US006936412B2

(12) United States Patent
Abe

(10) Patent No.: US 6,936,412 B2
(45) Date of Patent: Aug. 30, 2005

(54) METHOD OF FORMING COLOR IMAGES

(75) Inventor: Ryuji Abe, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/785,119

(22) Filed: Feb. 25, 2004

(65) Prior Publication Data

US 2004/0175660 A1 Sep. 9, 2004

(30) Foreign Application Priority Data

Feb. 27, 2003 (JP) ..... 2003-051735

(51) Int. Cl.[7] ..... G03C 7/46
(52) U.S. Cl. ..... 430/387; 430/558; 430/379
(58) Field of Search ..... 430/387, 558, 430/379

(56) References Cited

U.S. PATENT DOCUMENTS 4,764,456 A * 8/1988 Watanabe et al. ..... 430/558
6,379,878 B1 * 4/2002 Matsuda et al. ..... 430/558

FOREIGN PATENT DOCUMENTS

JP 9-222710 A 8/1997

* cited by examiner

*Primary Examiner*—Geraldine Letscher
(74) *Attorney, Agent, or Firm*—Sughrue Mion, PLLC

(57) ABSTRACT

A method of forming color images comprises forming an original image and duplicating the formed original image on a color photosensitive material having blue-, green- and red-sensitive silver halide emulsion layers on a transmission or reflective support. The formed original image contains a dye formed from a cyan coupler represented by formula (CC-1):

(CC-1)

wherein Ga represents —CC($R_{13}$)= or —N=; Gb represents —C($R_{13}$)= when Ga represents —N=, or Gb represents —N= when Ga represents —C($R_{13}$)=; $R_{11}$ and $R_{12}$ represent an electron-withdrawing group having a Hammett substituent constant σp value of 0.20 to 1.0; $R_{13}$ represents a substituent; and Y represents a hydrogen atom or a group capable of splitting-off by a coupling reaction with an oxidized product of an aromatic primary amine color developing agent; and wherein the red-sensitive layer has the maximum sensitivity wavelength, λmax (D), of spectral sensitivity distribution at each density of 630 to 670 nm.

7 Claims, No Drawings

METHOD OF FORMING COLOR IMAGES

CROSS-REFERENCE TO RELATED APPLICATIONS

This application is based upon and claims the benefit of priority from prior Japanese Patent Application No. 2003-051735, filed Feb. 27, 2003, the entire contents of which are incorporated herein by reference.

BACKGROUND OF THE INVENTION

1. Field of the Invention

The present invention relates to a method of forming color images. More particularly, the present invention relates to a method of forming duplicate color images exhibiting enhanced saturation and gradation reproduction.

2. Description of the Related Art

The today widespread color photographs can be broadly classified into the color negative film, color reversal film, color instant film, etc. for shooting, and the color paper, reversal paper, display film, etc. providing prints of images recorded in the shooting materials and subjected to viewing. Among the former shooting materials, positive photosensitive materials such as a color reversal film and an instant film are dual purpose materials that are shooting materials and simultaneously can be subjected to viewing. With respect to materials for exclusive use in shooting, print materials are absolutely needed because without corresponding print materials, viewing cannot be made. In this connection, with respect to dual purpose materials as well, print materials (duplicate materials) are needed when it is intended to store precious original images or to avoid damaging original images in, for example, processing thereof as a printing original, or when there are requirements for enlargement or use of multiple duplicates.

These print materials can be broadly classified into two types. The color reversal paper and color auto positive paper comprising a reflective support and subjected to viewing with reflected light, belong to the one type. The color duplicating film and display film comprising a transparent support or translucent support and subjected to viewing with transmitted light or projection, belong to the other type. Among these, the color duplicating film is demanded to have exactly the same quality as that of an original image, since the color duplicating film can be simultaneously viewed with the original image arranged sideways. Moreover, this color duplicating film may be used as an original for printing or stored as a stock photo for a prolonged period of time. Consequently, from the viewpoint of practical use as well, it is demanded to obtain a duplicate identical with the original image. However, in reality, it is extremely difficult to reproduce exactly the same image quality because of the performance of photosensitive material, performance of printer equipment, print technology, etc.

The quality of color images is principally determined by three elements, namely, gradation reproduction, color reproduction and image quality reproduction (granularity and sharpness). Among these, the gradation reproduction is of the utmost importance for the color duplicating film demanded to realize faithful reproduction.

Furthermore, with respect to the color duplicating film, it is believed that the use of dupe films in printing, etc. should be minimized because of the deterioration of saturation and change of color from those of the original image with the exception that extinguishment of original images by cut-and-paste, retouch, etc. is anticipated. Accordingly, there has been a demand for improvement thereof. With respect to the color reversal paper as well, due to the deterioration of saturation and change of color from those of the original image, there has been a demand for improvement thereof.

Heretofore, with respect to tone reproduction, attempts aiming at faithful reproduction not accompanied by deterioration of the tone of original image have been conducted (see, for example, R. M. Evans, Principles of Color Photography, 1953). In this technical literature, there are respective descriptions for the instance where the hues of color-forming dyes of a color photosensitive material for use as an original image and a color photosensitive material for print are identical with each other, and the instance where the hues are different from each other. However, the contents thereof only present an idealized discussion separately presuming the instance where the hues are identical with each other and the instance where the hues are different from each other. There is no description regarding the technique and means for simultaneously coping with the two instances.

As means for solving these, there has been proposed a method of regulating the wavelength of maximum sensitivity in the spectral sensitivity distribution of each color sensitive layer and regulating the point gamma of characteristic curve thereof (see, for example, Jpn. Pat. Appln. KOKAI Publication No. (hereinafter referred to as JP-A-) 9-222702). This method includes special device with respect to the spectral sensitivity of especially a red sensitive layer but is for the external system (system in which color couplers are supplied from processing solutions) whose market share is now substantially nil. In the current situation wherein the market share is substantially entirely occupied by the internal system (system in which color couplers are incorporated in photosensitive materials), the tone reproduction is unsatisfactory.

Further, in recent years, cyan couplers and magenta couplers having unfavorable absorptions reduced have been developed, and studies have been conducted for enhancing the color reproduction of photosensitive materials for shooting (see, for example, JP-A-2001-142181). Still further, the method of forming color images with the use of the same cyan coupler and same magenta coupler having unfavorable absorptions reduced in both a photosensitive material for shooting and a photosensitive material for duplication is known (see, for example, JP-A-9-222710). Desirable tone reproduction cannot be attained by this method, and hence improvements are demanded.

BRIEF SUMMARY OF THE INVENTION

It is an object of the present invention to provide a method of forming a duplicate color image exhibiting enhanced saturation and enhanced gradation reproduction. It is an especial object of the present invention to provide a method of forming a faithful duplicate image with respect to transmission type color reversal photosensitive materials.

The inventor has found that the objects of the present invention can be attained by the following means.

(1) A method of forming color images, comprising forming an original image on an image-forming material and duplicating the formed original image on a color photosensitive material for use in the duplication, the color photosensitive material for use in the duplication comprising at least one blue-sensitive silver halide emulsion layer containing a yellow coupler, at least one green-sensitive silver halide emulsion layer containing a magenta coupler and at least one red-sensitive silver halide emulsion layer containing a cyan coupler on a support of a transmission-type or reflection-type, wherein the formed original image contains a dye formed from a cyan coupler selected from among compounds represented by the following general formula (CC-1), and wherein with respect to the red-sensitive silver halide emulsion layer of the color photosensitive material for use in the duplication, the maximum sensitivity wavelength, λmax (D), of spectral sensitivity distribution at each density satisfies the relationship:

$$630\ \text{nm} \leqq \lambda\max(D) \leqq 670\ \text{nm}.$$

(CC-1)

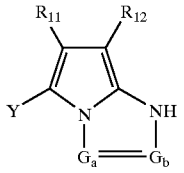

In the general formula (CC-1), Ga represents —C($R_{13}$)═ or —N═; Gb represents —C($R_{13}$)═ when Ga represents —N═, or Gb represents —N═ when Ga represents —C($R_{13}$)═; each of $R_{11}$ and $R_{12}$ represents an electron-withdrawing group having a Hammett substituent constant σp value of 0.20 to 1.0; $R_{13}$ represents a substituent; Y represents a hydrogen atom or a group capable of splitting-off by a coupling reaction with an oxidized product of an aromatic primary amine color developing agent.

(2) The method of forming color images according to item (1) above, wherein the color photosensitive material for use in the duplication contains a cyan coupler selected from among compounds represented by the above general formula (CC-1).

(3) The method of forming color images according to item (1) or (2) above, wherein the color photosensitive material for use in the duplication contains a magenta coupler selected from among compounds represented by the following general formula (MC-1):

(MC-1)

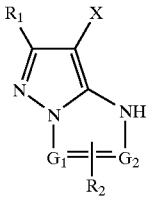

In formula (MC-1), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent, or a polymer chain may be bonded to the magenta coupler via $R_1$ or $R_2$. X represents a hydrogen atom or a group capable of splitting-off by a coupling reaction with an oxidized product of an aromatic primary amine color developing agent.

(4) The method of forming color images according to any of items (1) to (3) above, wherein the color photosensitive material for use in the duplication contains a yellow coupler selected from among compounds represented by the following general formula (YC-1):

(YC-1)

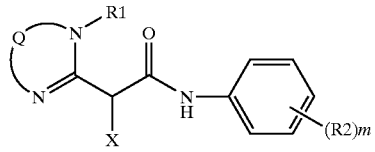

In this formula, Q represents a nonmetallic atomic group capable of forming a 5- to 7-membered ring in cooperation with —N═C—N(R1)—. R1 represents a substituent. R2 represents a substituent. m is an integer of 0 to 5. When m is 2 or greater, two or more R2s may be identical with or different from each other, and may be bonded with each other to thereby form a ring. X represents a hydrogen atom or a group capable of splitting-off by a coupling reaction with an oxidation product of a developing agent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The couplers preferably used in the present invention will be described in detail below.

Firstly, the coupler represented by the general formula (CC-1) will be described.

In the general formula (CC-1), Ga represents —C($R_{13}$)═ or —N═; Gb represents —C($R_{13}$)═ when Ga represents —N═, or Gb represents —N═ when Ga represents —C($R_{13}$)═; Y represents a hydrogen atom or a group capable of splitting-off by a coupling reaction with an oxidized product of an aromatic primary amine color developing agent (hereinafter also referred to as "a split-off group"). Each of $R_{11}$ and $R_{12}$ represents an electron-withdrawing group having a Hammett substituent constant σp value of 0.20 to 1.0. $R_{13}$ represents a substituent.

Although both $R_{11}$ and $R_{12}$ represent an electron-withdrawing group having a Hammett substituent constant σp value of 0.20 to 1.0, the sum of the σp values of $R_{11}$ and $R_{12}$ is desirably 0.65 or more. The coupler of the invention is given superior performance as a cyan coupler by introducing this strong electron-withdrawing group. The sum of the σp values of $R_{11}$ and $R_{12}$ is preferably 0.70 or more, and its upper limit is about 1.8.

In the invention, each of $R_{11}$ and $R_{12}$ is an electron-withdrawing group with a Hammett substituent constant σp value (hereinafter also referred to as "a up value") of 0.20 to 1.0. Preferably each of $R_{11}$ and $R_{12}$ is an electron-withdrawing group having a σp value of 0.30 to 0.8.

The Hammett's rule is an empirical rule proposed by L. P. Hammett in 1935 in order to quantitatively argue the effects of substituents on reaction or equilibrium of benzene derivatives. The rule is widely regarded as appropriate in these days. The substituent constants obtained by the Hammett rule include a σp value and a σm value, and these values are described in a large number of general literature. For example, the values are described in detail in J. A. Dean ed., "Lange's Hand Book of Chemistry," the 12th edition, 1979 (McGraw-Hill), "The Extra Number of The Domain of Chemistry," Vol. 122, pages 96 to 103, 1979 (Nanko Do) and Chemical Reviews, vol. 91, pp.165–195 (1991), the disclosures of which are incorporated herein by reference. In the invention, each of $R_{11}$ and $R_{12}$ is defined by the Hammett substituent constant σp value. However, this does not mean that $R_{11}$ and $R_{12}$ are limited to substituents having the already known values described in these literature. That is, the invention includes, of course, substituents having values that fall within the above range when measured on the basis of the Hammett's rule even if they are unknown in literature.

Practical examples of $R_{11}$ and $R_{12}$, as the electron-withdrawing group with a σp value of 0.20 to 1.0, are an acyl group, acyloxy group, carbamoyl group, aliphatic oxycarbonyl group, aryloxycarbonyl group, cyano group, nitro group, dialkylphosphono group, diarylphosphono group, diarylphosphinyl group, alkylsulfinyl group, arylsulfinyl group, alkylsulfonyl group, arylsulfonyl group, sulfonyloxy group, acylthio group, sulfamoyl group, thiocyanate group, thiocarbonyl group, alkyl group substituted by at least two halogen atoms, alkoxy group substituted by at least two halogen atoms, aryloxy group substituted by at least two halogen atoms, alkylamino group substituted by at least two halogen atoms, alkylthio group substituted by at least two halogen atoms, aryl group substituted by another electron-withdrawing group with a σp value of 0.20 or more, heterocyclic group, chlorine atom, bromine atom azo group, and selenocyanate group. Of these substituents, those capable of further having substituents can further have substitutes to be mentioned later for $R_{13}$.

The aliphatic portion of the aliphatic oxycarbonyl group can be straight-chain, branched-chain, or cyclic and can be saturated or can contain an unsaturated bond. This aliphatic oxycarbonyl group includes, e.g., alkoxycarbonyl, cycloalkoxycarbonyl, alkenyloxycarbonyl, alkinyloxycarbonyl, and cycloalkenyloxycarbonyl.

The σp values of representative electron-withdrawing groups having a σp value of 0.2 to 1.0 are a bromine atom (0.23), chlorine atom (0.23), cyano group (0.66), nitro group (0.78), trifluoromethyl group (0.54), tribromomethyl group (0.29), trichloromethyl group (0.33), carboxyl group (0.45), acetyl group (0.50), benzoyl group (0.43), acetyloxy group (0.31), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60), and sulfamoyl group (0.57). Each of the numbers in parenthesis is σp value.

$R_{11}$ preferably represents a cyano group, aliphatic oxycarbonyl group (a 2- to 36-carbon, straight-chain or branched-chain alkoxycarbonyl group, aralkyloxycarbonyl group, alkenyloxycarbonyl group, alkinyloxycarbonyl group, cycloalkoxycarbonyl group, or cycloalkenyloxycarbonyl group, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, or 2,6-di-t-butyl-4-methylcylohexyloxycarbonyl); dialkylphosphono group (a 2- to 36-carbon dialkylphosphono group, e.g., diethylphosphono or dimethylphosphono); alkylsulfonyl or arylsulfonyl group (a 1- to 36-carbon alkylsulfonyl or 6- to 36-carbon arylsulfonyl group, e.g., a methanesulfonyl group, butanesulfonyl group, benzenesulfonyl group, or p-toluenesulfonyl group); or fluorinated alkyl group (a 1- to 36-carbon fluorinated alkyl group, e.g., trifluoromethyl). $R_{11}$ is particularly preferably a cyano group, aliphatic oxycarbonyl group, or fluorinated alkyl group, and most preferably, a cyano group.

$R_{12}$ preferably represents an aliphatic oxycarbonyl group as mentioned above for $R_{11}$; carbamoyl group (a 1- to 36-carbon carbamoyl group, e.g., diphenylcarbamoyl or dioctylcarbamoyl); sulfamoyl group (a 1- to 36-carbon sulfamoyl, e.g., dimethylsulfamoyl or dibutylsulfamoyl); dialkylphosphono group mentioned above for $R_{11}$; diarylphosphono group (a 12- to 50-carbon diarylphosphono group, e.g., diphenylphosphono or di(p-tolyl)phosphono). $R_{12}$ is particularly preferably a group represented by the following formula (Z):

(Z)

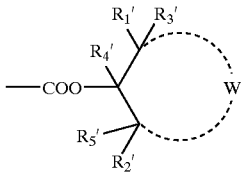

In the formula (X), each of $R_1'$ and $R_2'$ represents an aliphatic group, e.g., a 1- to 36-carbon, straight-chain or branched-chain alkyl group, aralkyl group, alkenyl group, alkinyl group, cycloalkyl group, or cycloalkenyl group, and more specifically, methyl, ethyl, propyl, isopropyl, t-butyl, t-amyl, t-octyl, tridecyl, cyclopentyl, cyclohexyl, vinyl allyl, 1-propenyl, or 2-pentenyl. Each of $R_3'$, $R_4'$ and $R_5'$ represents a hydrogen atom or aliphatic group. Examples of the aliphatic group are those mentioned above for $R_1'$ and $R_2'$. Each of $R_3'$, $R_4'$, and $R_5'$ is preferably a hydrogen atom.

W represents a non-metallic atomic group required to form a 5- to 8-membered ring. This ring may be substituted, may be a saturated ring, or can have an unsaturated bond. A non-metallic atom is preferably a nitrogen atom, oxygen atom, sulfur atom, or carbon atom, and more preferably, a carbon atom.

Examples of a ring formed by W are a cyclopentane ring, cyclohexane ring, cycloheptane ring, cyclooctane ring, cyclohexene ring, piperazine ring, oxane ring, and thiane ring. These rings can be substituted by a substituents represented by $R_{13}$ to be described below.

A ring formed by W is preferably a cyclohexane ring which may be substituted, and most preferably, a cyclohexane ring whose 4-position is substituted by a 1- to 36-carbon alkyl group (which may be substituted by a substituent represented by $R_{13}$ to be described below).

$R_{13}$ represents a substituent. Examples are those mentioned above for $R_2$ in formula (MC-1).

Among the substituents, $R_{13}$ is preferably an alkyl group, aryl group, alkoxy group, aryloxy group, alkylthio group, ureido group, urethane group, or acylamino group.

Y represents a hydrogen atom or a group capable of splitting-off when the coupler reacts with an aromatic primary amine color developing agent in an oxidized form. When Y represents a split-off group, examples are those to be described later in the explanation of X of the general formula (MC-1).

Y is preferably a hydrogen atom, halogen atom, aryloxy group, heterocyclic acyloxy group, dialkylphosphonooxy group, arylcarbonyloxy group, arylsulfonyloxy group, alkoxycarbonyloxy group, or carbamoyloxy group. Also, it is also preferable that the split-off group or a compound released from the split-off group has a property of further reacting with an aromatic primary amine color developing agent in an oxidized form. For example, the split-off group is a non-color-forming coupler, hydroquinone derivative, aminophenol derivative, sulfonamidophenol derivative. In the present invention, Y is preferably a hydrogen atom, halogen atom or carbamoyloxy group.

The coupler represented by the general formula (CC-1) may be in a form of a dimer or higher polymer wherein the group represented by $R_{12}$ or $R_{13}$ has a residue of the coupler represented by the general formula (CC-1). The coupler represented by the general formula (CC-1) may be in a homopolymer or copolymer wherein the group represented by $R_{12}$ or $R_{13}$ has a polymer chain. A typical example of the homopolymer or copolymer containing the polymer chain is a homopolymer or copolymer of an addition polymerized ethylenic unsaturated compounds having the coupler residue represented by the general formula (CC-1). In this case, one or more kinds of cyan color-forming repeating unit having the coupler residue represented by the general formula (CC-1) may be contained in the polymer. The copolymer may be one having, as copolymerization component, one or more non-color-forming ethylenic monomer that does not couple with an aromatic primary amine developing agent in an oxidized form, such as acrylic ester, methacrylic ester and maleic ester. The number of repeating units in the polymer is preferably 100–1000.

As preferred examples of the cyan couplers represented by the general formula (CC-1), there can be mentioned those of the following general formula (CC-2):

(CC-2)

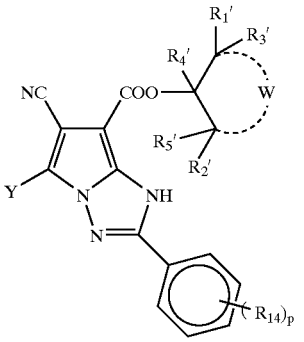

In the general formula (CC-2), $R_{14}$ represents a substituent other than a hydrogen atom. p is a natural number of 1 to 5, and when p is 2 or greater, two or more $R_{14}$s may be wholly identical with or different from each other. $R_1'$, $R_2'$, $R_3'$, $R_4'$ and $R_5'$ are as defined above with respect to the general formula (Z) mentioned in the description of $R_{12}$ of the general formula (CC-1). Y has the same meaning as that of the general formula (CC-1).

The general formula (CC-2) will be described below. As examples of the substituents represented by $R_{14}$, there can be mentioned those set forth with respect to $R_{13}$ of the general formula (CC-1). Preferred examples of the substituents represented by $R_{14}$ include a chlorine atom, fluorine atom, alkyl group, alkoxy group, amino group, alkylthio group, arylthio group, aryloxy group, acylamino group, sulfonylamino group, carbamoyl group, sulfamoyl group, carbonyloxy group, oxycarbonyl group, ureido group, oxycarbonylamino group, aminocarbonyloxy group, carboxyl group, cyano group and heterocycle group. When p is 2 or greater, at least one of the $R_{14}$s is preferably a substituent whose total number of carbon atoms is in the range of 6 to 80, more preferably an alkyl group, alkoxy group, acylamino group, sulfonylamino group, carbamoyl group, sulfamoyl group, carbonyloxy group, oxycarbonyl group, aminocarbonylamino group, oxycarbonylamino group or aminocarbonyloxy group whose total number of carbon atoms is in the range of 6 to 80 (still more preferably the total number of carbon atoms is in the range of 10 to 60). When $R_{14}$ is a group whose total number of carbon atoms is in the range of 6 to 80, the substitution position thereof is preferably meta or para, more preferably meta, to the pyrrolotriazole moiety on the phenyl group of the general formula (CC-2).

The most preferred couplers represented by the general formula (CC-2) are those wherein each of $R_1'$ and $R_2'$ is a tertiary alkyl group; each of $R_3'$, $R_4'$ and $R_5'$ is a hydrogen atom; the ring formed by W is a cyclohexane ring; p is 2 or 3; and at least one of the $R_{14}$s is a group selected from among an alkoxy group, acylamino group, sulfonylamino group, carbamoyl group, sulfamoyl group, carbonyloxy group, oxycarbonyl group, aminocarbonylamino group, oxycarbonylamino group and aminocarbonyloxy group whose total number of carbon atoms is in the range of 10 to 60. Among these couplers, those having a substituent on the phenyl group at the meta position to the pyrrolotriazole moiety and having a substituent of an alkoxy group, aryloxy group or amino group on the phenyl group at the para position to the pyrrolotriazole moiety are preferred. As the substituent at the para position, amino is most preferred. Y is preferably a hydrogen atom, halogen atom or carbamoyloxy group.

Specific examples of the couplers of the general formula (CC-1) will be shown below, which should not be construed as limiting the scope of the present invention.

CC-1

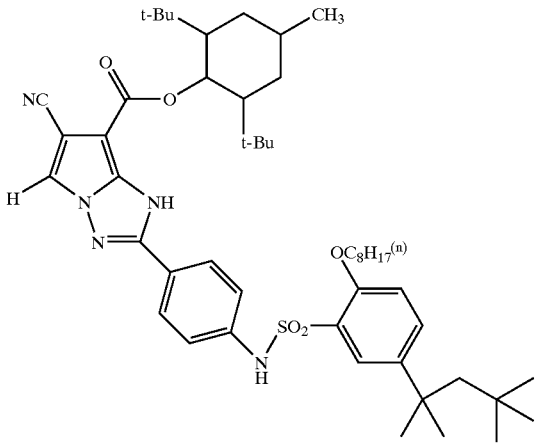

CC-2

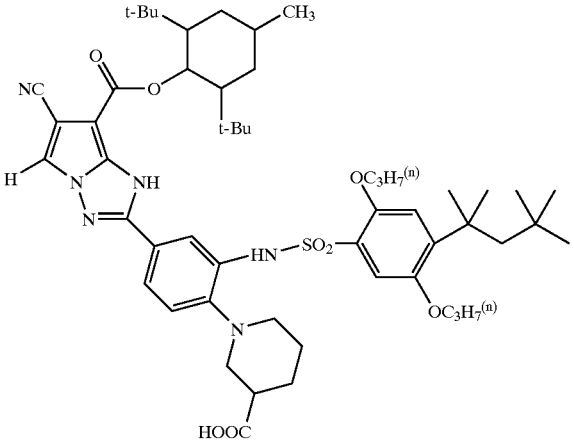

-continued
CC-3
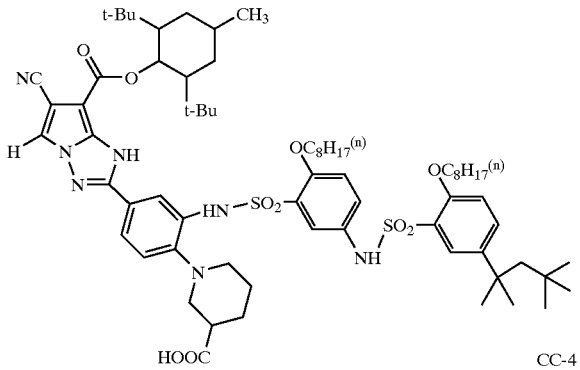
CC-4
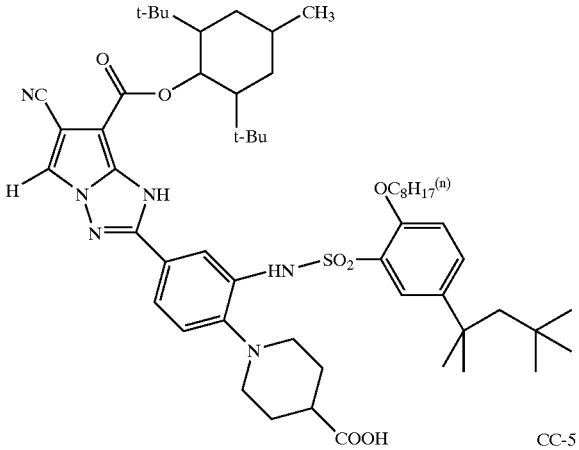
CC-5
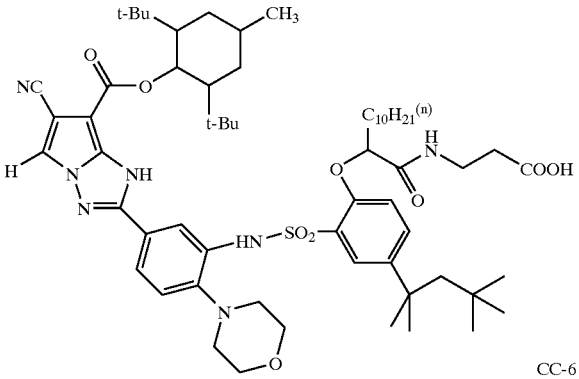
CC-6
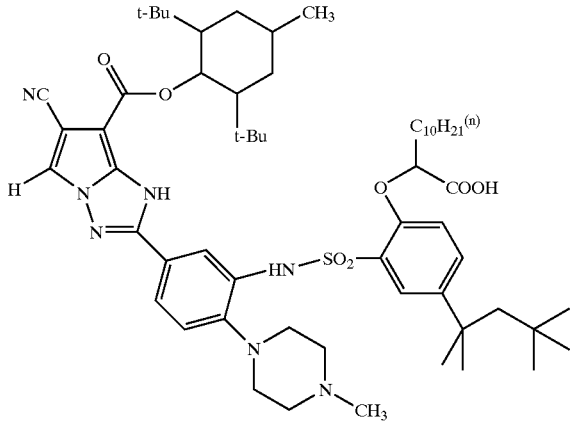
-continued
CC-7
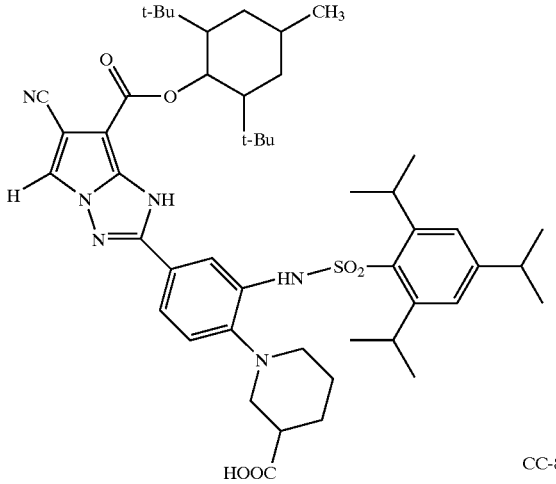
CC-8
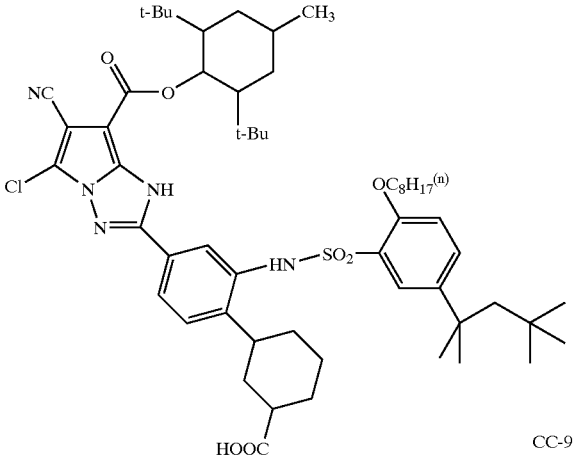
CC-9
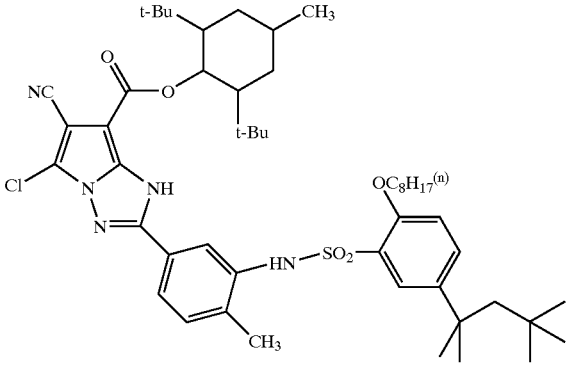
CC-10
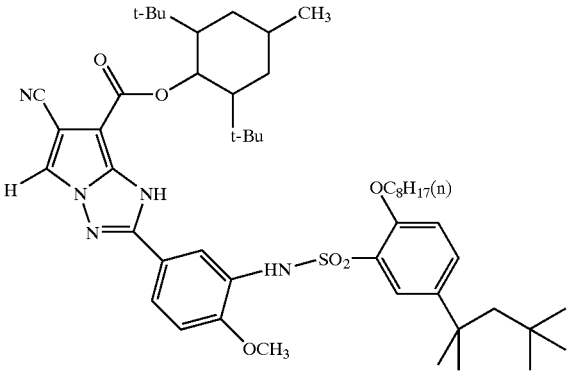

-continued
CC-11
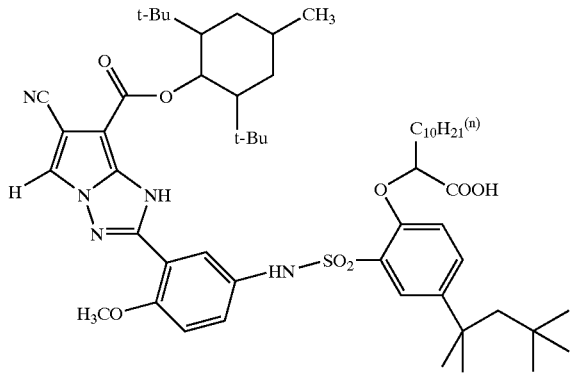
CC-12
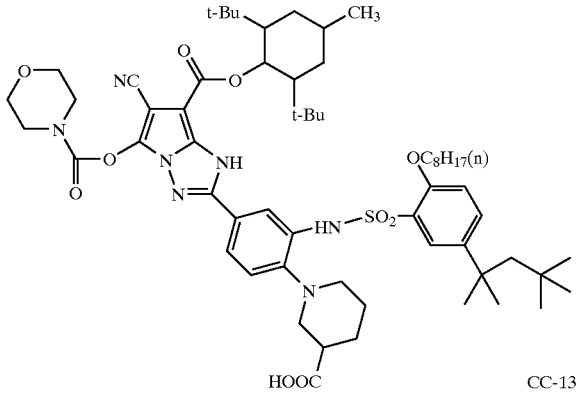
CC-13
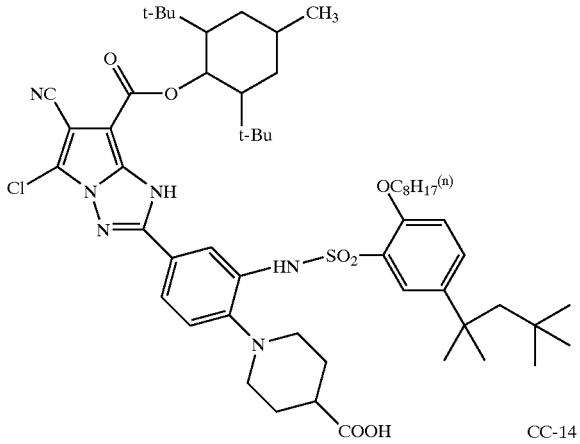
CC-14
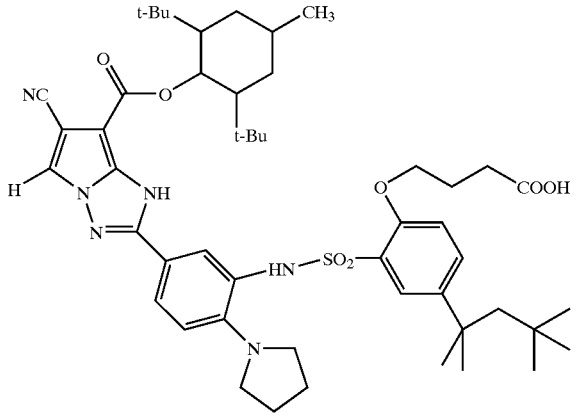
-continued
CC-15
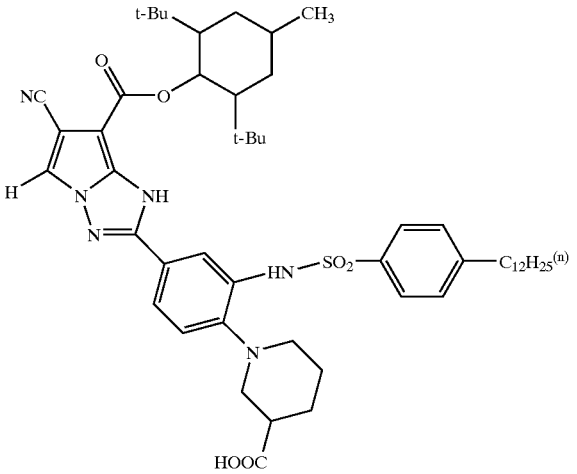
CC-16
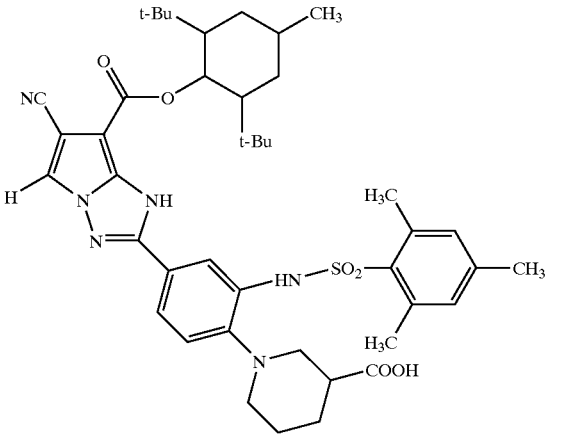
CC-17
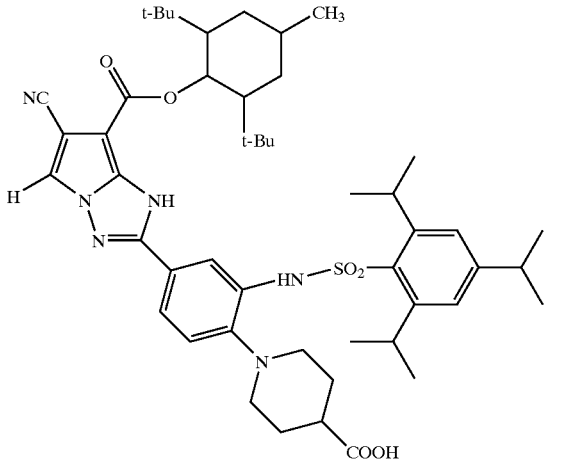

-continued
CC-18
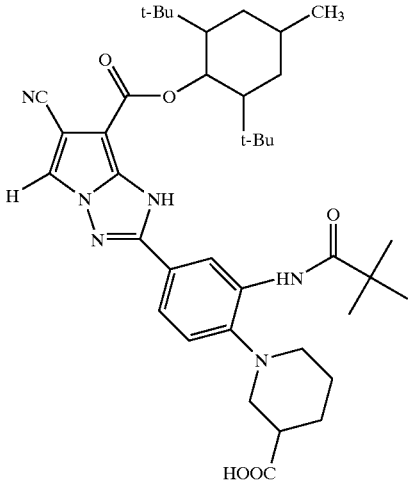
CC-19
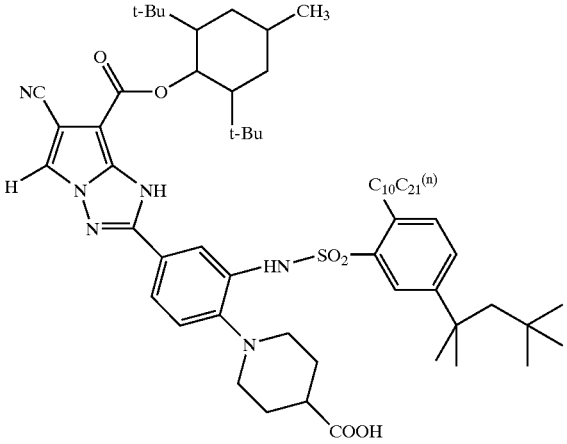
CC-20
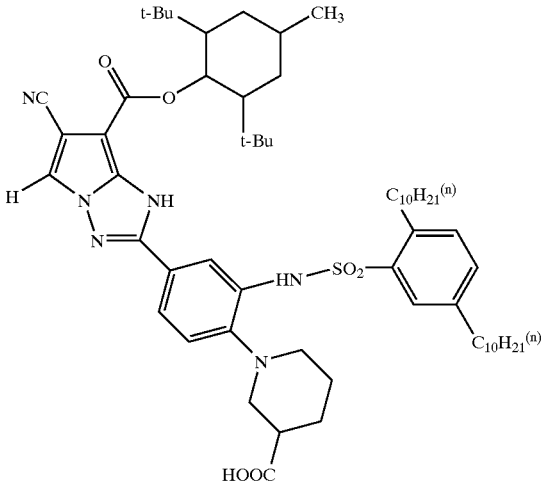
-continued
CC-21
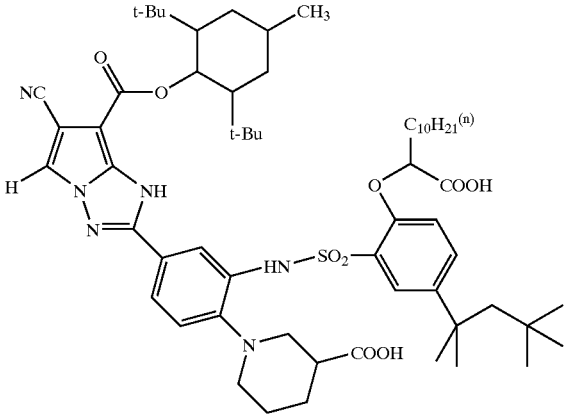
CC-22
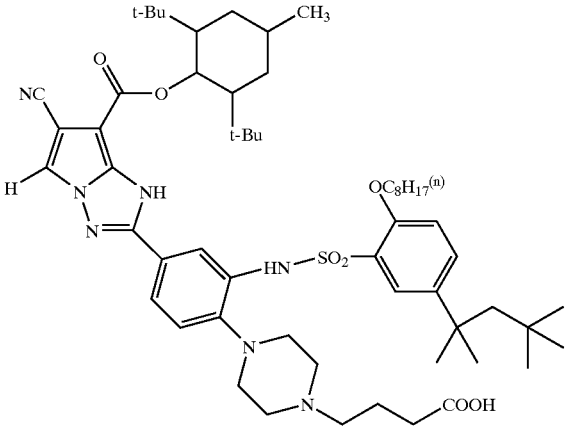
CC-23
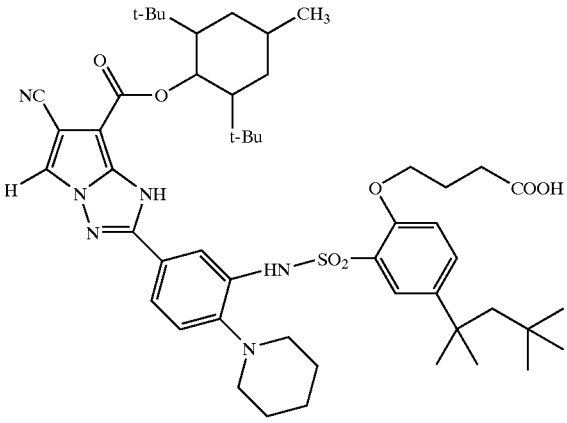

-continued
CC-24
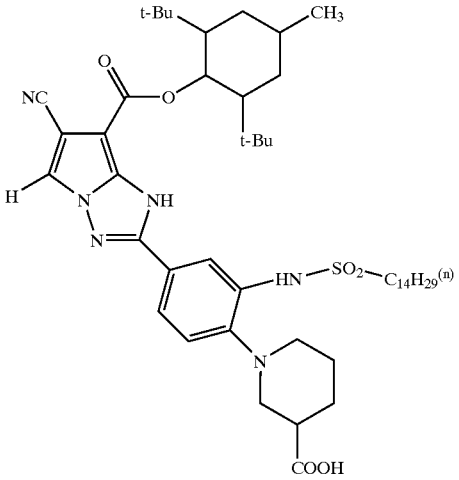
CC-25
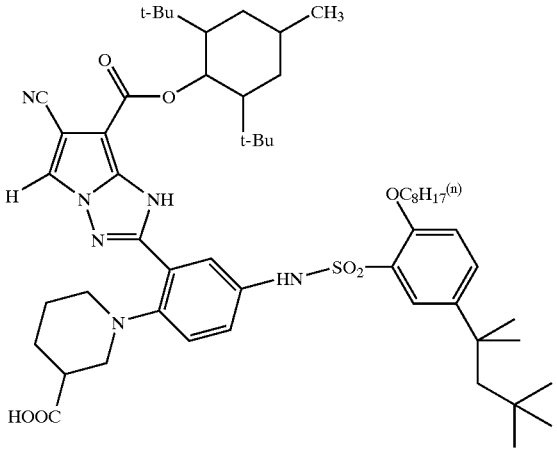
CC-26
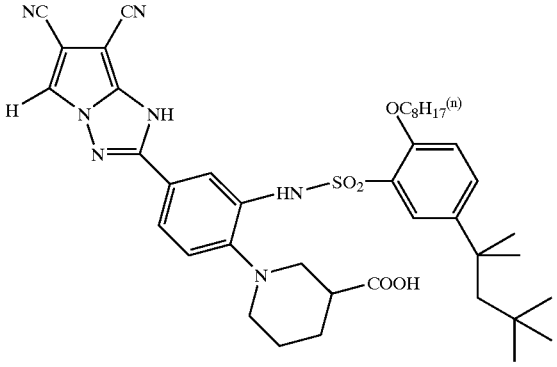
-continued
CC-27
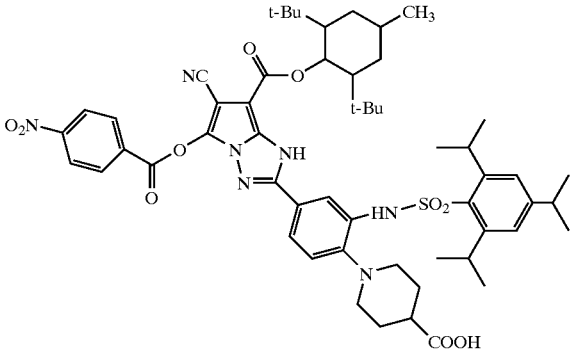
CC-28
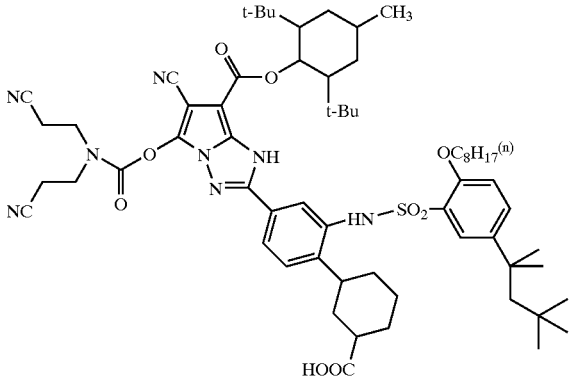
CC-29
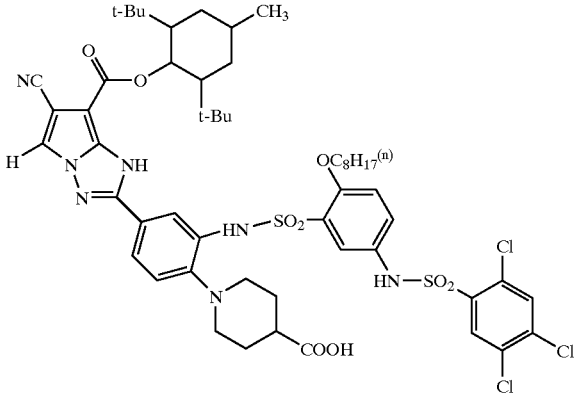
CC-30
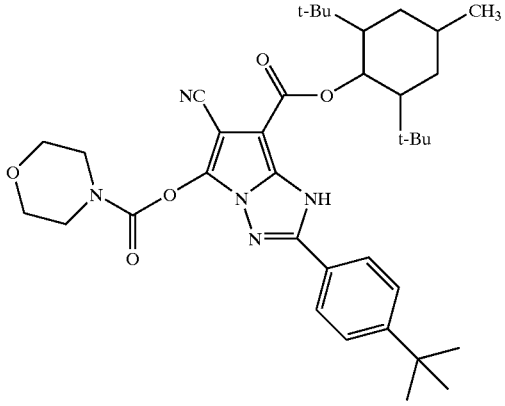

The compound represented by the general formula (CC-1) of the invention may be synthesized by known methods such as those described, for example, in J. C. S., 1961, page 518; J.C.S., 1962, page 5149; Angew. Chem., vol. 72, page 956 (1960) and Berichte, vol. 97, page 3436 (1964) or methods cited therein or analogous methods.

Next, the magenta image-forming dye of the present will be explained below.

In the formula (MC-1), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent, a polymer of the general formula (MX-1) may be formed or a polymer chain may be bonded to the magenta coupler via $R_1$ or $R_2$. X represents a hydrogen atom or a split-off group.

The general formula (MC-1) will be described in detail. In the formula, $R_1$ represents a hydrogen atom or a substituent selected from an alkyl group, aralkyl group, aryl group, alkoxy group, aryloxy group, amino group, acylamino group, arylthio group, alkylthio group, ureido group, alkoxycarbonylamino group, carbamoyloxy group, and heterocyclic thio group, all of which may have a substituent.

Examples of the substituent represented by $R_1$ can be an alkyl group (e.g., methyl, ethyl, isopropyl, t-butyl, t-amyl, adamantly, 1-methylcyclopropyl, n-octyl, cyclohexyl, 2-methanesulfonylethyl, 3-(3-pentadecylphenoxy)propyl, 3-{4-{2-[4-(4-hydroxyphenylsulfonyl)phenoxy]dodecanamide}phenyl}propyl, 2-ethoxytridecyl, trifluoromethyl, cyclopentyl, and 3-(2,4-di-t-amylphenoxy)propyl); aralkyl group (e.g., benzyl, 4-methoxybenzyl, and 2-methoxybenzyl); aryl group (e.g., phenyl, 4-t-butylphenyl, 2,4-di-t-amylphenyl, and 4-tetradecanamidophenyl); alkoxy group (e.g., methoxy, ethoxy, 2-methoxyethoxy, 2-dodecylethoxy, 2-methanesulfonylethoxy, and 2-phenoxyethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); amino group (including an anilino group, e.g., methylamino, ethylamino, anilino, dimethylamino, diethylamino, t-butylamino, 2-methoxyanilino, 3-acetylaminoanilino, and cyclohexylamino); acylamino group (e.g., acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido); ureido group (e.g., phenylureido, methylureido, and N,N-dibutylureido); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio and 4-tetradecanamidephenylthio); alkoxycarbonyamino group (e.g., methoxycarbonylamino, and tetradecyloxycarbonyamino); carbamoyloxy group (e.g., N-methylcarbamoyloxy, and N-phenylcarbamoyloxy); heterocyclic thio group (e.g., 2-benzothiazolyl thio, 2,4-diphenoxy-1,3,5-triazole-6-thio, and 2-pyridylthio).

Among the above-mentioned groups, alkyl group, aralkyl group, aryl group, alkoxy group, aryloxy group, and amino group are preferable. More preferably, secondary alkyl and tertiary alkyl groups each having a total of 3- to 15-carbon, and most preferably a 4-to 10-carbon tertiary alkyl group.

X represents a hydrogen atom or a split-off group capable of leaving upon a coupling reaction with an aromatic primary amine color developing agent in an oxidized form. Specifically, the split-off group includes a halogen atom, alkoxy group, aryloxy group, acyloxy group, alky- or arylsulfonyloxy group, acylamino group, alkyl- or arylsulfonylamido group, alkoxycarbonyloxy group, aryloxycarbonyloxy group, alkyl-, aryl-, or heterocyclic-thio group, carbamoylamino group, carbamoyloxy group, 5- or 6-memebered nitrogen-containing heterocyclic group, imido group, and arylazo group. These groups may be further substituted with the substituents represented by $R_2$.

More specifically, examples of X are a halogen atom (e.g., a fluorine atom, chlorine atom, and bromine atom); alkoxy group (e.g., ethoxy, dodecyloxy, methoxyethylcarbamoylmethoxy, carboxypropyloxy, methylsulfonylethoxy, and ethoxycarbonylmethoxy); aryloxy group (e.g., 4-methylphenoxy, 4-chlorophenoxy, 4-methoxyphenoxy, 4-carboxyphenoxy, 4-methoxycarboxyphenoxy, 4-carbamoylphenoxy, 3-ethoxycarboxyphenoxy, 3-acetylaminophenoxy, and 2-carboxyphenoxy); acyloxy group (e.g., acetoxy, tetradecanoyloxy, and benzoyloxy); alkyl- or arylsulfonyloxy group (e.g., methanesulfonyloxy and toluenesulfonyloxy); acylamino group (e.g., dichloroacetylamino and heptafluorobutylylamino), alkyl- or arylsulfonamido group (e.g., methanesulfonamido, trifluoromethanesulfonamido, and p-toluenesulfonylamido); alkoxycarbonyloxy group (e.g., ethoxycarbonyloxy and benzyloxycarbonyloxy); aryloxycarbonyloxy group (e.g., phenoxycarbonyloxy); alkyl-, aryl-, or heterocyclic-thio group (e.g., dodecylthio, 1-carboxydodecylthio, phenylthio, 2-butoxy-5-t-octylphenylthio, and tetrazolylthio); carbamoylamino group (e.g., N-methylcarbamoylamino and N-phenylcarbamoylamino); carbamoyloxy group (e.g., N,N-dimethylcarbamoyloxy, N-phenylcarbamoyloxy, morpholinylcarbamoyloxy, and pyrrolidinylcarbamoyloxy); 5- or 6-membered nitrogen-containing heterocyclic group (e.g., imidazolyl, pyrazolyl, triazolyl, tetrazolyl, and 1,2-dihydro-2-oxo-1-pyridyl); imido group (e.g., succinimido and hydantoinyl); and arylazo group (e.g., phenylazo and 4-methoxyphenylazo). X can also take the form of a bis coupler obtained by condensing a 4-equivalent coupler by aldehydes or ketones, as a split-off group bonded via a carbon atom.

X is preferably a hydrogen atom, halogen atom, alkoxy group, aryloxy group, alkyl- or aryl-thio group, or 5- or 6-membered nitrogen-containing heterocyclic group that is bonded to the coupling active position via the nitrogen atom, and particularly preferably, a hydrogen atom, chlorine atom, or phenoxy group that may be substituted.

One of $G_1$ and $G_2$ is a nitrogen atom, and the other is a carbon atom. $R_2$ in the formula (MC-1) is bonded to one of $G_1$ and $G_2$ which is a carbon atom.

$R_2$ represents a substituent. Examples are a halogen atom, aliphatic group, aryl group, heterocyclic group, cyano group, hydroxyl group, nitro group, carboxyl group, amino group, alkoxy group, aryloxy group, acylamino group, alkylamino group, anilino group, ureido group, sulfamoylamino group, alkylthio group, arylthio group, alkoxycarbonylamino group, sulfonamido group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imido group, heterocyclic thio group, sulfinyl group, phosphonyl group, aryloxycarbonyl group, acyl group, and azolyl group. These substituents may have a substituent.

More specifically, examples of a substituent represented by $R_2$ are a halogen atom (e.g., a chlorine atom and bromine atom); alkyl group (e.g., a 1- to 32-carbon, straight-chain or branched-chain alkyl group, aralkyl group, alkenyl group, alkinyl group, cycloalkyl group and cycloalkenyl group; more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecanamid o}phenyl}propyl, 2-ethoxytridecyl, trifluoromethyl, cyclopentyl, and 3-(2,4-di-t-amylphenoxy) propyl); aryl group (e.g., phenyl, 4-t-butylphenyl, 2,4-di-t-amylphenyl, and 4-tetradecanamidophenyl); heterocyclic group (e.g., 2-furyl, 2-thienyl, 2-pyrimidinyl, and 2-benzothiazolyl); cyano group; hydroxyl group; nitro group; carboxyl group; amino group; alkoxy group (e.g., methoxy, ethoxy, 2-methoxyethoxy, 2-dodecylethoxy, and 2-methanesulfonylethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); acylamino group (e.g., acetamido, benzamido, tetradecanamido, 2-(2,4-di-t-amylphenoxy)butanamido, 4-(3-t-butyl-4-hydroxyphenoxy) butanamido, 2-{4-(4-hydroxyphenylsulfonyl) phenoxy}decanamido); alkylamino group (e.g., methylamino, butylamino, dodecylamino, diethylamino, and methylbutylamino); anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{α-(3-t-butyl-4-hydroxyphenoxy) dodecanamido}anilino); ureido group (e.g., phenylureido, methylureido, and N,N-dibutylureido); sulfamoylamino group (e.g., N,N-dipropylsulfamoylamino and N-methyl-N-decylsulfamoylamino); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio, and 4-tetradecanamidophenylthio); alkoxycarbonylamino group (e.g., methoxycarbonylamino and tetradecyloxycarbonylamino); sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido); carbamoyl group (e.g., N-ethylcarbamoyl, N,N-dibutylcarbamoyl, N-(2-dodecyloxyethyl)carbamoyl, N-methyl-N-dodecylcarbamoyl, and N-(3-(2,4-di-t-amylphenoxy) propyl)carbamoyl); sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl); sulfonyl group (e.g., methanesulfonyl, octanesulfonyl, benzenesulfonyl, and toluenesulfonyl); alkoxycarbonyl group (e.g., methoxycarbonyl, butyloxycarbonyl, dodecyloxycarbonyl, and octadecyloxycarbonyl); heterocyclic oxy group (e.g., 1-phenyltetrazole-5-oxy and 2-tetrahydropyranyloxy); azo group (e.g., phenylazo, 4-methoxphenylazo, 4-pyvaloylaminophenylazo, and 2-hydroxy-4-propanoylphenylazo); acyloxy group (e.g., acetoxy); carbamoyloxy group (e.g., N-methylcarbamoyloxy and N-phenylcarbamoyloxy); silyloxy group (e.g., trimethylsilyloxy and dibutylmethylsilyloxy); aryloxycarbonylamino group (e.g., phenoxycarbonylamino); imido group (e.g., N-succinimido, N-phthalimido, and 3-octadecenylsuccinimido); heterocyclic thio group (e.g., 2-benzothiazolylthio, 2,4-di-phenoxy-1,3,5-trizole-6-thio, and 2-pyridylthio); sulfinyl group (e.g., dodecanesulfinyl, 3-pentadecylphenylsulfinyl, and 3-phenoxypropylsulfinyl); phosphonyl group (e.g., phenoxyphosphonyl, octyloxyphosphonyl, and phenylphosphonyl); aryloxycarbonyl group (e.g., phenoxycarbonyl); acyl group (e.g., acetyl, 3-phenylpropanoyl, benzoyl, and 4-dodecyloxybenzoyl); and azolyl group (e.g., imidazolyl, pyrazolyl, 3-chloro-pyrazole-1-yl, and triazole).

In a case where a group represented by $R_2$ can further have a substituent, such further substituent may be an organic substituent that is bonded to $R_2$ via a carbon atom, oxygen atom, nitrogen atom, or sulfur atom thereof, or a halogen atom.

Preferable substituents as $R_2$ are an alkyl group, aryl group, alkoxy group, aryloxy group, alkylthio group, ureido group, alkoxycarbonylamino group, and acylamino group. More preferably, $R_2$ is a group having the total carbon atoms of 6 to 70 and having an alkyl group or aryl group as a partial structure thereof, thereby providing immobility to the coupler represented by the general formula (MC-1). Herein, the terms "$R_2$ has an alkyl group or aryl group as a partial structure thereof" include the cases where R2 is a substituent having an alkyl group or aryl group as a further substituent thereof, and also where $R_2$ itself is an alkyl group or aryl group. The same can be applied to groups other than $R_2$.

Formula (MC-1) is more preferably a compound in which $R_2$ is a substituent represented by the following general formula (BL-1) or (BL-2) below:

(BL-1)

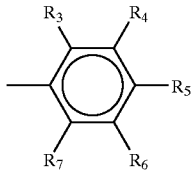

(BL-2)

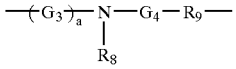

In the general formula (BL-1), each of $R_3$, $R_4$, $R_5$, $R_6$ and $R_7$ independently represents a hydrogen atom or a substituent, and at least one of them represents a substituent having the total carbon atoms of 4 to 70 and containing a substituted or unsubstituted alkyl group as a partial structure thereof, or a substituent having the total carbon atoms of 6 to 70 and containing a substituted or unsubstituted aryl group as a partial structure thereof.

A group represented by the general formula (BL-1) will be described below. Each of $R_3$, $R_4$, $R_5$, $R_6$, and $R_7$ independently represents a hydrogen atom or a substituent. Examples of the substituent are those enumerated above for $R_2$. At least one of $R_3$, $R_4$, $R_5$, $R_6$, and $R_7$ is a substituent having the total carbon atoms of 4 to 70 and containing a substituted or unsubstituted alkyl group as a partial structure thereof, or a substituent having the total carbon atoms of 6 to 70 and containing a substituted or unsubstituted aryl group as a partial structure thereof. Preferred examples are an alkoxy group, aryloxy group, acylamino group, ureido group, carbamoyl group, alkoxycarbonylamino group, sulfonyl group, sulfonamido groups, sulfamoyl group, sulfamoylamino group, and alkoxycarbonyl group, each containing a substituted or unsubstituted alkyl or aryl group as a partial structure thereof, and an alkyl group and aryl group, each having the total carbon atoms of 4 (6 if an aryl group is contained) to 70. Of these substituents, an alkyl group having 4 to 70 carbon atoms, and an alkoxy group, acylamino group and sulfonamido groups each having an alkyl group having 4 to 70 carbon atoms as a partial structure thereof are preferred.

Especially preferably, $R_3$, or both of $R_4$ and $R_6$ represent a substituent having the total carbon atoms of 4 (6 if aryl group is contained) to 70, and having a substituted or unsubstituted alkyl or aryl group as a partial structure thereof.

In the general formula (BL-2), $G_3$ represents a substituted or unsubstituted methylene group; a represents an integer from 1 to 3; $R_8$ represents a hydrogen atom, alkyl group, or aryl group; $G_4$ represents —O— or —$SO_2$—; and $R_9$ represents a substituent having the total carbon atoms of 6 to 70 and containing a substituted or unsubstituted alkyl or aryl group as a partial structure thereof. If $R_9$ has a substituent, examples of this substituent are those enumerated above for $R_2$. If a is 2 or more, a plurality of $G_3$s may be the same or different to each other. The substituted or unsubstituted methylene group represented by $(G_3)_a$ is preferably —$CH_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, or —$C(CH_3)_2$—$C(CH_3)_2$—, R8 is a hydrogen atom, $G_4$ is —CO— or —$SO_2$—, and $R_9$ is a substituted or unsubstituted alkyl or aryl group having the total carbon atoms of 10 to 70.

Among the compounds represented by the general formula (MC-1), if $G_1$ is a nitrogen atom, $G_2$ is a carbon atom, and X is a hydrogen atom, it is preferable that $R_1$ is a tertiary alkyl group, and $R_2$ is a group represented by the general formula (BL-1), wherein each of $R_4$ and $R_6$ is a group selected from an acylamino group, sulfonamido group, ureido group, alkoxycarbonylamino group, sulfonyl group, carbamoyl group, sulfamoyl group, sulfamoylamino group, and alkoxycarbonyl group, each of which is substituted by a substituted or unsubstituted alkyl group having the total carbon atoms of 4 to 70 or by a substituted or unsubstituted aryl group having carbon atoms of 6 to 70.

Among the compounds represented by the general formula (MC-1), if $G_1$ is a carbon atom, $G_2$ is a nitrogen atom, and X is a hydrogen atom, it is preferable that $R_1$ is a tertiary alkyl group, $R_2$ is a group represented by the general formula (BL-1) or (BL-2). It is especially preferable that $R_2$ is a group represented by the general formula (BL-2).

Among the compounds represented by the general formula (MC-1), if $G_1$ is a nitrogen atom, $G_2$ is a carbon atom, and X is a split-off group other than a hydrogen atom, it is preferable that $R_1$ is a tertiary alkyl group, $R_2$ is a group represented by the general formula (BL-1), at least one of $R_3$, $R_4$, $R_5$, $R_6$ and $R_7$ is a group selected from an acylamino group, sulfonamido group, ureido group, alkoxycarbonylamino group, sulfonyl group, carbamoyl group, sulfamoyl group, sulfamoylamino group and alkoxycarbonyl group, each of which is substituted by a substituted or unsubstituted alkyl group having the total carbon atoms of 6 to 70 or by a substituted or unsubstituted aryl group having carbon atoms of 6 to 70, and X is a chlorine atom.

Among the compounds represented by the general formula (MC-1), if $G_1$ is a carton atom, $G_2$ is a nitrogen atom, and X is a split-off group other than a hydrogen atom, it is preferable that $R_1$ is a tertiary alkyl group, $R_2$ is a group represented by the general formula (BL-1) or (BL-2). It is especially preferable that $R_2$ is a group represented by the general formula (BL-2),.

In the present invention, it is preferable that $G_1$ is a carbon atom and $G_2$ is a nitrogen atom, $R_1$ is a tertiary alkyl group, $R_2$ is represented by the general formula (BL-2), wherein $G_4$ is —$SO_2$—, $R_9$ is a phenyl group having, as a substituent, at least one group containing an alkyl group of 6- to 50-carbon atoms, and a is 1 or 2. Among these especially preferable is that X is a hydrogen atom or chlorine atom, or substituted phenyloxy group.

Specific compound examples of the general formula (MC-1) are shown below, but the present invention is not limited to these specific examples.

MC-1

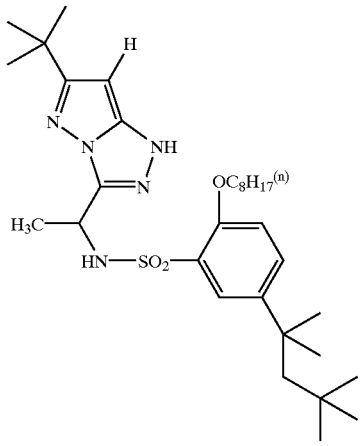

MC-2

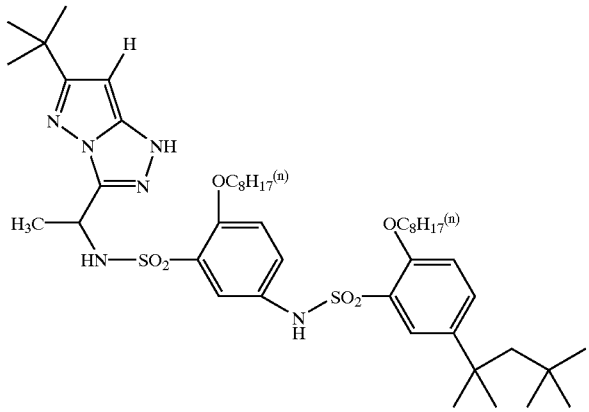

-continued
MC-3
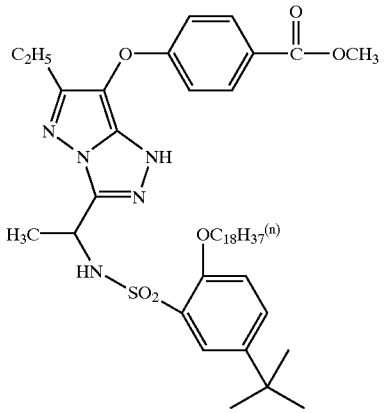
MC-4
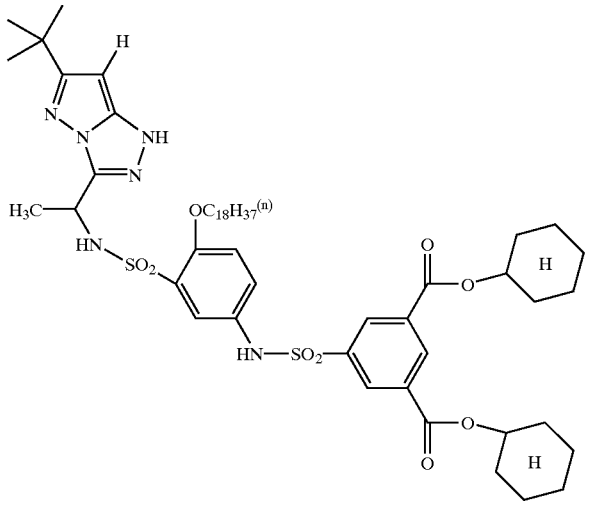
MC-5
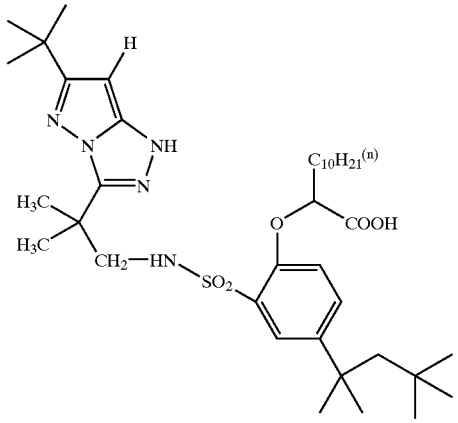
MC-6
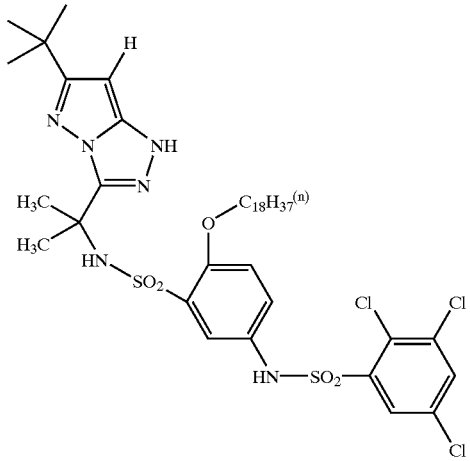
MC-7
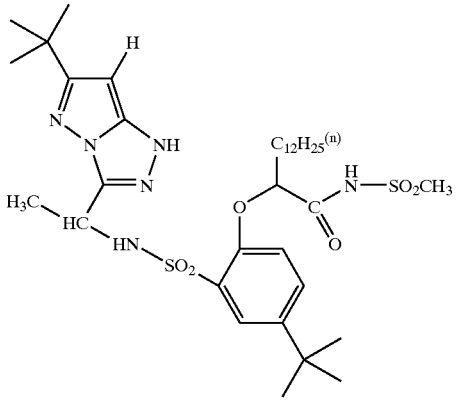
MC-8
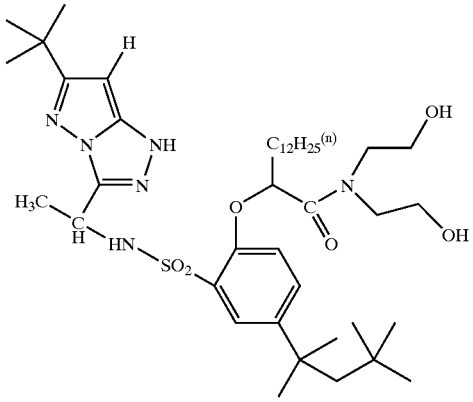

-continued
MC-9
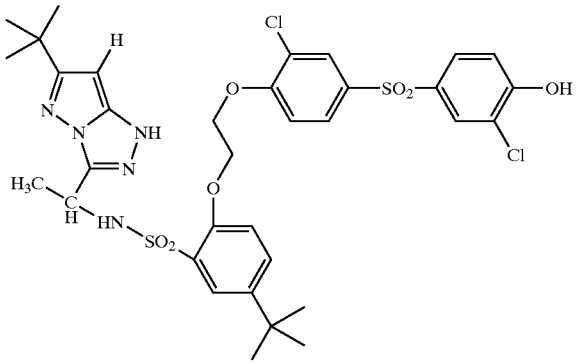
MC-10
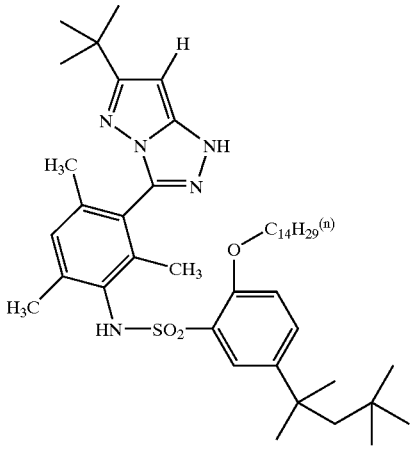
MC-11
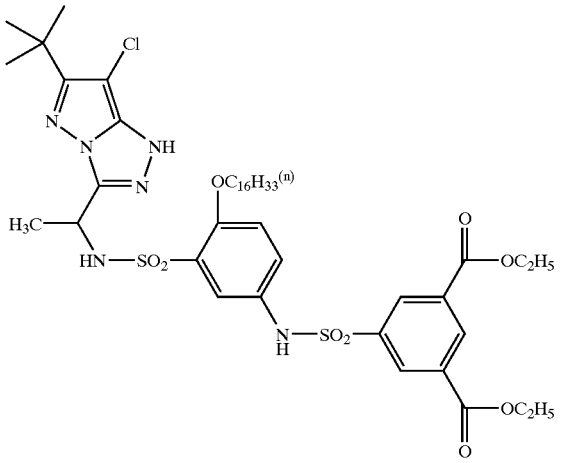
MC-12
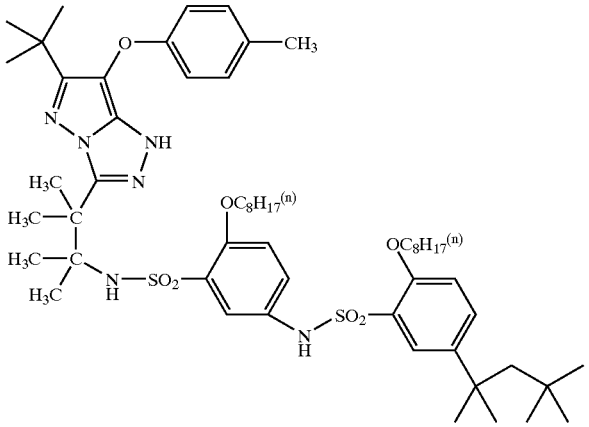
MC-13
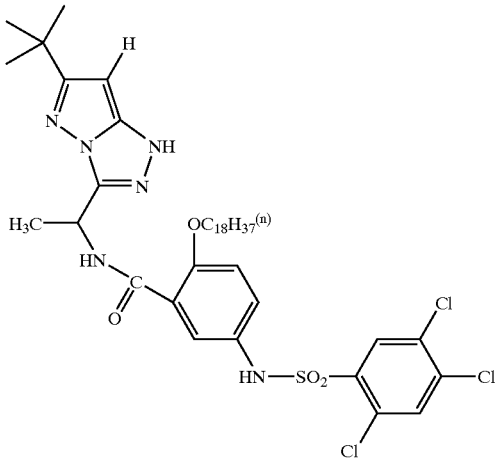
MC-14
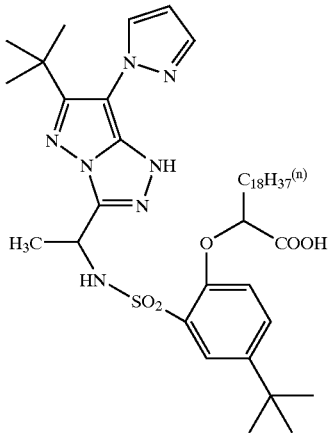

-continued
MC-15
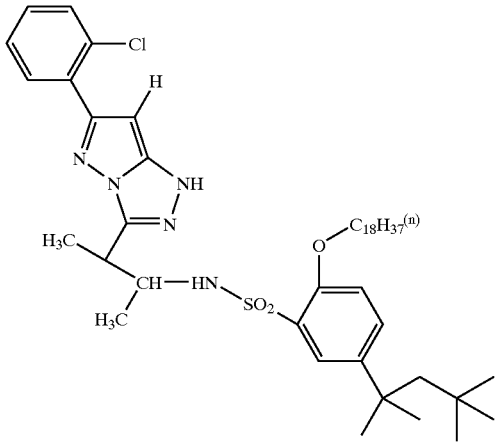
MC-16
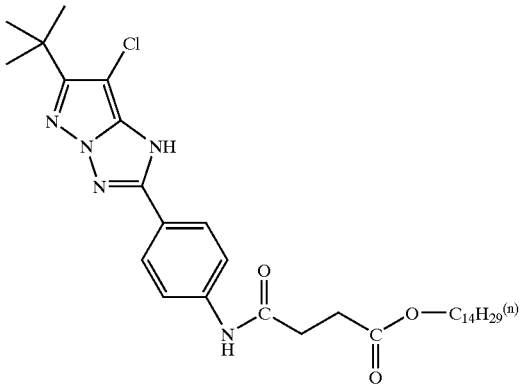
MC-17
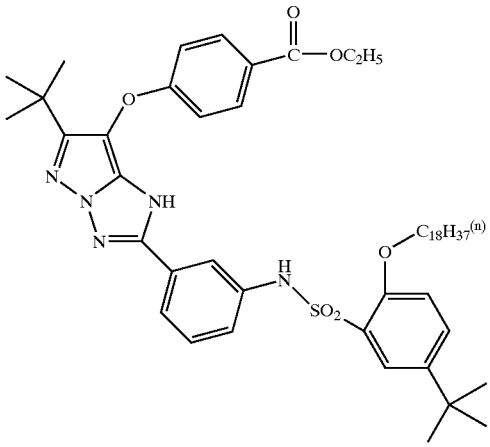
MC-18
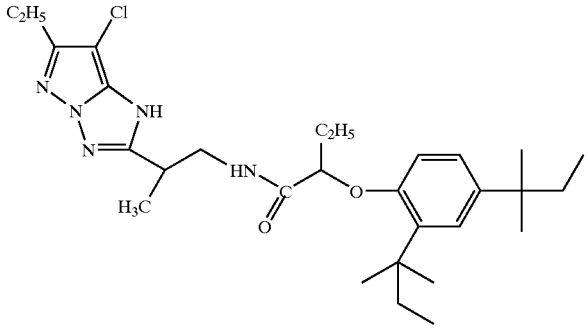
MC-19
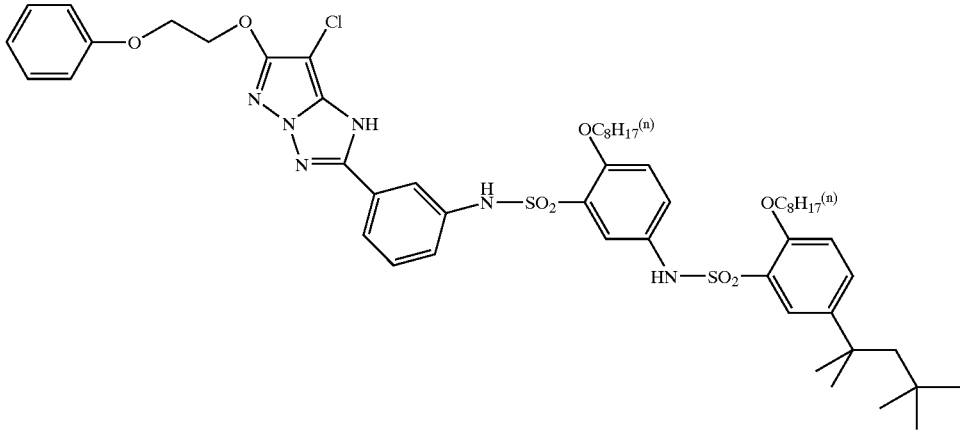

-continued
MC-20
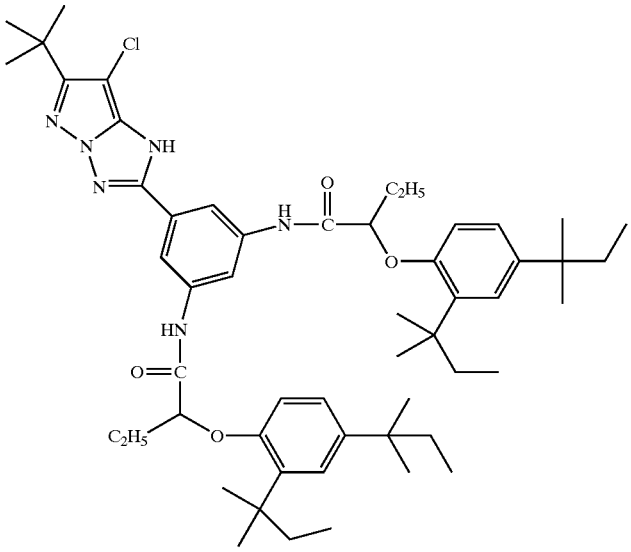
MC-21
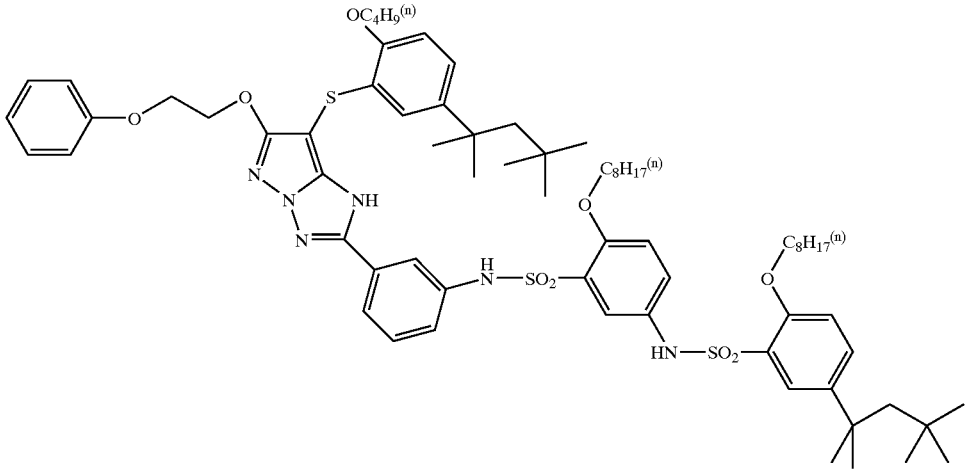
MC-22
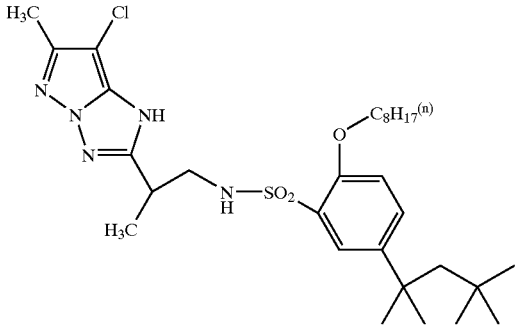
MC-23
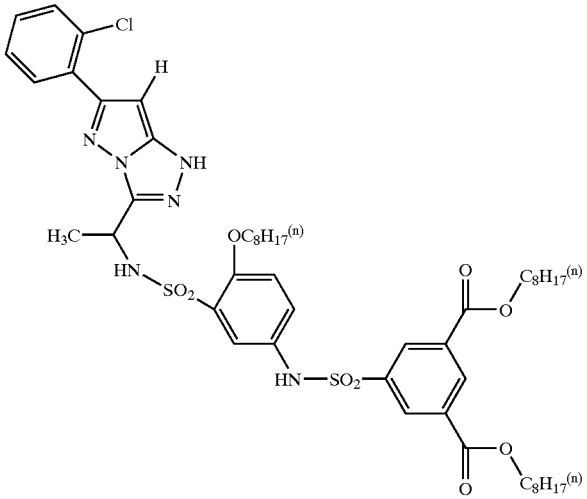

-continued
MC-24
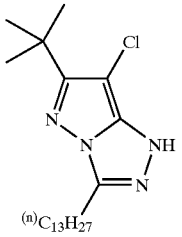
MC-25
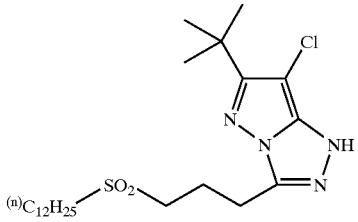
MC-26
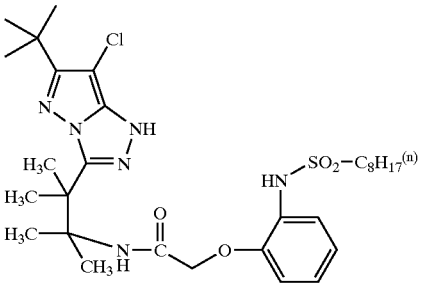
MC-27
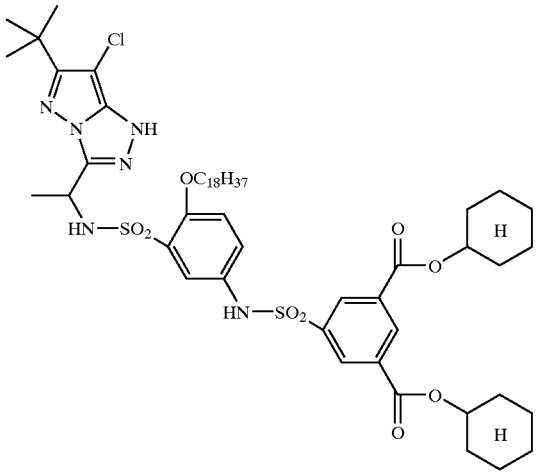
MC-28
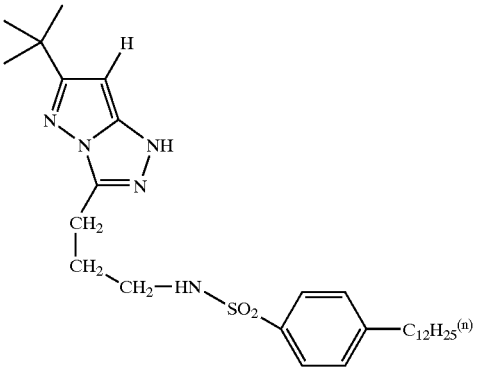
MC-29
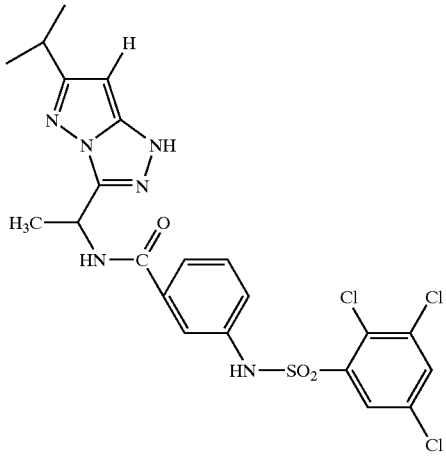
MC-30
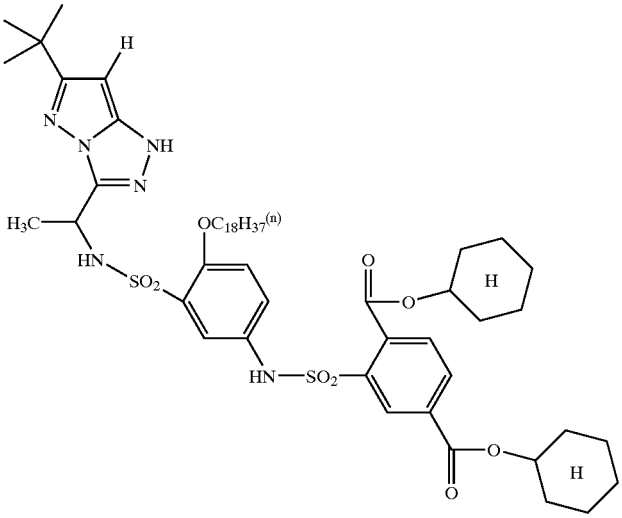

The coupler represented by the general formula (MC-1) of the present invention may be synthesized by known method. For example, such methods are described in the specifications of U.S. Pat. Nos. 4,540,654, 4,705,863 and 5,451,501, JP-A's-61-65245, 62-209457, 62-249155, 63-41851, Jpn. Pat. Appln. KOKOKU Publication No. (hereinafter referred to as "JP-B") 7-122744, JP-B's-5-105682, 7-13309 and 7-82252 or U.S. Pat. Nos. 3,725,067 and 4,777,121, and JP-A-2-201442, 2-101077, 3-125143 and 4-242249.

Preferable color developing agent for the couplers represented by the general formula (CC-1) or the general formula (MC-1) to provide a dye having the characteristics defined in the present invention, is N-methyl-N-(β-methanesulfonamidoethyl)-3-methyl-4-aminoaniline.

Now, the yellow dye-forming couplers represented by the general formula (YC-1) of the present invention will be described.

In the general formula, R1 represents a substituent other than a hydrogen atom. As the substituent, there can be mentioned, for example, a halogen atom, alkyl group (including cycloalkyl and bicycloalkyl), alkenyl group (including cycloalkenyl and bicycloalkenyl), alkynyl group, aryl group, heterocycle group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including alkylamino and anilino), acylamino group, aminocarbonylamino group, alkoxycarbonylamino group, aryloxycarbonylamino group, sulfamoylamino group, alkyl- or aryl-sulfonylamino group, mercapto group, alkylthio group, arylthio group, heterocyclic thio group, sulfamoyl group, sulfo group, alkyl- or aryl-sulfinyl group, alkyl- or aryl-sulfonyl group, acyl group, aryloxycarbonyl group, alkoxycarbonyl group, carbamoyl group, aryl- or heterocyclic-azo group, imido group, phosphino group, phosphinyl group, phosphinyloxy group, phosphinylamino group or silyl group.

These substituents may further have substituents. As the further substituents, there can be mentioned those set forth above.

Preferably, R1 is a substituted or unsubstituted alkyl group. The total number of carbon atoms had by R1 is preferably in the range of 1 to 60, more preferably 6 to 50, still more preferably 11 to 40, and most preferably 16 to 30. When R1 is a substituted alkyl group, the substituent can be any of those mentioned as R1 substituents above.

R1 is preferably an unsubstituted alkyl group having 11 or more carbon atoms or an alkyl group having its 2-, 3- or 4-position substituted with alkoxy group or aryloxy group. More preferably, R1 is an unsubstituted alkyl group having 16 or more carbon atoms or an alkyl group having its 3-position substituted with an alkoxy group or aryloxy group. Most preferably, R1 is $C_{16}H_{33}$, $C_{18}H_{37}$, 3-lauryloxypropyl or 3-(2,4-di-t-amylphenoxy)propyl.

In the general formula (YC-1), Q represents a nonmetallic atomic group capable of forming a 5- to 7-membered ring in cooperation with —N═C—N(R1)—. Preferably, the formed 5- to 7-membered ring is a substituted or unsubstituted single-ring or condensed-ring heterocycle. More preferably, the ring-constituting atoms are selected from among carbon, nitrogen and sulfur atoms. Still more preferably, Q is a group represented by the formula —C(—R11)═C(—R12)—$SO_2$— or —C(R11)═C(—R12)—CO—. R11 and R12 represent groups capable of bonding with each other to thereby form a 5- to 7-membered ring in cooperation with —C═C—, or each independently represent a hydrogen atom or a substituent. The formed 5- to 7-membered ring is a saturated or unsaturated ring, and may be an alicycle, an aromatic ring or a heterocycle. For example, there can be mentioned a benzene ring, furan ring, thiophene ring, cyclopentane ring or cyclohexane ring. The substituent can be any of those mentioned above as examples of the R1 substituents.

These substituents and rings formed by mutual bonding of multiple substituents may have further substituents (e.g., groups mentioned above as examples of the R1 substituents).

In the general formula (YC-1), R2 represents a substituent other than a hydrogen atom. This substituent can be, for example, any of those mentioned above as examples of the R1 substituents. Preferably, R2 represents a halogen atom (e.g., fluorine atom, chlorine atom or bromine atom), alkyl group (e.g., methyl or isopropyl), aryl group (e.g., phenyl or naphthyl), alkoxy group (e.g., methoxy or isopropyloxy), aryloxy group (e.g., phenoxy), acyloxy group (e.g., acetyloxy), amino group (e.g., dimethylamino or morpholino), acylamino group (e.g., acetamido), sulfonamido group (e.g., methanesulfonamido or benzenesulfonamido), alkoxycarbonyl group (e.g., methoxycarbonyl), aryloxycarbonyl group (e.g., phenoxycarbonyl), carbamoyl group (e.g., N-methylcarbamoyl or N,N-diethylcarbamoyl), sulfamoyl group (e.g., N-methylsulfamoyl or N,N-diethylsulfamoyl), alkylsulfonyl group (e.g., methanesulfonyl), arylsulfonyl group (e.g., benzenesulfonyl), cyano group, carboxyl group or sulfo group. When the position of R2 is ortho to —CONH—, R2 is more preferably a halogen atom, or alkoxy group, aryloxy group or alkyl group.

In the general formula (YC-1), m is an integer of 0 to 5. When m is 2 or greater, multiple R2s may be the same or different from each other, and may be bonded with each other to thereby form a ring.

In the general formula (YC-1), X represents a hydrogen atom or a group capable of splitting-off by a coupling reaction with an oxidized product of a developing agent. When X is a group capable of splitting-off by a coupling reaction with an oxidized product of a developing agent, such a group can be, for example, a group that splits off at a nitrogen atom, a group that splits off at an oxygen atom, a group that splits off at a sulfur atom, or a halogen atom (e.g., chlorine or bromine atom).

The group that splits off at a nitrogen atom can be, for example, a heterocyclic group [preferably 5- to 7-membered, substituted or unsubstituted, saturated or unsaturated, aromatic (herein meaning those having 4n+2 cyclic conjugated electrons) or nonaromatic, single-ring or condensed-ring heterocyclic group; more preferably a 5- or 6-membered heterocyclic group having its ring forming atoms selected from among carbon, nitrogen and sulfur atoms and having at least one of nitrogen, oxygen and sulfur hetero atoms, such as any of groups from succinimide, maleinimide, phthalimide, diglycolimide, pyrrole, pyrazole, imidazole, 1,2,4-triazole, tetrazole, indole, benzopyrazle, benzimidazole, benzotriazole, imidazoline-2,4-dione, oxazolidine-2,4-dione, thiazolidin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine parabanic acid, 1,2,4-triazolidine-3,5-dione, 2-pyridone, 4-pyridone, 2-pyrimidone, 6-pyridazone, 2-pyrazone and 2-amino-1,3,4-thiazolidin-4-one], a carbonamido group (e.g., acetamido or trifluoroacetamido), a sulfonamido group (e.g., methanesulfonamido or benzenesulfonamido), an arylazo group (e.g., phenylazo or naphthylazo) or a carbamoylamino group (e.g., N-methylcarbamoylazo).

Among the groups that splits off at a nitrogen atom, a heterocyclic group is preferred. An aromatic heterocyclic group having one, two, three or four nitrogen atoms as ring-forming atoms, or a heterocyclic group represented by the following general formula (L) is more preferred.

(L)

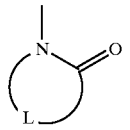

In the formula, L represents a residue capable of forming a 5- or 6-membered nitrogen-containing heterocycle in cooperation with —NC(=O)—.

Examples thereof are as mentioned above in the description of heterocyclic groups, which are more preferred.

In particular, it is preferred that L represents a residue capable of forming a 5-membered nitrogen-containing heterocycle.

As the group that splits off at an oxygen atom, there can be mentioned, for example, aryloxy group (e.g., phenoxy or 1-naphthoxy), heterocyclic oxy group (e.g., pyridyloxy or pyrazolyloxy), acyloxy group (e.g., acetoxy or benzoyloxy), alkoxy group (e.g., methoxy or dodecyloxy), carbamoyloxy group (e.g., N,N-diethylcarbamoyloxy or morpholinocarbamoyloxy), aryloxycarbonyloxy group (e.g., phenoxycarbonyloxy), alkoxycarbonyloxy group (e.g., methoxycarbonyloxy or ethoxycarbonyloxy), alkylsulfonyloxy group (e.g., methanesulfonyloxy) or arylsulfonyloxy group (e.g., benzenesulfonyloxy or toluenesulfonyloxy).

Among the groups that split off at an oxygen atom, an aryloxy group, acyloxy group and heterocyclic oxy group are preferred.

As the group that splits off at a sulfur atom, there can be mentioned, for example, arylthio group (e.g., phenylthio or naphthylthio), heterocyclic thio group (e.g., tetrazolylthio, 1,3,4-thiadiazolylthio, 1,3,4-oxazolylthio or benzimidazolylthio), alkylthio group (e.g., methylthio, octylthio or hexadecylthio), alkylsulfinyl group (e.g., methanesulfinyl), arylsulfinyl group (e.g., benzenesulfinyl), arylsulfonyl group (e.g., benzenesulfonyl) or alklylsulfonyl group (e.g., methanesulfonyl).

Among the groups that split off at a sulfur atom, arylthio group and heterocyclic thio group are preferred. Heterocyclic thio group is more preferred.

X may have a substituent. The substituent for X can be, for example, any of those mentioned above as examples of the R1 substituents.

Preferably, X represents a group that splits off at a nitrogen atom, a group that splits off at an oxygen atom or a group that splits off at a sulfur atom. More preferably, X represents a group that splits off at a nitrogen atom. Still more preferably, X represents any of preferred groups mentioned above with respect to the group that splits off at a nitrogen atom.

Moreover, X may be a photographically useful group. As the photographically useful group, there can be mentioned a development inhibitor, desilvering accelerator, redox compound, dye, coupler or the like, or a precursor thereof.

For the immobilization of the coupler in the photosensitive material, it is preferred that the total number of carbon atoms, including those of substituents, of at least one of Q, R1, X and R2 be in the range of 8 to 50. More preferably, the total number of carbon atoms is in the range of 10 to 40.

Among the couplers of the general formula (YC-1), those of the following general formula (YC-2) are preferred.

(YC-2)

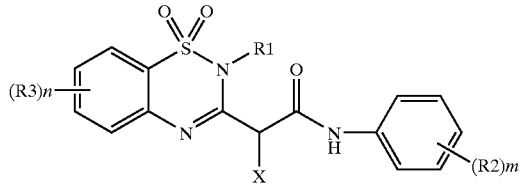

In the general formula (YC-2), R1, R2, m and X are as defined above with respect to the general formula (YC-1), and preferred ranges thereof are also as defined there.

In the general formula (YC-2), R3 represents a substituent. This substituent can be, for example, any of those mentioned above as examples of the R1 substituents. Preferably, R3 represents a halogen atom (e.g., fluorine, chlorine or bromine atom), alkyl group (e.g., methyl or isopropyl), aryl group (e.g., phenyl or naphthyl), alkoxy group (e.g., methoxy or isopropyloxy), aryloxy group (e.g., phenoxy), acyloxy (e.g., acetyloxy), amino group (e.g., dimethylamino or morpholino), acylamino group (e.g., acetamido), sulfonamido group (e.g., methanesulfonamido or benzenesulfonamido), alkoxycarbonyl group (e.g., methoxycarbonyl), aryloxycarbonyl group (e.g., phenoxycarbonyl), carbamoyl group (e.g., N-methylcarbamoyl or N,N-diethylcarbamoyl), sulfamoyl group (e.g., N-methylsulfamoyl or N,N-diethylsulfamoyl), alkylsulfonyl group (e.g., methanesulfonyl), arylsulfonyl group (e.g., benzenesulfonyl), cyano group, carboxyl group or sulfo group.

n is an integer of 0 to 4. When n is 2 or greater, multiple R3s may be the same or different from each other, and may be bonded with each other to thereby form a ring.

Among the couplers represented by the general formula (YC-1) or general formula (YC-2) according to the present invention, preferred specific examples will be shown below, which however should not be construed as limiting the scope of the present invention. Tautomers resulting from moving of the hydrogen atom at coupling position onto the nitrogen of C=N moiety bonded to the coupling position are also comprehended in the present invention.

(1)
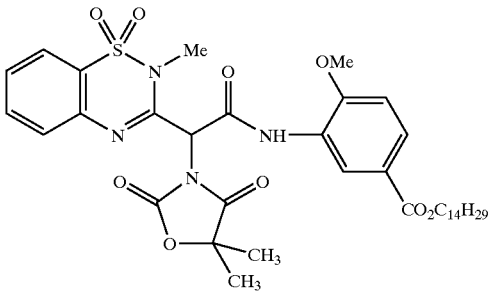
(2)
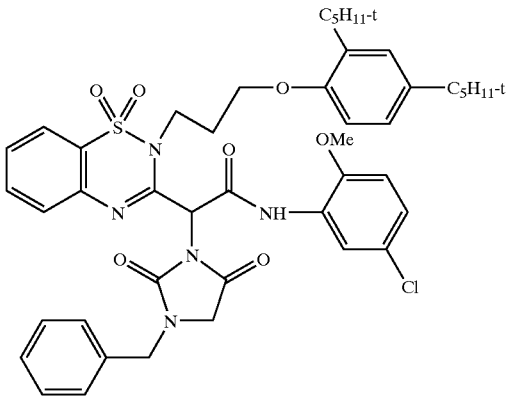
(3)
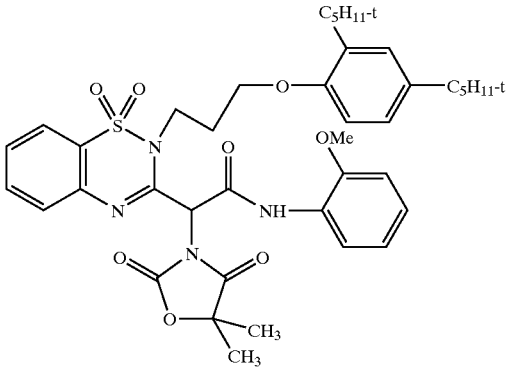
(4)
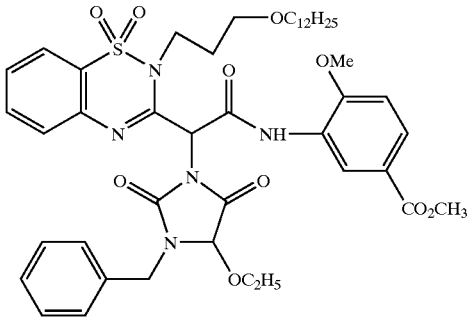
(5)
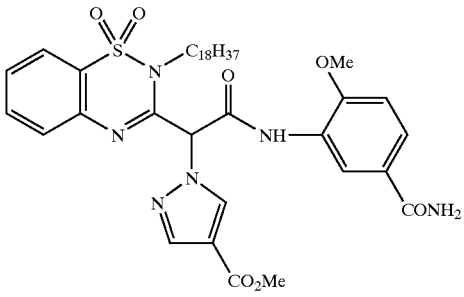
(6)
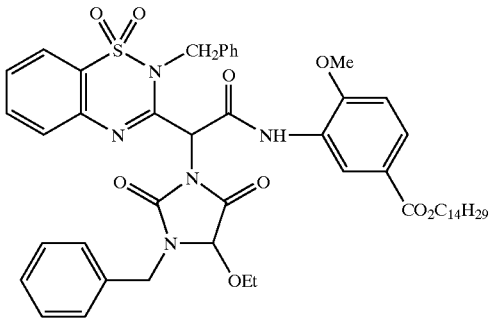
(7)
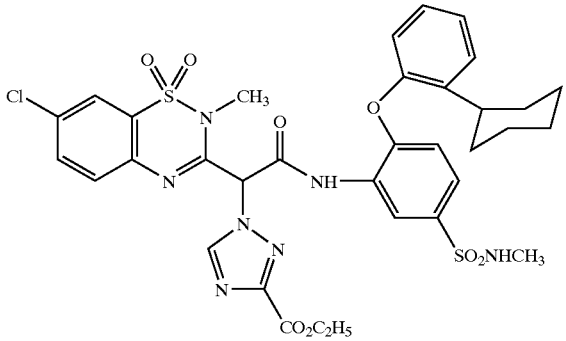
(8)
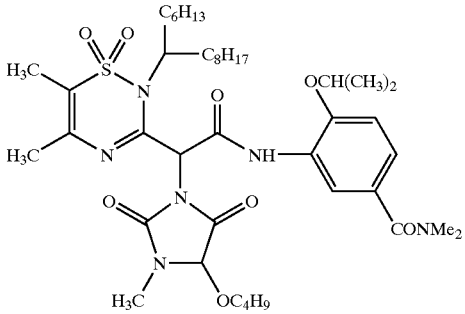

-continued
(9)
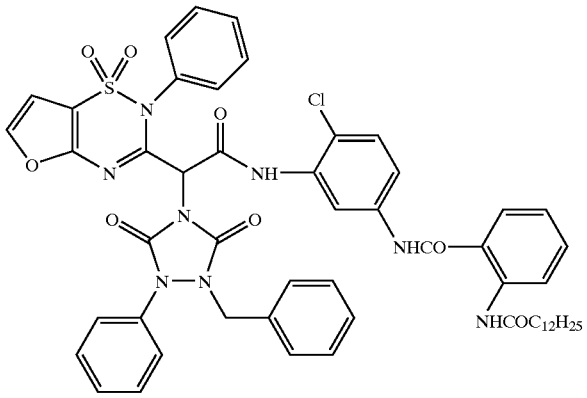
(10)
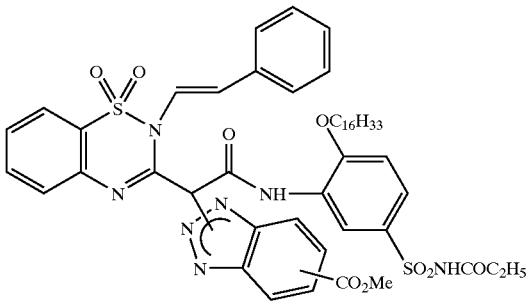
(11)
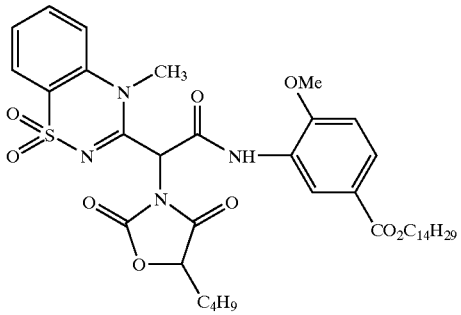
(12)
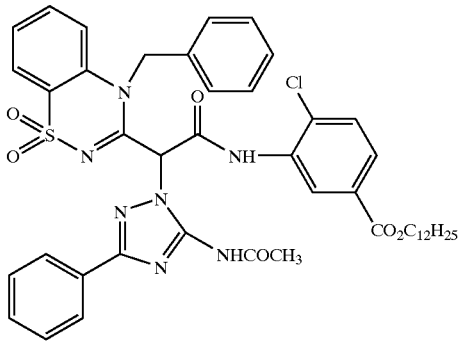
(13)
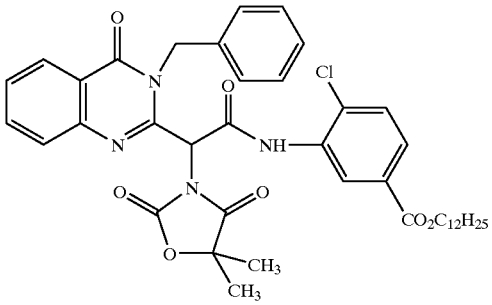
(14)
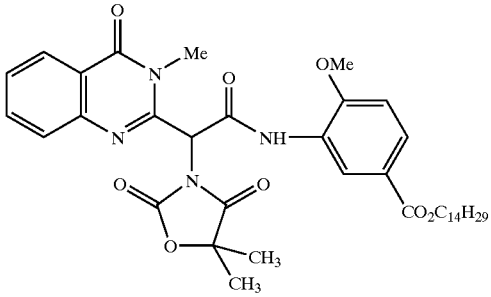
(15)
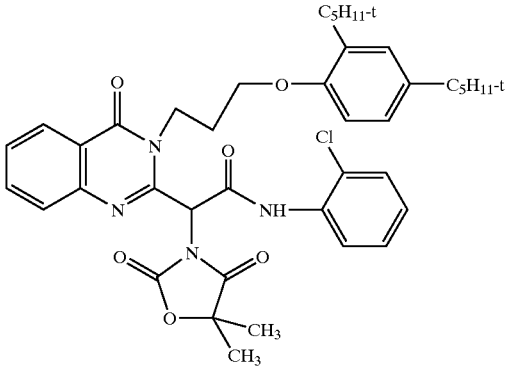
(16)
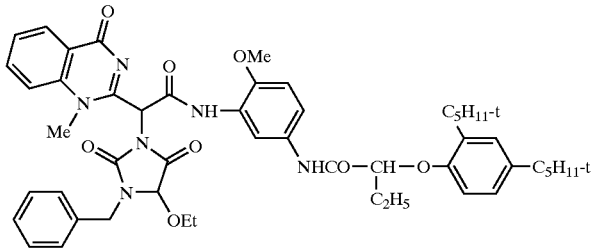

-continued
(17)
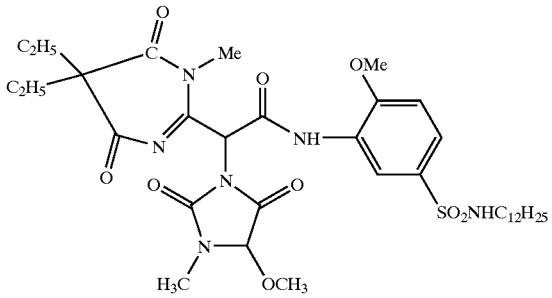
(18)
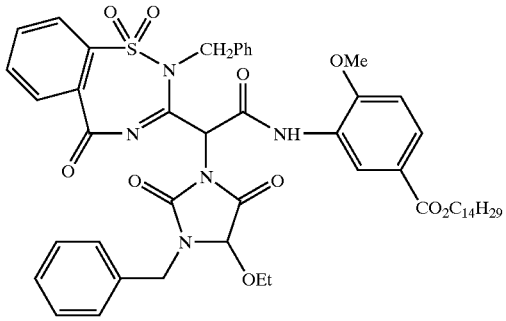
(19)
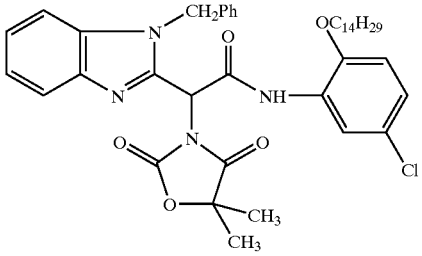
(20)
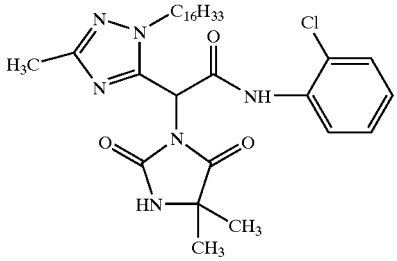
(21)
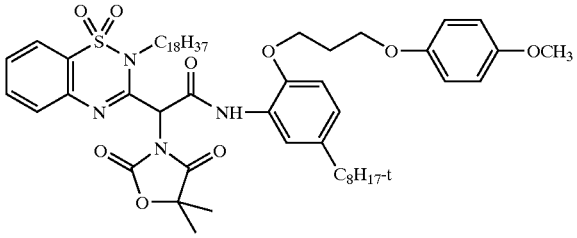
(22)
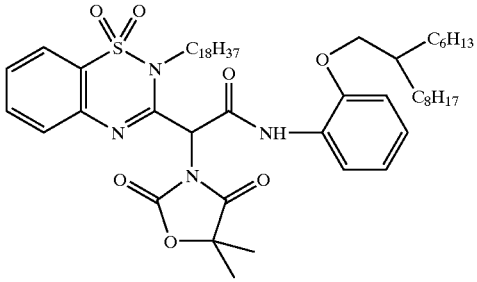
(23)
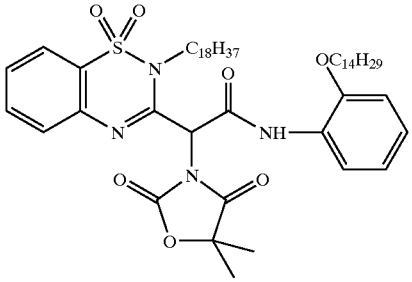
(24)
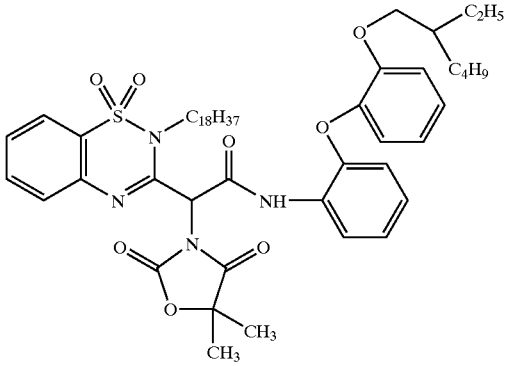
(25)
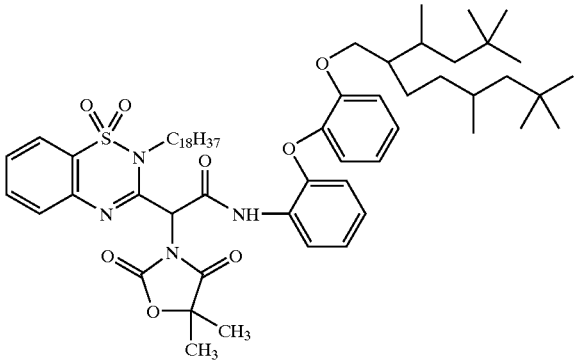
(26)
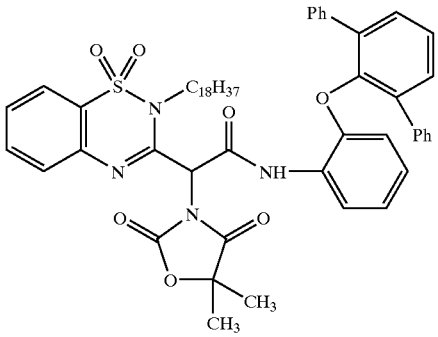

-continued
(27)
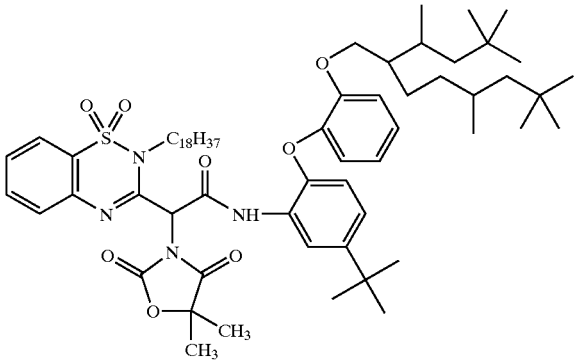
(28)
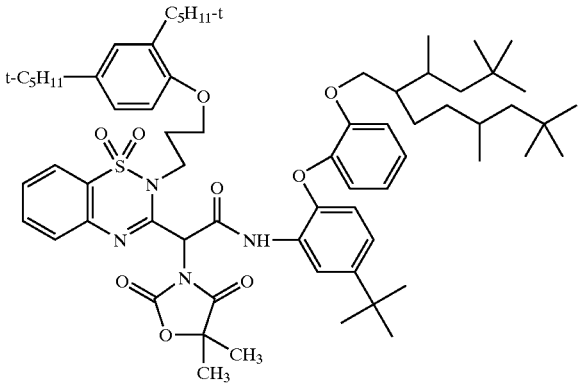
(29)
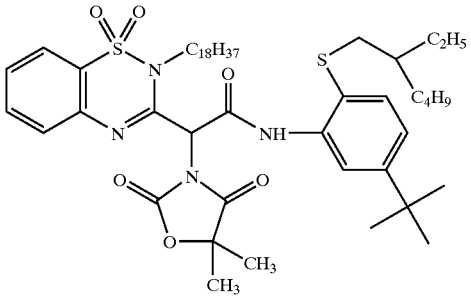
(30)
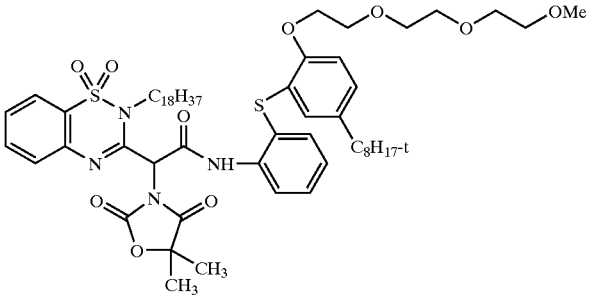
(31)
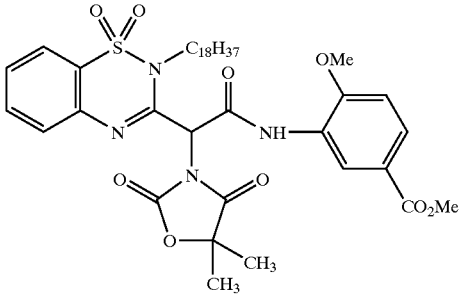
(32)
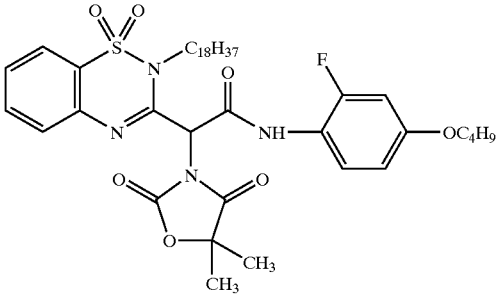
(33)
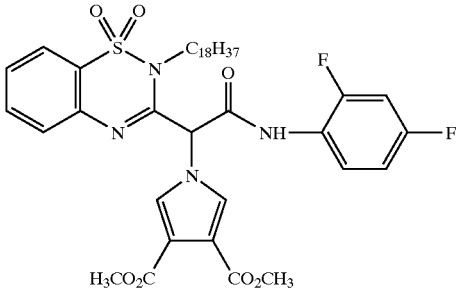
(34)
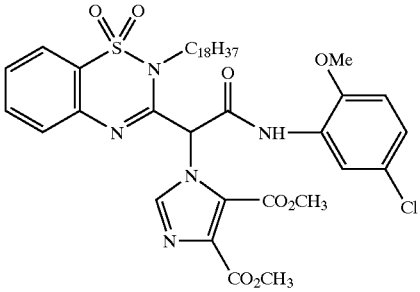
(35)
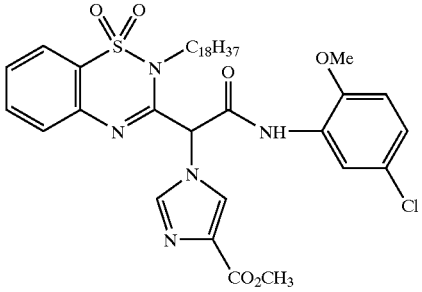
(36)
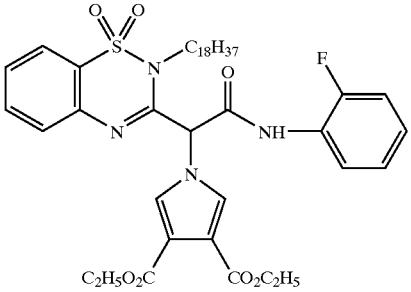

-continued
(37)
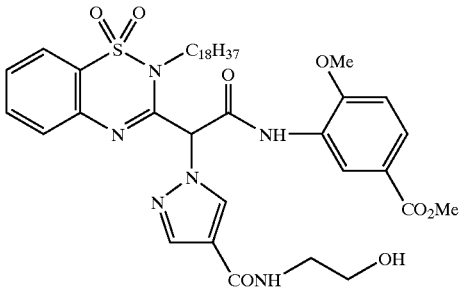
(38)
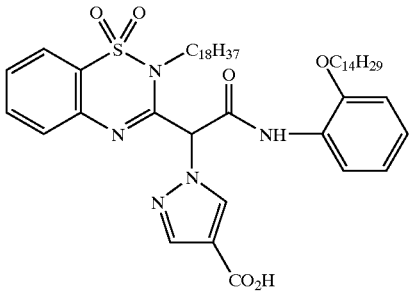
(39)
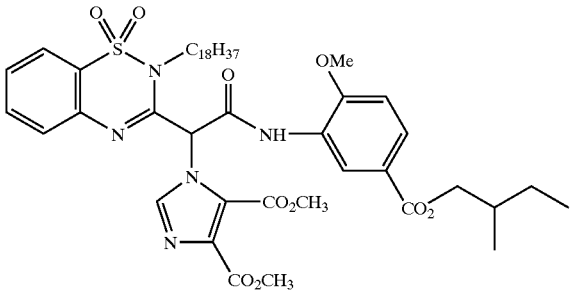
(40)
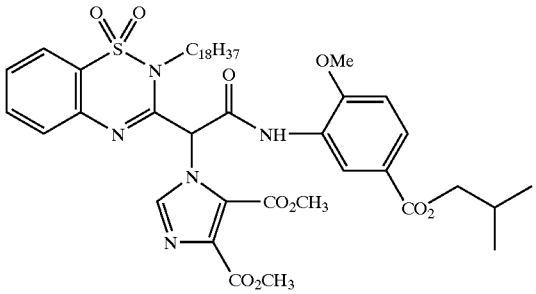
(41)
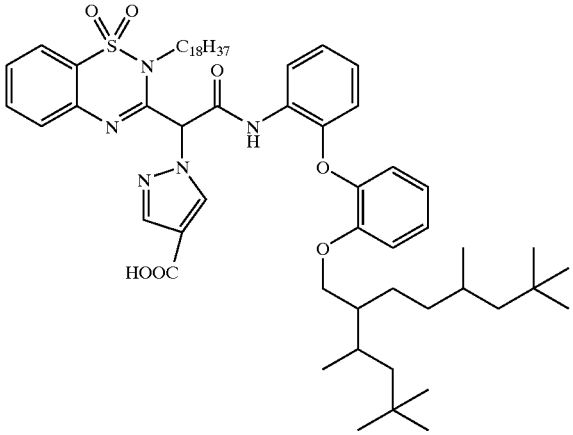
(42)
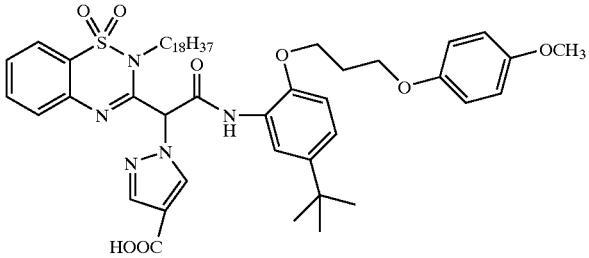
(43)
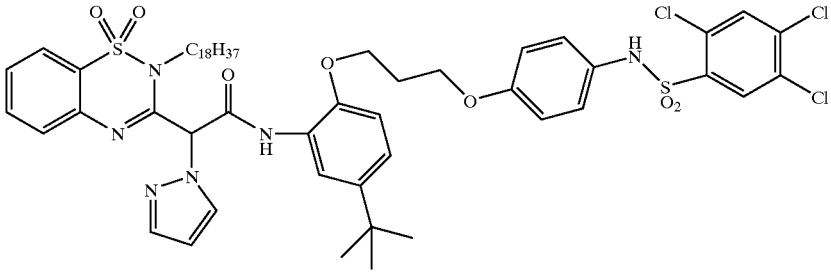
(44)
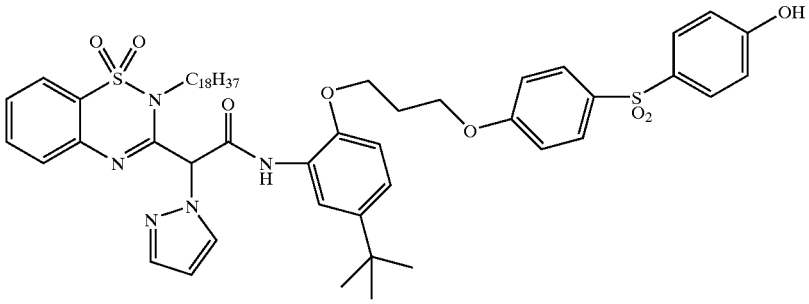

-continued (45)

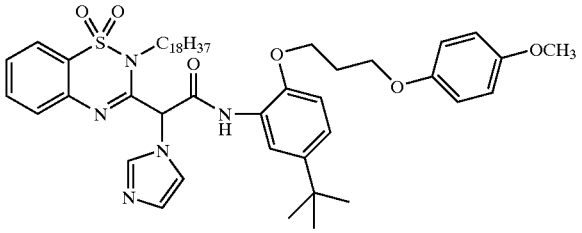

(46)

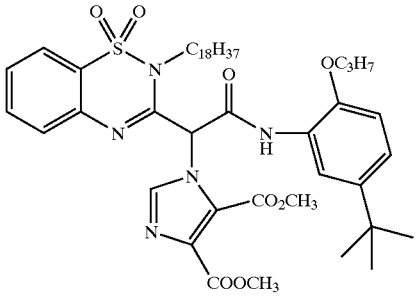

(47)

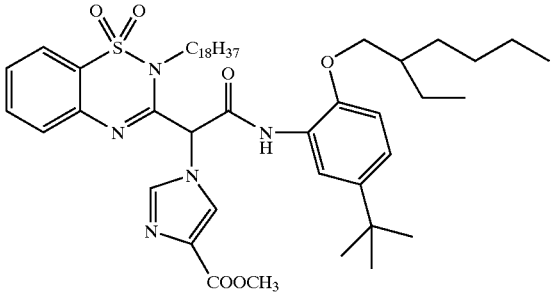

(48)

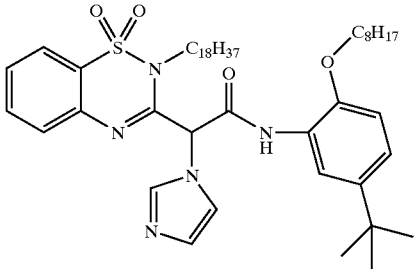

(49)

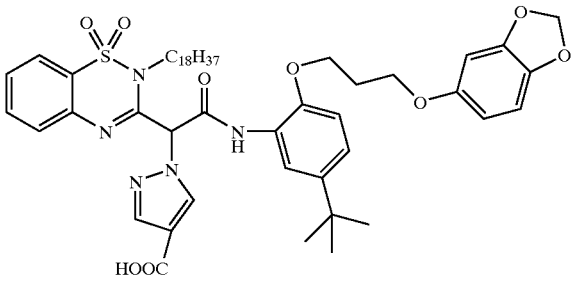

(50)

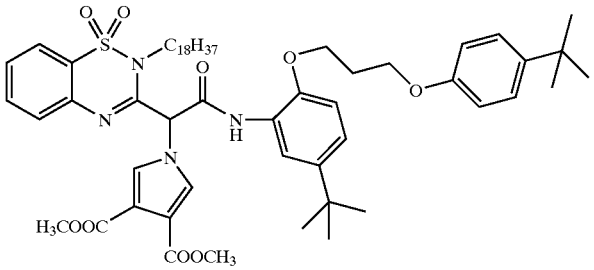

The addition amount of dye or dye-providing compound according to the present invention is preferably in the range of 0.01 to 10 g, more preferably 0.1 to 5 g per square meter of image-forming material.

When the dye-providing compound of the present invention is a coupler, also, the addition amount thereof is preferably in the range of 0.01 to 10 g, more preferably 0.1 to 5 g, and most preferably 0.3 to 2 g, per square meter of silver halide color photosensitive material.

The dye or dye-providing compound according to the present invention can be incorporated in image-forming materials by various known dispersion methods. With respect to a coupler applied to the silver halide color photosensitive material, it is preferred to employ the oil-in-water dispersion method in which the coupler is dissolved in a high-boiling organic solvent (in combination with low-boiling solvent according to necessity), emulsified into an aqueous solution of gelatin and added to a silver halide emulsion.

Examples of the high-boiling solvent used in this oil-in-water dispersion method are described in, e.g., U.S. Pat. No. 2,322,027. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Dispersion using an organic solvent-soluble polymer is described in PCT International Publication WO88/00723, the disclosure of which is herein incorporated by reference.

Examples of the high-boiling solvent usable in the above-mentioned oil-in-water dispersion method are phthalic esters (e.g., dibutylphthalate, dioctylphthalate, dicyclohexylphthalate, di(2-ethylhexyl)phthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di(2-ethylhexylphenylphosphate), benzoic esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, N,N-diethyllaurylamide, N,N,N,N-tetrakis(2-ethlhexyl)isophthalamide and N,N,N,N-tetrokiscyclohexylisophthalamide), alcohols and phenols (e.g., isostearylalcohol and 2,4-di-tert-amylphenol), aliphatic esters (e.g., dibutoxyethyl succinate, bis(2-ethylhexyl) succinate, 2-hexyldecyl tetradecanoate, tributyl citrate, diethyl azelate, isostearyl lactate, and trioctyl tosylate), aniline derivatives (e.g., N,N-dibutyl-2-butoxy-5-tert-octylaniline), chlorinated paraffins (paraffins containing 10% to 80% of chlorine), trimesic esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy butyric acid and 2-ethoxyoctanedecanoic acid), alkylphosphoric acids (e.g., di-(2-ethylhexyl)phosphoric acid and diphenylphosphoric acid). In addition to the above high-boiling solvents, compounds described in, e.g., JP-A-6-258803, the disclosure of which is incorporated herein by reference.

Also, an organic solvent having a boiling point of 30° C. to about 160° C. (e.g., ethyl acetate, butyl acetate, ethyl propionate, methyl ethyl ketone, cyclohexanone, 2-ethoxyethylacetate, or dimethylformamide) may be used in combination as an auxiliary solvent.

The content of coupler of the present invention in the photosensitive material is in the range of 0.01 to 10 g, preferably 0.1 to 2 g per $m^2$. Per mol of silver halides contained in the same photosensitive emulsion, the coupler content is appropriately in the range of $1\times10^{-3}$ to 1 mol, preferably $2\times10^{-3}$ to $3\times10^{-1}$ mol.

When each photosensitive layer has a unit structure consisting of two or more photosensitive emulsion layers of different speeds, it is preferred that the content of coupler of the present invention per mol of silver halides be in the range of $2\times10^{-3}$ to $2\times10^{-1}$ mol in low-speed layers and $3\times10^{-2}$ to $3\times10^{-1}$ mol in high-speed layers.

The coupler represented by the general formula (CC-1) of the present invention is preferably added to a red-sensitive emulsion layer. The coupler represented by the general formula (MC-1) of the present invention is preferably added to a green-sensitive emulsion layer. The coupler represented by the general formula (YC-1) of the present invention is preferably added to a blue-sensitive emulsion layer.

In the present invention, although the use of coupler of the general formula (CC-1), general formula (MC-1) or general formula (YC-1) is preferred, it may be combined with other couplers. However, the higher the degree of contribution of color-forming dye of coupler of the present invention to the total density of dyes forming substantially the same color, the more favorable the obtained results. In particular, the coupler of the present invention is preferably used in such an amount that at least the degree of contribution to color formation density is 50% or more, more preferably 70% or more.

In each of the color-forming layers of an image-forming material and a color photosensitive material for use in duplication, the coupler used in one color-forming layer of an image-forming material and the coupler used in the corresponding color-forming layer of a color photosensitive material for use in duplication does not necessarily the same type. But it is preferable that, in each of the color-forming layers, the coupler used in one color-forming layer of an image-forming material and the coupler used in the corresponding color-forming layer of a color photosensitive material for use in duplication are within the same scope of general formula set forth above, and it is more preferable that the couplers are the same type.

Much more preferably, the described cyan coupler, magenta coupler and yellow coupler are each used in both the formation of original images and the formation of duplicate images. More preferably, the cyan coupler and the magenta coupler are simultaneously used in both the formation of original images and the formation of duplicate images.

The magenta coupler represented by the general formula (MC-1) and cyan coupler represented by the general formula (CC-1) according to the present invention are characterized in that the absorption value of subsidiary absorption maximum wavelength residing in wavelengths quite different from the respective maximum absorption maximum wavelengths of magenta and cyan colors is low. This means that the present invention uses color forming materials of low subsidiary absorption in the original image or duplicate color image-forming material.

In particular, the absorption value at the subsidiary absorption maximum wavelength of cyan color-forming dye and/or magenta color-forming dye is preferably 5% or less, more preferably 3% or less, and most preferably 1% or less based on the absorption value at the main absorption maximum wavelength thereof.

The terminology "original image" used herein means images to be duplicated, which refer to, for example, color reversal photosensitive materials, color negative photosensitive materials, thermal paper, pressure sensitive paper, OHP, etc. The preferred form of original image is a color reversal photosensitive material or a color negative photosensitive material. The color reversal photosensitive material is most preferred.

Now, the spectral sensitivity distribution of red-sensitive silver halide emulsion layer according to the present invention will be described.

In the present invention, the spectral sensitivity distribution refers to one obtained by exposing photosensitive materials to radiation of several nanometers (nm) interval spectrum ranging from 400 to 700 nm, defining the exposure amount realizing a given density at each wavelength as the sensitivity at the wavelength and expressing sensitivity values as a function of wavelength.

In the present invention, appropriate means can be employed for using the spectral sensitivity distribution as a constituent of the invention. For example, the above spectral sensitivity distribution can be obtained by the use of spectral sensitizing dyes. In the present invention, in the regulating of spectral sensitivity distribution by the use of spectral sensitizing dyes, the amount of spectral sensitizing dye is not limited and can be appropriate for realizing desired spectral sensitivity distribution in conformity with the type of dye used and the design of photosensitive material. The type of spectral sensitizing dyes used is not limited.

In the present invention, it is needed for the maximum sensitivity wavelength, λmax (D), of red-sensitive silver halide emulsion layer to fall within the range of 630 to 670 nm. Preferably, the maximum sensitivity wavelength falls within the range of 650 to 670 nm.

In the original images, the silver halide photosensitive materials and silver halide photographic emulsion used therein, to which the method of the present invention may be applied, it is generally possible to use various techniques and inorganic and organic materials described in Research Disclosure Nos. 308119 (1989), and 37038 (1995), the entire contents of which are incorporated herein by reference.

More specifically, techniques and inorganic and organic materials usable in color photosensitive materials to which the method of the present invention can be applied are described in portions of the specification of EP436,938A2 and patents cited below, the entire contents of which are incorporated herein by reference.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421,453A1, page 3, line 5 to page 25, line 55 |
| 5) | Cyan couplers usable together | page 149, lines 29 to 33; EP432,804A2, page 3, line 28 to page 40, line 2 |
| 6) | Polymer couplers | page 149, lines 34 to 38; EP435,334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435,334A2, page 3, line 1 to page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421,453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness · film physical properties | page 150, lines 35 to 49. |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing · stabilizing step | page 153, lines 3 to 37 |

EXAMPLES

The present invention will be described specifically by examples, but the present invention is not limited to these.

Example-1

A; Formation of an Original Sample

Preparation of a Silver Halide Color Photosensitive Material, Sample A101

Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 205 μm.

Components of Undercoat Layer

The two surfaces of the triacetylcellulose film were subjected to undercoating treatment. Numbers represent weight contained per liter of an undercoat solution.

The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |
| Coating of back layers | |

One surface of the undercoated support was coated with the following back layers.

| | |
|---|---|
| 1st layer | |
| Binder: acid-processed gelatin (isoelectric point: 9.0) | 1.00 g |
| Polymeric latex: P-2 (average grain size: 0.1 μm) | 0.13 g |
| Polymeric latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer | |
| Binder: acid-processed gelatin (isoelectric point: 9.0) | 3.10 g |
| Polymeric latex: P-3 (average grain size: 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point: 9.0) | 3.30 g |
| Surfactant W-3 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant W-3 | 0.060 g |
| Surfactant W-2 | 7.0 mg |
| Hardener H-1 | 0.23 g |

Coating of Photosensitive Emulsion Layers

The following photosensitive emulsion layers were coated on the opposite side of the support to the side on which the back layers were coated to make Sample A101. Numbers represent addition amounts per $m^2$ of the coating surface. Note that the effects of added compounds are not restricted to the described purposes.

1st layer: Antihalation layer

| | | |
|---|---|---|
| Black colloidal silver | | 0.30 g |
| Gelatin | | 2.50 g |
| Ultraviolet absorbent U-1 | | 0.10 g |
| Ultraviolet absorbent U-3 | | 0.030 g |
| Ultraviolet absorbent U-4 | | 0.050 g |
| Ultraviolet absorbent U-5 | | 0.050 g |
| Dye D-4 | | 1.0 mg |
| Dye D-8 | | 2.5 mg |
| Fine crystal solid dispersion of dye E-1 | | 0.05 g |

2nd layer: Interlayer

| | | |
|---|---|---|
| Gelatin | | 0.80 g |
| Compound Cpd-A | | 0.2 mg |
| Compound Cpd-G | | 3.0 mg |
| Compound Cpd-H | | 0.030 g |
| Ultraviolet absorbent U-2 | | 0.010 g |
| Ultraviolet absorbent U-6 | | 0.020 g |
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |

3rd layer: Interlayer

| | | |
|---|---|---|
| Yellow colloidal silver | | 0.020 g |
| Gelatin | | 0.60 g |
| High-boiling organic solvent Oil-3 | | 0.010 g |
| High-boiling organic solvent Oil-8 | | 0.010 g |

4th layer: Low-speed red-sensitive emulsion layer

| | | |
|---|---|---|
| Emulsion A | silver | 0.15 g |
| Emulsion B | silver | 0.20 g |
| Emulsion C | silver | 0.20 g |
| Gelatin | | 0.80 g |
| Coupler C-1 | | 0.18 g |
| High-boiling organic solvent Oil-2 | | 0.020 g |

5th layer: Medium-speed red-sensitive emulsion layer

| | | |
|---|---|---|
| Emulsion C | silver | 0.30 g |
| Emulsion D | silver | 0.20 g |
| Gelatin | | 0.70 g |
| Coupler C-1 | | 0.20 g |
| High-boiling organic solvent Oil-2 | | 0.020 g |

6th layer: High-speed red-sensitive emulsion layer

| | | |
|---|---|---|
| Emulsion E | silver | 0.25 g |
| Emulsion F | silver | 0.30 g |
| Gelatin | | 1.70 g |
| Coupler C-1 | | 0.70 g |
| High-boiling organic solvent Oil-2 | | 0.070 g |
| Additive P-1 | | 0.010 g |

7th layer: Interlayer

| | | |
|---|---|---|
| Gelatin | | 0.70 g |
| Additive P-2 | | 0.10 g |
| Dye D-5 | | 0.020 g |
| Dye D-9 | | 6.0 mg |
| Compound Cpd-F | | 0.010 g |
| Compound Cpd-H | | 0.040 g |
| Compound Cpd-J | | 3.0 mg |
| Compound Cpd-K | | 5.0 mg |
| High-boiling organic solvent Oil-6 | | 0.050 g |

8th layer: Interlayer

| | | |
|---|---|---|
| Yellow colloidal silver | silver | 0.020 g |
| Gelatin | | 1.00 g |
| Additive P-2 | | 0.05 g |
| Compound Cpd-A | | 0.050 g |
| Compound Cpd-D | | 0.030 g |
| Compound Cpd-H | | 0.050 g |
| High-boiling organic solvent Oil-3 | | 0.010 g |
| High-boiling organic solvent Oil-6 | | 0.050 g |

-continued

9th layer: Low-speed green-sensitive emulsion layer

| | | |
|---|---|---|
| Emulsion G | silver | 0.30 g |
| Emulsion H | silver | 0.35 g |
| Emulsion I | silver | 0.30 g |
| Gelatin | | 1.70 g |
| Coupler C-2 | | 0.25 g |
| High-boiling organic solvent Oil-2 | | 0.10 g |

10th layer: Medium-speed green-sensitive emulsion layer

| | | |
|---|---|---|
| Emulsion I | silver | 0.30 g |
| Emulsion J | silver | 0.30 g |
| Gelatin | | 0.70 g |
| Coupler C-2 | | 0.40 g |
| High-boiling organic solvent Oil-2 | | 0.16 g |

11th layer: High-speed green-sensitive emulsion layer

| | | |
|---|---|---|
| Emulsion K | silver | 0.60 g |
| Gelatin | | 0.80 g |
| Coupler C-2 | | 0.50 g |
| High-boiling organic solvent Oil-2 | | 0.20 g |

12th layer: Yellow filter layer

| | | |
|---|---|---|
| Yellow colloidal silver | silver | 0.010 g |
| Gelatin | | 1.0 g |
| Compound Cpd-C | | 0.010 g |
| Compound Cpd-H | | 0.10 g |
| High-boiling organic solvent Oil-1 | | 0.020 g |
| High-boiling organic solvent Oil-6 | | 0.10 g |
| Fine crystal solid dispersion of dye E-2 | | 0.20 g |

13th layer: Interlayer

| | | |
|---|---|---|
| Gelatin | | 0.40 g |
| Compound Cpd-L | | 0.20 g |
| High-boiling organic solvent Oil-5 | | 0.010 g |
| Dye D-6 | | 2.0 mg |

14th layer: Low-speed blue-sensitive emulsion layer

| | | |
|---|---|---|
| Emulsion L | silver | 0.10 g |
| Emulsion M | silver | 0.20 g |
| Emulsion N | silver | 0.15 g |
| Gelatin | | 1.30 g |
| Coupler C-3 | | 0.35 g |
| Compound Cpd-B | | 0.10 g |
| Ultraviolet absorbent U-6 | | 0.010 g |
| High-boiling organic solvent Oil-2 | | 0.010 g |

15th layer: Medium-speed blue-sensitive emulsion layer

| | | |
|---|---|---|
| Emulsion N | silver | 0.15 g |
| Emulsion O | silver | 0.20 g |
| Gelatin | | 0.80 g |
| Coupler C-4 | | 0.25 g |
| Compound Cpd-B | | 0.10 g |
| Compound Cpd-I | | 2.0 mg |
| High-boiling organic solvent Oil-2 | | 0.010 g |

16th layer: High-speed blue-sensitive emulsion layer

| | | |
|---|---|---|
| Emulsion P | silver | 0.25 g |
| Emulsion Q | silver | 0.25 g |
| Gelatin | | 2.00 g |
| Coupler C-4 | | 1.10 g |
| High-boiling organic solvent Oil-2 | | 0.050 g |
| High-boiling organic solvent Oil-9 | | 0.050 g |
| Ultraviolet absorbent U-6 | | 0.10 g |
| Compound Cpd-I | | 5.0 mg |

17th layer: 1st protective layer

| | | |
|---|---|---|
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-J | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |

-continued

| | | |
|---|---|---|
| 18th layer: 2nd protective layer | | |
| Colloidal silver | silver | 2.5 mg |
| Silver iodobromide emulsion grains (average grain diameter 0.06 μm, silver iodide content: 1 mol %) | silver | 0.10 g |
| Gelatin | | 0.80 g |
| Ultraviolet absorbent U-1 | | 0.030 g |
| Ultraviolet absorbent U-6 | | 0.030 g |
| High-boiling organic solvent Oil-3 | | 0.010 g |
| 19th layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |

-continued

| | |
|---|---|
| Silicone oil SO-1 | 0.20 g |
| Surfactant W-1 | 3.0 mg |
| Surfactant W-2 | 8.0 mg |
| Surfactant W-3 | 0.040 g |
| Surfactant W-7 | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

Silver halide emulsions used in Sample 101

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) |
|---|---|---|---|---|---|---|---|---|---|---|---|
| A | Monodisperse tetradecahedral grains | 0.24 | 10 | 5.5 | Double structure | 1.5 | ○ | | | ○ | |
| B | Monodisperse (111) tabular grains Av. aspect ratio 2.0 | 0.25 | 10 | 4.5 | Triple structure | 2.5 | | ○ | | | ○ |
| C | Monodisperse (111) tabular grains Av. aspect ratio 5.0 | 0.30 | 19 | 3.5 | Quintuple structure | 0.5 | | ○ | | | ○ |
| D | Monodisperse (111) tabular grains Av. aspect ratio 7.0 | 0.40 | 21 | 3.0 | Triple structure | 1.0 | ○ | ○ | | ○ | ○ |
| E | Monodisperse (111) tabular grains Av. aspect ratio 10.0 | 0.50 | 10 | 0.5 | Quadruple structure | 1.5 | | ○ | | | |
| F | Monodisperse (111) tabular grains Av. aspect ratio 10.5 | 0.70 | 12 | 1.6 | Triple structure | 0.6 | ○ | ○ | | | ○ |
| G | Monodisperse cubic grains | 0.15 | 9 | 3.5 | Triple structure | 2.0 | | | ○ | ○ | |
| H | Monodisperse cubic grains | 0.20 | 10 | 3.0 | Triple structure | 0.7 | ○ | ○ | | ○ | |
| I | Monodisperse (111) tabular grains Av. aspect ratio 4.0 | 0.35 | 12 | 3.5 | Quintuple structure | 4.5 | | ○ | | | ○ |
| J | Monodisperse (111) tabular grains Av. aspect ratio 10.0 | 0.50 | 15 | 2.5 | Triple structure | 1.2 | ○ | | | | ○ |
| K | Monodisperse (111) tabular grains Av. aspect ratio 10.5 | 0.65 | 13 | 2.7 | Triple structure | 1.3 | ○ | ○ | | | ○ |
| L | Monodisperse tetradecahedral grains | 0.31 | 9 | 7.5 | Triple structure | 7.0 | | | ○ | ○ | ○ |
| M | Monodisperse tetradecahedral grains | 0.35 | 13 | 4.5 | Quadruple structure | 2.0 | ○ | ○ | | | ○ |
| N | Monodisperse (111) tabular grains Av. aspect ratio 8.0 | 0.33 | 13 | 2.1 | Quadruple structure | 4.0 | ○ | ○ | ○ | | |
| O | Monodisperse (111) tabular grains Av. aspect ratio 10.0 | 0.50 | 9 | 2.5 | Quadruple structure | 1.0 | | ○ | | | ○ |
| P | Monodisperse (111) tabular grains Av. aspect ratio 12.0 | 0.75 | 21 | 1.8 | Triple structure | 0.5 | ○ | ○ | | | ○ |

TABLE 1-continued

Silver halide emulsions used in Sample 101

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) |
|---|---|---|---|---|---|---|---|---|---|---|---|
| Q | Monodisperse (111) tabular grains<br>Av. aspect ratio 12.0 | 0.90 | 15 | 0.8 | Quadruple structure | 0.3 | ○ | | | | ○ |

Av. ESD = Equivalent-sphere average grain size;
COV = Coefficient of variation
(Other characteristics)
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsions were after-ripped by the use of sodium thiosulfate, sodium thiocyanate, and sodium aurichloride. Note, also, a iridium salt was added during grain formation.
Note, also, that chemically-modified gelatin whose amino groups were partially converted to phthalic acid amide, was added to emulsions B, C, E, H, J, N, and Q.

TABLE 2

Spectral sensitization of Emulsions A to Q

| Emulsion | Spectral sensitizing dye added | Addition amount per mol of silver halide (g) | Timing at which the sensitizing dye was added |
|---|---|---|---|
| A | S-1 | 0.01 | Subsequent to after-ripening |
| | S-2 | 0.20 | Prior to after-ripening |
| | S-3 | 0.02 | Prior to after-ripening |
| | S-8 | 0.25 | Prior to after-ripening |
| | S-14 | 0.01 | Prior to after-ripening |
| B | S-2 | 0.20 | Prior to after-ripening |
| | S-3 | 0.02 | Prior to after-ripening |
| | S-8 | 0.20 | Prior to after-ripening |
| | S-14 | 0.01 | Prior to after-ripening |
| C | S-2 | 0.25 | Prior to after-ripening |
| | S-3 | 0.04 | Prior to after-ripening |
| | S-8 | 0.25 | Prior to after-ripening |
| | S-13 | 0.02 | Subsequent to after-ripening |
| | S-14 | 0.04 | Subsequent to after-ripening |
| D | S-2 | 0.25 | Prior to after-ripening |
| | S-3 | 0.03 | Prior to after-ripening |
| | S-8 | 0.25 | Prior to after-ripening |
| | S-13 | 0.01 | Prior to after-ripening |
| E | S-1 | 0.01 | Subsequent to after-ripening |
| | S-2 | 0.20 | Prior to after-ripening |
| | S-3 | 0.05 | Prior to after-ripening |
| | S-8 | 0.25 | Prior to after-ripening |
| | S-13 | 0.01 | Prior to after-ripening |
| | S-14 | 0.02 | Prior to after-ripening |
| F | S-2 | 0.20 | Prior to after-ripening |
| | S-3 | 0.04 | Prior to after-ripening |
| | S-8 | 0.20 | Prior to after-ripening |
| | S-14 | 0.02 | Prior to after-ripening |
| G | S-4 | 0.3 | Subsequent to after-ripening |
| | S-5 | 0.05 | Subsequent to after-ripening |
| | S-12 | 0.1 | Subsequent to after-ripening |
| H | S-4 | 0.2 | Prior to after-ripening |
| | S-9 | 0.15 | Prior to after-ripening |
| | S-14 | 0.02 | Prior to after-ripening |
| I | S-4 | 0.3 | Prior to after-ripening |
| | S-9 | 0.2 | Prior to after-ripening |
| | S-12 | 0.1 | Prior to after-ripening |

TABLE 2-continued

Spectral sensitization of Emulsions A to Q

| Emulsion | Spectral sensitizing dye added | Addition amount per mol of silver halide (g) | Timing at which the sensitizing dye was added |
|---|---|---|---|
| J | S-4 | 0.35 | Prior to after-ripening |
| | S-5 | 0.05 | Subsequent to after-ripening |
| | S-12 | 0.1 | Prior to after-ripening |
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequent to after-ripening |
| | S-10 | 0.2 | Subsequent to after-ripening |
| | S-11 | 0.05 | Subsequent to after-ripening |
| N | S-6 | 0.05 | Subsequent to after-ripening |
| | S-7 | 0.05 | Subsequent to after-ripening |
| | S-10 | 0.25 | Subsequent to after-ripening |
| | S-11 | 0.05 | Subsequent to after-ripening |
| O | S-10 | 0.4 | Subsequent to after-ripening |
| | S-11 | 0.15 | Subsequent to after-ripening |
| P | S-6 | 0.05 | Subsequent to after-ripening |
| | S-10 | 0.3 | Prior to after-ripening |
| | S-11 | 0.1 | Prior to after-ripening |
| Q | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |

C-1
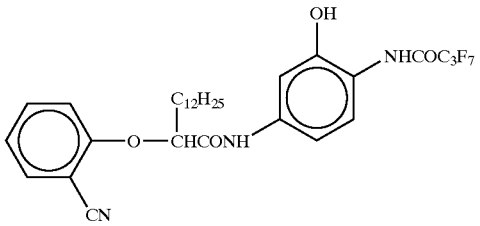
C-2
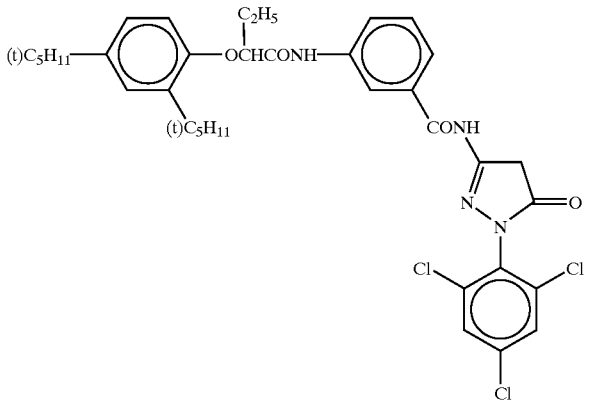
C-3
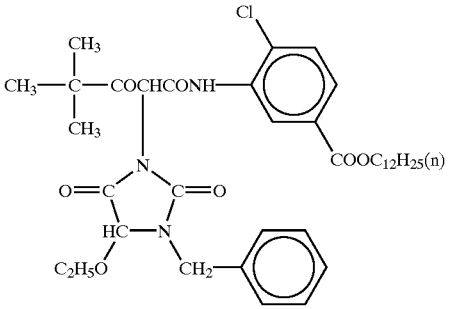
C-4
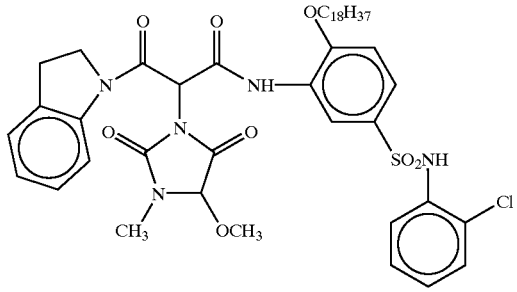
Oil-1
Tri(n-hexyl) phosphate
Oil-2
Tricresyl phosphate
Oil-3
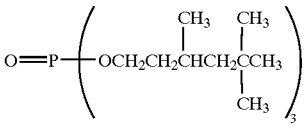
Bis (2-ethylhexyl) succinate
Oil-4
Tricyclohexyl phosphate
Oil-5
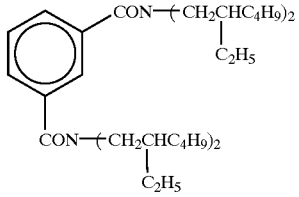
Oil-6
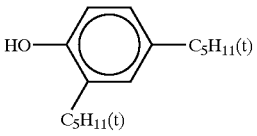
Oil-7
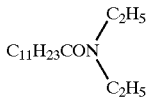
Oil-8
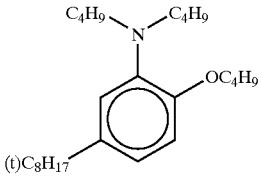
Oil-9
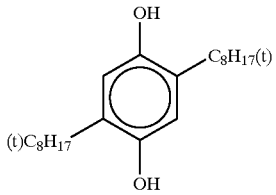
Cpd-A -continued
Cpd-B
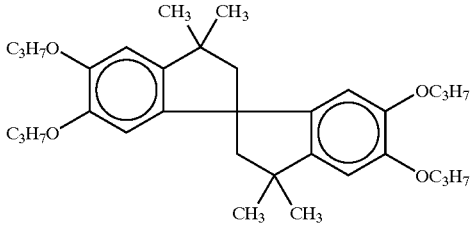
Cpd-C
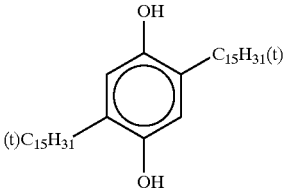
Cpd-D
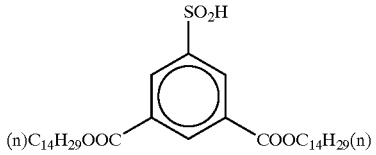
Cpd-E
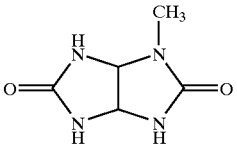
Cpd-F
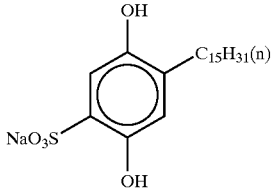
Cpd-G
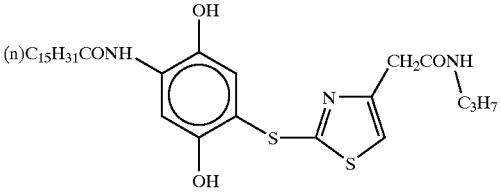
Cpd-H
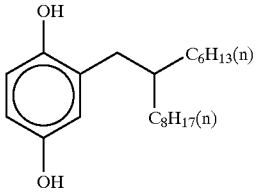
Cpd-I
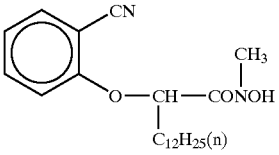
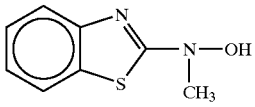
Cpd-J
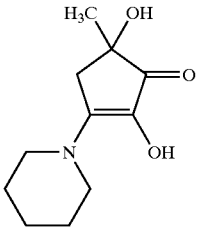
Cpd-K
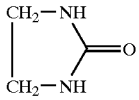
Cpd-L
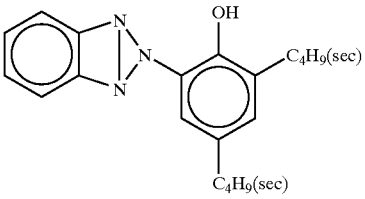
U-1
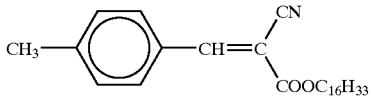
U-2
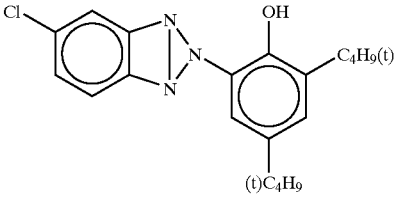
U-3

-continued
U-4
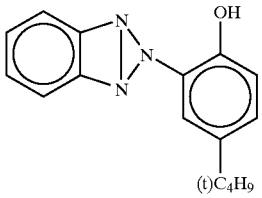
U-5
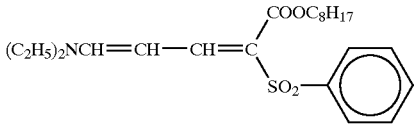
U-6
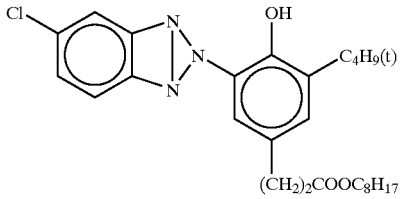
S-1
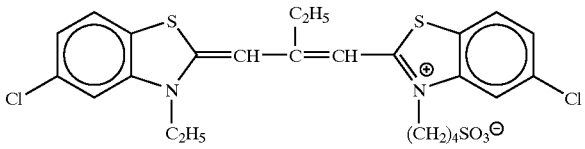
S-2
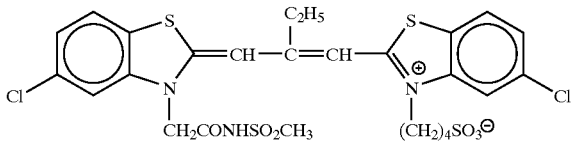
S-3
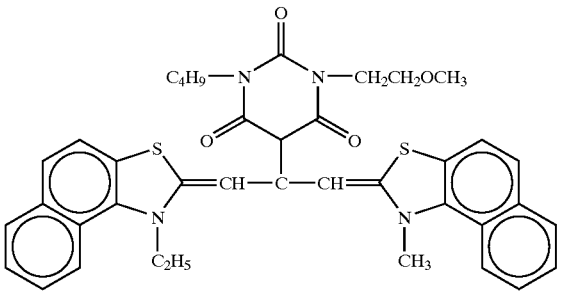
S-4
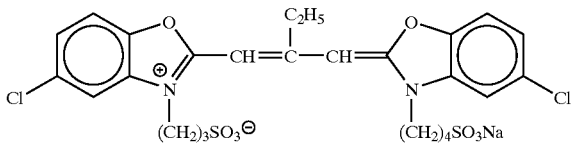
S-5
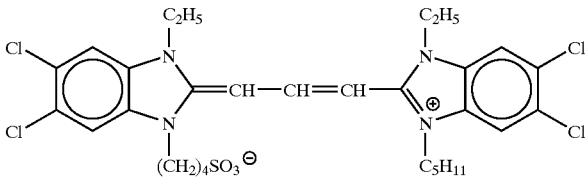
S-6
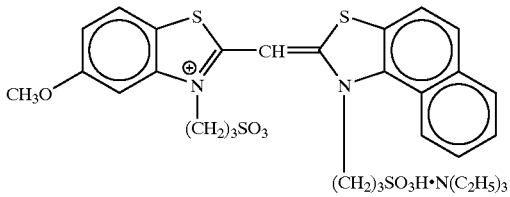
S-7
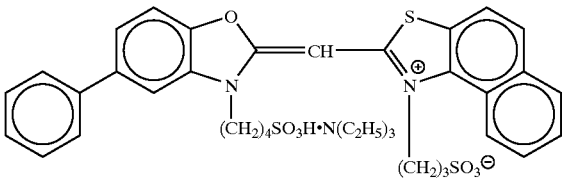
S-8
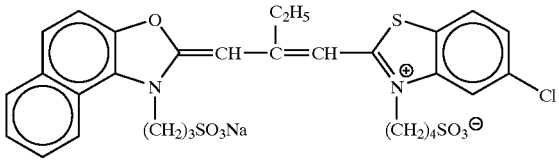
S-9
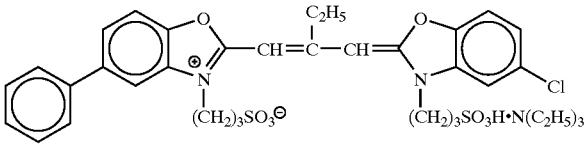
S-10
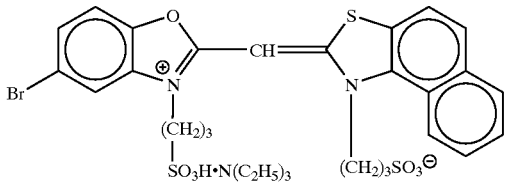
S-11
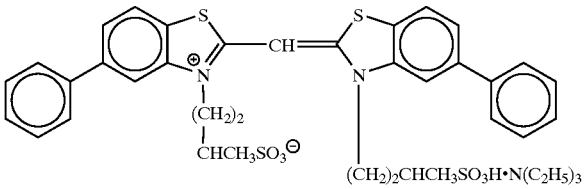

-continued
S-12
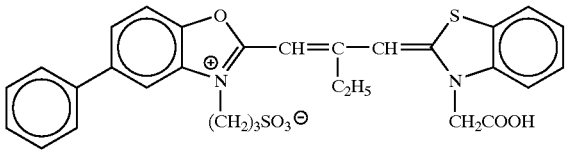
S-13
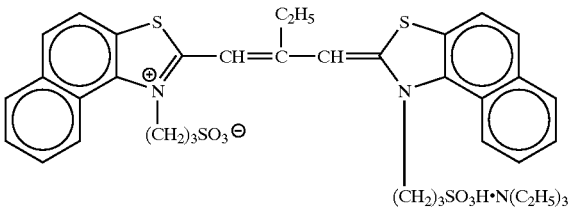
S-14
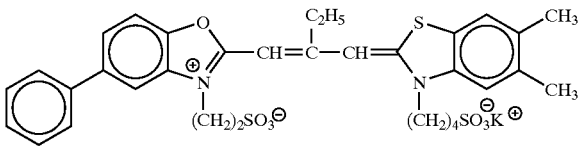
D-1
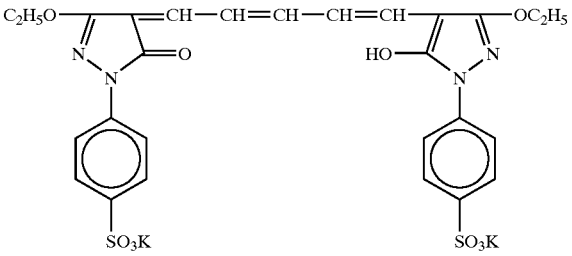
D-2
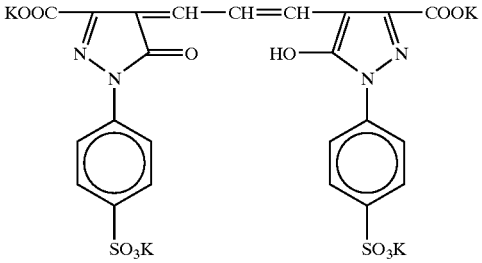
D-3
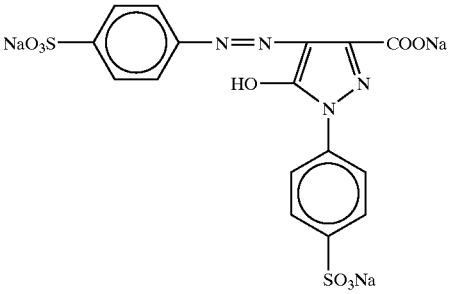
D-4
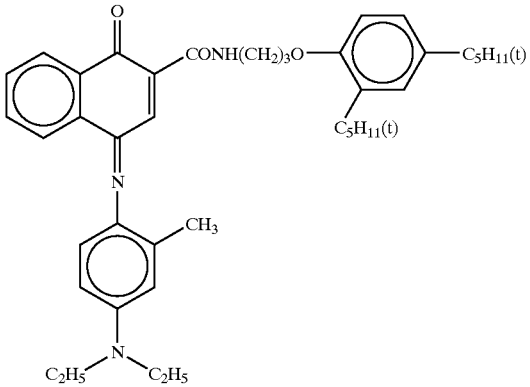
D-5
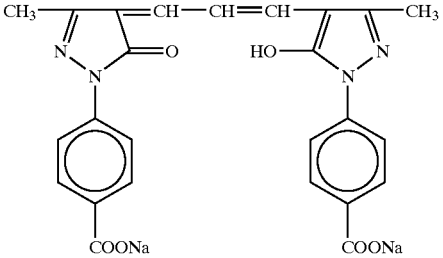
D-6
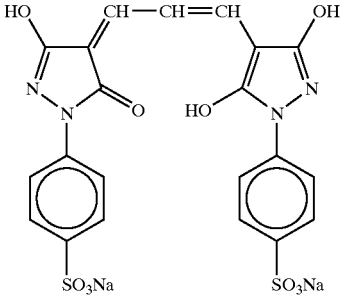
D-7
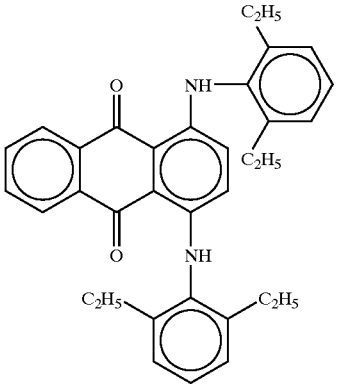

-continued
D-8
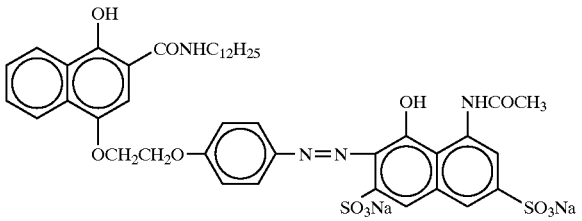
D-9
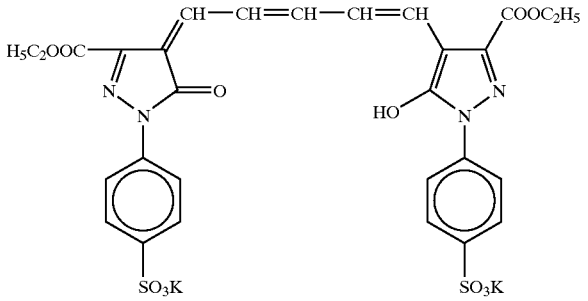
D-10
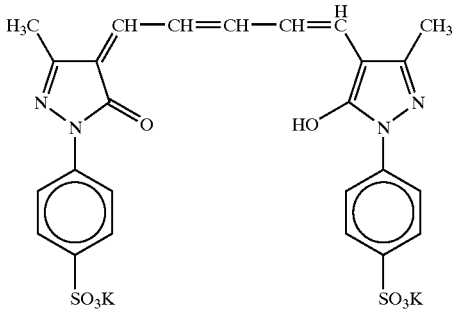
E-1
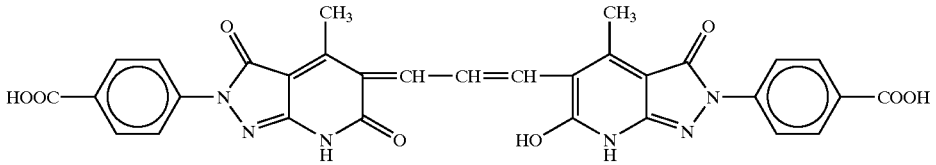
E-2
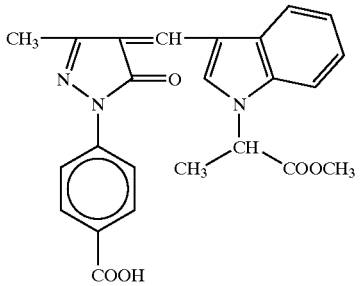
H-1
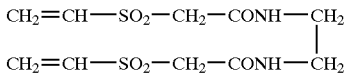
W-1
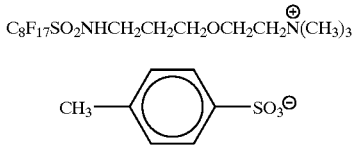
W-2
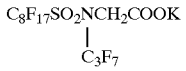
W-3
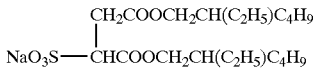
W-4
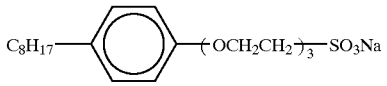
W-5
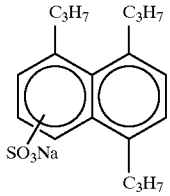
W-6
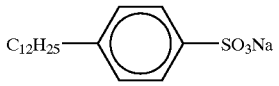

$C_8F_{17}SO_3Li$
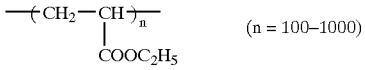
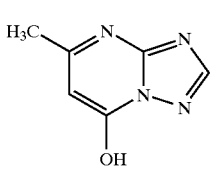
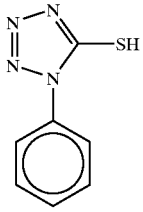
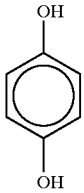
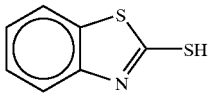
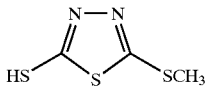
-continued
W-7
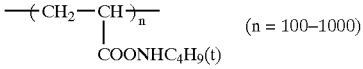
P-1
P-2
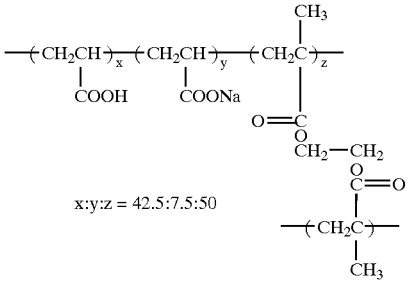
P-3
F-1
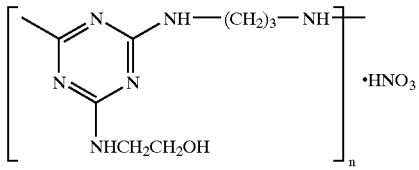
F-2
F-3
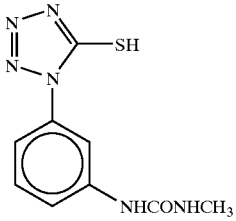
F-4
F-5
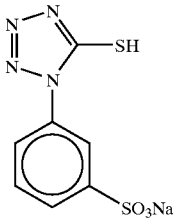
F-6
F-7
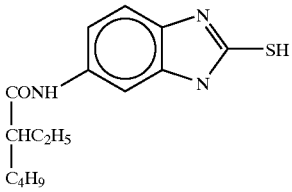
F-8
F-9
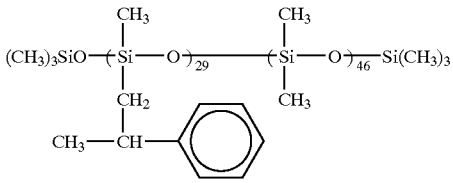
SO-1

Preparation of Organic Solid Dispersed Dye (Preparation of Fine Crystalline Solid Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Fine Crystalline Solid Dispersion of Dye E-2)

Water and 270 g of W-4 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion. The average grain size was 0.15 $\mu$m.

Subsequently, sample A102 was prepared by replacing the couplers and high-boiling organic solvents of the 4th, 5th and 6th layers of the sample A101 as indicated in Table 3. The replacement of couplers was conducted so that the same cyan maximum density was realized upon processing through the following Development Processing A. Further, the coupler replacement was conducted so that in the layers of identical color sensitivity the coupler ratios among high-speed, medium-speed and low-speed layers were the same as in the sample A101. With respect to high-boiling organic solvents, the replacement thereof was conducted as indicated in Table 3, and expressed in terms of mass weight ratio to coupler. The amount of Ag was changed as indicated in Table 3. Further additives other than those specifically mentioned were not changed from those of the sample A101.

TABLE 3

| Sample | Coupler in 4th, 5th and 6th layers | High-boiling organic solvent (Wt. ratio with respect to coupler) | Ag amount in 4th, 5th and 6th layers |
|---|---|---|---|
| A101 | C-1 | oil-2 (0.1) | — |
| A102 | CC-2 | oil-A (0.35)<br>oil-B (0.20)<br>Additive-C (0.10) | Reduced to 0.7 times with respect to Sample A101 in each of the layers |

oil-A

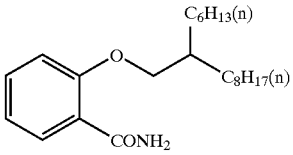

oil-B

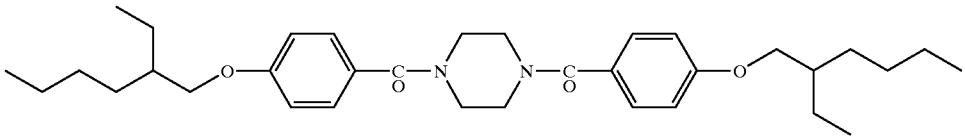

Additive-C

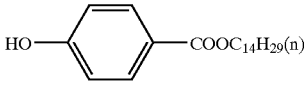

In this Example, the following Development Processing A was carried out. In the processing, each solution was used after samples A101 and A102, 60% of which were subjected to complete exposure to white light, were applied at a ratio of 1:1 until the replenishing volume became 5 times the tank capacity.

| Step | Time (min) | Temp. (° C.) | Tank vol. (L) | Replenishment rate (mL/m$^2$) |
|---|---|---|---|---|
| 1st Development | 6 | 38 | 195 | 2200 |
| 1st Aater washing | 2 | 38 | 55 | 4000 |
| Reversal | 2 | 38 | 90 | 1100 |
| Color development | 6 | 38 | 180 | 1500 |
| Prebleaching | 2 | 38 | 70 | 1100 |
| Bleaching | 6 | 38 | 160 | 220 |
| Fixing | 4 | 38 | 120 | 1100 |
| 2nd Water washing | 4 | 38 | 100 | 4000 |
| Final rinse | 1 | 25 | 45 | 1100 |

The composition of each processing solution was as follows.

| (1st development solution) | Tank solution | Replenisher |
|---|---|---|
| Pentasodium nitrilo-N,N,N-trimethylenephosphonate | 1.5 g | 1.5 g |
| Pentasodium diethylenetriaminepentacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 mL | 1000 mL |
| pH | 9.60 | 9.60 |

This pH was adjusted by the use of sulfuric acid or potassium hydroxide.

| (reversal solution) | Tank solution | Replenisher |
|---|---|---|
| Pentasodium nitrilo-N,N,N-trimethylenephosphonate | 3.0 g | same as the tank solution |
| Stannous chloride dihydrate | 1.0 g | |
| p-Aminophenol | 0.1 g | |
| Sodium hydroxide | 8 g | |
| Glacial acetic acid | 15 mL | |
| Water to make | 1000 mL | |
| PH | 6.00 | |

This pH was adjusted by the use of acetic acid or sodium hydroxide.

| (Color developer) | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfonamidoethyl)-3-methyl-4-aminoaniline 3/2 sulfate monohydrate | 10 g | 10 g |
| 3,6-Dithiaoctane-1,8-diol | 1.0 g | 1.0 g |
| Water to make | 1000 mL | 1000 mL |
| pH | 11.80 | 12.00 |

This pH was adjusted by the use of sulfuric acid or potassium hydroxide.

| (Prebleaching) | Tank solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde/sodium bisulfite adduct | 30 g | 35 g |
| Water to make | 1000 mL | 1000 mL |
| pH | 6.50 | 6.50 |

This pH was adjusted by the use of acetic acid or sodium hydroxide.

| (Bleaching solution) | Tank solution | Replenisher |
|---|---|---|
| Disodium ethylenediaminetetraacetate dihydrate | 2.0 g | 4.0 g |
| Fe(III) ammonium ethylenediaminetetraacetate dihydrate | 120 g | 240 g |
| Potassium bromide | 100 g | 200 g |
| Ammonium nitrate | 10 g | 20 g |
| Water to make | 1000 mL | 1000 mL |
| pH | 5.70 | 5.50 |

This pH was adjusted by the use of nitric acid or sodium hydroxide.

| (Fixing solution) | Tank solution | Replenisher |
|---|---|---|
| Ammonium thiosulfate | 80 g | same as the tank solution |
| Sodium sulfite | 5.0 g | |
| Sodium bisulfite | 5.0 g | |
| Water to make | 1000 mL | |
| pH | 6.60 | |

This pH was adjusted by the use of acetic acid or aqueous ammonia.

| (Stabilizer) | Tank solution | Replenisher |
|---|---|---|
| 1,2-Benzoisothiazolin-3-one | 0.02 g | 0.03 g |
| Polyoxyethylene p-monononylphenyl ether (av. deg. of polymn. 10) | 0.3 g | 0.3 g |
| Polymaleic acid (av. mol. wt. 2,000) | 0.1 g | 0.15 g |
| Water to make | 1000 mL | 1000 mL |
| pH | 7.0 | 7.0 |

In the above development processing operation, continuous solution circulation and agitation was conducted in each of the baths. In each tank, a burst pipe provided with small holes of 0.3 mm diameter at intervals of 1 cm was arranged on the bottom thereof so as to effect continuous bursting of nitrogen gas and agitation. The bursting agitation was not performed in the pre-bleaching bath and the second washing bath.

B; Procedure for Preparing Photosensitive Material for Duplication

The following silver halide color photosensitive material for duplication, sample B101, was prepared.

A support of 195 μm thick undercoated triacetylcellulose film was coated with the silver halide emulsions of Tables 4 and 5, so that a multilayer color photosensitive material having layers of the following compositions, sample B101, was obtained. The figures are for the addition amount per $m^2$. The effects of added compounds are not limited to described uses.

| | | |
|---|---|---|
| 1st layer: Antihalation layer | | |
| Black colloidal silver | silver | 0.28 g |
| Gelatin | | 2.25 g |
| Ultraviolet absorber U1-1 | | 0.05 g |
| Ultraviolet absorber U1-2 | | 0.02 g |
| Ultraviolet absorber U1-3 | | 0.04 g |
| High-boiling organic solvent Oil1-1 | | 0.03 g |
| High-boiling organic solvent Oil1-3 | | 0.08 g |
| Fine crystalline solid dispersion of dye E1-1 | | 0.05 g |
| 2nd layer: Interlayer | | |
| Gelatin | | 0.39 g |
| Compound Cpd1-A | | 1.1 mg |
| High-boiling organic solvent Oil1-2 | | 0.02 g |
| Dye D1-1 | | 9.0 mg |
| 3rd layer: Interlayer | | |
| Silver iodobromide emulsion grains having grain surface fogged (av. grain diam. 0.06 μm and silver iodide content 1 mol %) | silver | 0.03 g |
| Gelatin | | 0.45 g |
| 4th layer: Low-speed red-sensitive emulsion layer | | |
| Emulsion A1 | silver | 0.33 g |
| Gelatin | | 0.68 g |
| Coupler Cp-1 | | 0.06 g |
| Coupler Cp-2 | | 0.15 g |
| Compound Cpd1-B | | 5.0 mg |
| Compound Cpd1-C | | 1.0 mg |
| Compound Cpd1-D | | 0.01 g |
| High-boiling organic solvent Oil1-3 | | 0.05 g |
| 5th layer: Medium-speed red-sensitive emulsion layer | | |
| Emulsion B1 | silver | 0.34 g |
| Emulsion C1 | silver | 0.09 g |
| Gelatin | | 1.46 g |
| Coupler Cp-1 | | 0.30 g |
| Coupler Cp-2 | | 0.30 g |
| Compound Cpd1-C | | 2.0 mg |
| High-boiling organic solvent Oil1-3 | | 0.10 g |
| 6th layer: High-speed red-sensitive emulsion layer | | |
| Emulsion D1 | silver | 0.37 g |
| Emulsion E1 | silver | 0.21 g |
| Gelatin | | 1.45 g |
| Coupler Cp-1 | | 0.18 g |
| Coupler Cp-2 | | 0.40 g |
| Coupler Cp-3 | | 0.02 g |
| Compound Cpd1-D | | 3.0 mg |
| High-boiling organic solvent Oil1-3 | | 0.13 g |
| 7th layer: Interlayer | | |
| Gelatin | | 0.40 g |
| Color mixing preventive Cpd1-E | | 0.02 g |
| High-boiling organic solvent Oil1-1 | | 0.02 g |
| Solid dispersion of dye E1-2 | | 0.01 g |

-continued

| | | |
|---|---|---|
| 8th layer: Interlayer | | |
| Yellow colloidal silver | silver | 0.04 g |
| Gelatin | | 1.20 g |
| Compound Cpd1-C | | 0.15 g |
| High-boiling organic solvent Oil1-2 | | 0.46 g |
| Solid dispersion of dye E1-1 | | 0.10 g |
| Additive M1-1 | | 0.05 g |
| 9th layer: Low-speed green-sensitive emulsion layer | | |
| Emulsion F1 | silver | 0.40 g |
| Silver iodobromide emulsion grains having surface and internal portion fogged (av. grain diam. 0.1 μm and silver iodide content 1 mol %) | silver | 0.04 g |
| Gelatin | | 1.60 g |
| Coupler Cp-4 | | 0.02 g |
| Coupler Cp-5 | | 0.10 g |
| Coupler Cp-6 | | 0.02 g |
| Coupler Cp-7 | | 0.15 g |
| Compound Cpd1-C | | 0.9 mg |
| Compound Cpd1-F | | 9.0 mg |
| High-boiling organic solvent Oil1-3 | | 0.23 g |
| 10th layer: Medium-speed green-sensitive emulsion layer | | |
| Emulsion G1 | silver | 0.37 g |
| Emulsion H1 | silver | 0.12 g |
| Gelatin | | 0.93 g |
| Coupler Cp-4 | | 0.25 g |
| Coupler Cp-5 | | 0.02 g |
| Coupler Cp-7 | | 0.02 g |
| Compound Cpd1-C | | 0.6 mg |
| Compound Cpd1-F | | 7.0 mg |
| High-boiling organic solvent Oil1-3 | | 0.12 g |
| 11th layer: High-speed green-sensitive emulsion layer | | |
| Emulsion I1 | silver | 0.37 g |
| Emulsion J1 | silver | 0.28 g |
| Gelatin | | 1.74 g |
| Coupler Cp-4 | | 0.40 g |
| Coupler Cp-5 | | 0.02 g |
| Coupler Cp-7 | | 0.02 g |
| Compound Cpd1-C | | 1.3 mg |
| Compound Cpd1-F | | 0.02 g |
| High-boiling organic solvent Oil1-3 | | 0.26 g |
| 12th layer: Interlayer | | |
| Gelatin | | 0.39 g |
| Compound Cpd1-C | | 0.02 g |
| Formalin scavenger Cpd1-G | | 1.20 g |
| Formalin scavenger Cpd1-H | | 0.38 g |
| High-boiling organic solvent Oil1-2 | | 0.09 g |
| Additive M1-1 | | 0.11 g |
| 13th layer: Yellow filter layer | | |
| Yellow colloidal silver | silver | 0.19 g |
| Gelatin | | 0.05 g |
| Color mixing preventive Cpd1-E | | 0.05 g |
| Color mixing preventive Cpd1-I | | 0.01 g |
| High-boiling organic solvent Oil1-2 | | 0.02 g |
| Fine crystalline solid dispersion of dye E1-3 | | 0.05 g |
| Additive M1-1 | | 0.63 g |
| 14th layer: Interlayer | | |
| Silver iodobromide emulsion grains (av. grain diam. 0.06 μm and silver iodide content 1 mol %) | silver | 0.10 g |
| Gelatin | | 0.33 g |
| Color mixing preventive Cpd1-E | | 0.03 g |
| 15th layer: Low-speed blue-sensitive emulsion layer | | |
| Emulsion K1 | silver | 0.25 g |
| Emulsion L1 | silver | 0.12 g |

-continued

| | | |
|---|---|---|
| Emulsion M1 | silver | 0.12 g |
| Gelatin | | 1.57 g |
| Coupler Cp-8 | | 0.63 g |
| 16th layer: High-speed blue-sensitive emulsion layer | | |
| Emulsion M1 | silver | 0.10 g |
| Emulsion N1 | silver | 0.13 g |
| Emulsion O1 | silver | 0.30 g |
| Gelatin | | 1.92 g |
| Coupler Cp-8 | | 1.00 g |
| Coupler Cp-9 | | 0.10 g |
| Coupler Cp-10 | | 0.10 g |
| 17th layer: 1st protective layer | | |
| Gelatin | | 1.37 g |
| Ultraviolet absorber U1-1 | | 0.02 g |
| Ultraviolet absorber U1-4 | | 0.01 g |
| Ultraviolet absorber U1-5 | | 0.04 g |
| Dye D1-2 | | 0.01 g |
| Dye D1-3 | | 0.02 g |
| Dye D1-4 | | 5.0 mg |
| Dye D1-5 | | 5.0 mg |
| Dye D1-6 | | 0.02 g |
| 18th layer: 2nd protective layer | | |
| Colloidal silver | silver | 0.1 mg |
| Silver iodobromide emulsion grains (av. grain diam. 0.06 μm and silver iodide content 1 mol %) | silver | 0.10 g |
| Gelatin | | 0.66 g |
| 19th layer: 3rd protective layer | | |
| Gelatin | | 1.39 g |
| Polymethyl methacrylate (av. particle diam. 1.5 μm) | | 8.0 mg |
| Methyl methacrylate/methacrylate 6:4 copolymer (av. particle diam. 1.5 μm) | | 0.23 g |
| Silicone oil | | 0.03 g |
| Surfactant W1-1 | | 3.0 mg |
| Surfactant W1-2 | | 6.0 mg |

In addition to the above components, additives F1-1 to F1-11 were added to all the above emulsion layers. In the sample B101, the compound F1-6 was added to the 19th layer in an amount of 0.3 mmol per mol of photosensitive silver halides.

Furthermore, in addition to the above components, gelatin hardener H1-1 and surfactants for coating and emulsification W1-3 to W1-7 were added to the above layers.

Still further, phenol, 1,2-benzisothiazolin-3-one, 2-phenoxyethanol, phenethyl alcohol and butyl p-benzoate were added as antiseptics and mildewproofing agents.

The opposite side of the support was furnished with the following back layers.

| | |
|---|---|
| B-1 layer: Back layer | |
| Acid-treated gelatin | 2.0 g |
| Ultraviolet absorber U1-1 | 0.1 g |
| Ultraviolet absorber U1-2 | 0.05 g |
| Ultraviolet absorber U1-3 | 0.03 g |
| High-boiling organic solvent Oil1-1 | 0.1 g |
| Additive M1-1 | 0.6 g |
| Additive M1-2 | 0.7 g |
| B-2 layer: Back 1st protective layer | |
| Acid-treated gelatin | 9.0 g |
| B-3 layer: Back 2nd protective layer | |
| Alkali-treated gelatin | 1.5 g |

-continued

| | |
|---|---|
| Polymethyl methacrylate (av. particle diam. 1.5 μm) | 0.02 g |
| Methyl methacrylate/methacrylate 6:4 copolymer (av. particle diam. 1.5 μm) | 0.05 g |
| Strontium/barium sulfate grains (av. grain diam. 1.4 μm) | 0.15 g |
| Surfactant W1-2 | 5 mg |
| Surfactant W1-3 | 50 mg |

Further, in addition to the above components, sodium chloride, potassium nitrate, calcium chloride, surfactant for coating W1-6, surfactant for emulsification W1-4 and gelatin hardener H1-1 were added to the layers of sample B101. Still further, phenol, 1,2-benzisothiazolin-3-one, 2-phenoxyethanol, phenyl isothiocyanate and phenethyl alcohol as antiseptics and mildewproofing agents were added to the layers of sample B101.

Cp-1

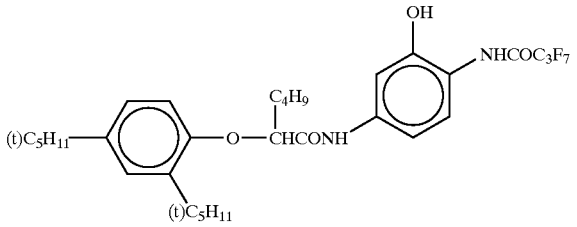

Cp-2

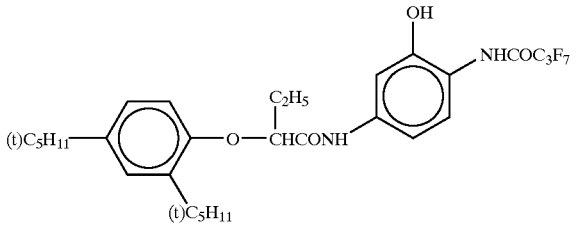

Cp-3

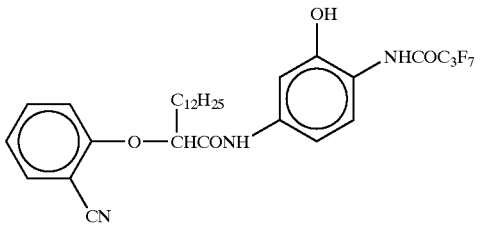

Cp-4

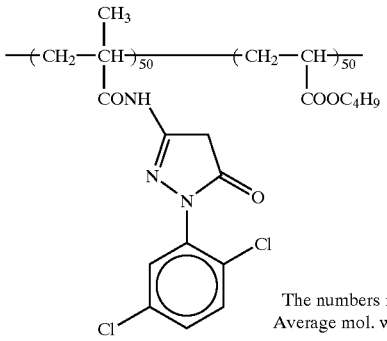

The numbers represent wt. %
Average mol. wt.: about 25,000

-continued
Cp-5
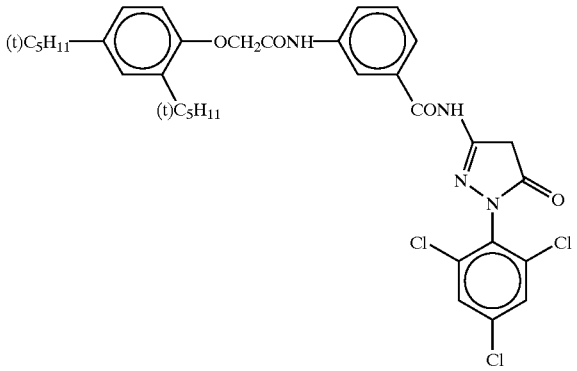
Cp-6
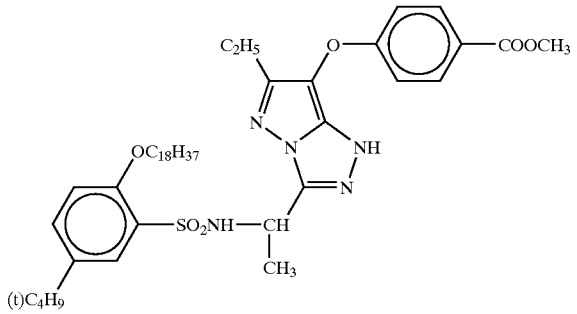
Cp-7
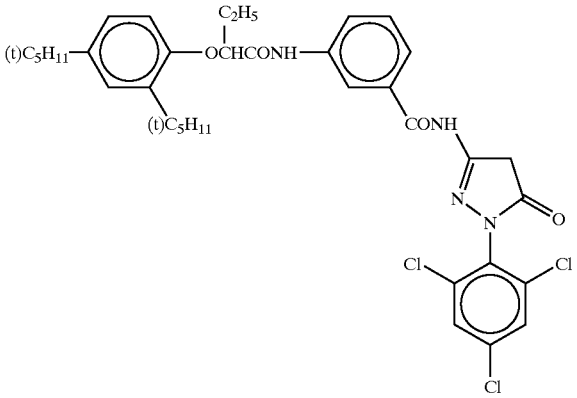
Cp-8
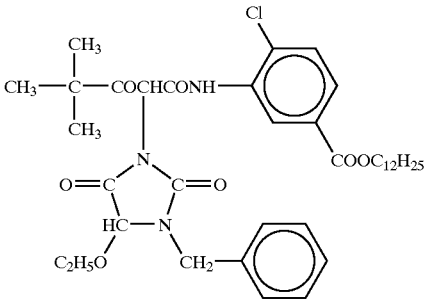
-continued
Cp-9
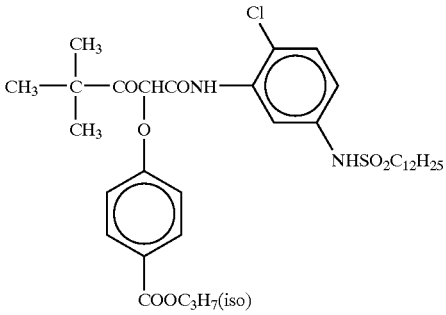
Cp-10
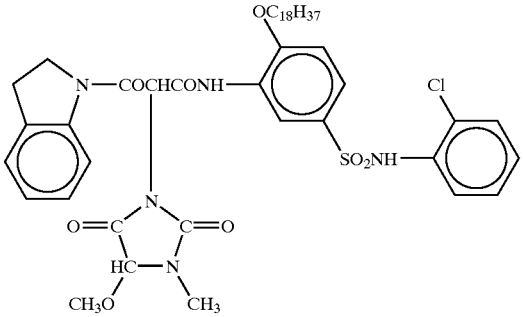
Oill-1
Dibutyl phthalate
Oill-2
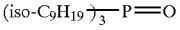
Oill-3
Tricresyl phosphate
Cpdl-A
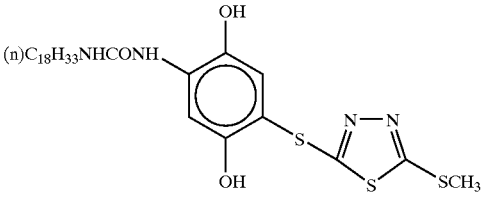
Cpdl-B
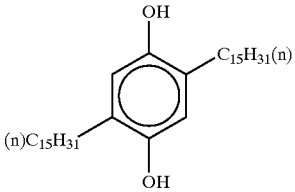
Cpdl-C
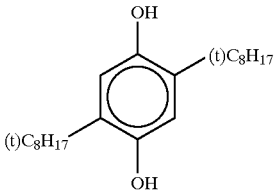
Cpdl-D
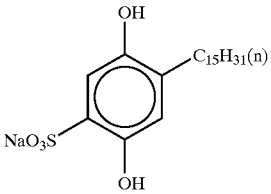

-continued
Cpdl-E
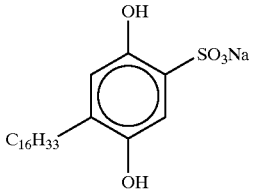
Cpdl-F
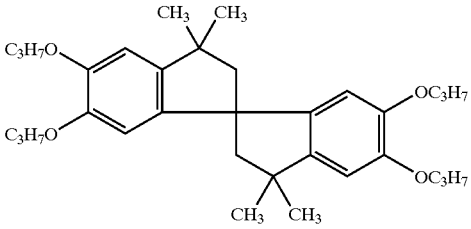
Cpdl-G
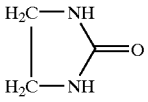
Cpdl-H
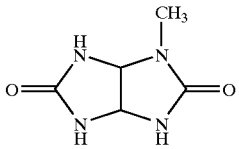
Cpdl-I
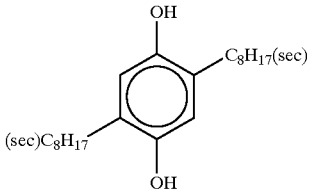
U1-1
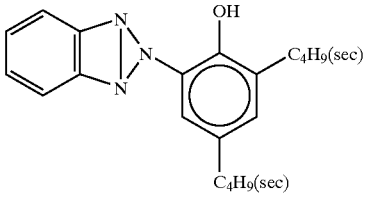
U1-2
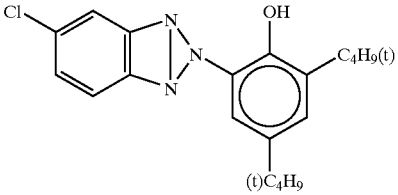
U1-3
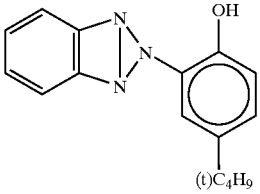
U1-4
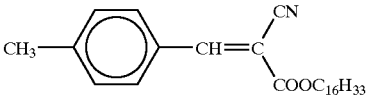
-continued
U1-5
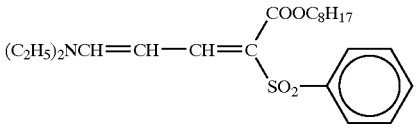
S1-1
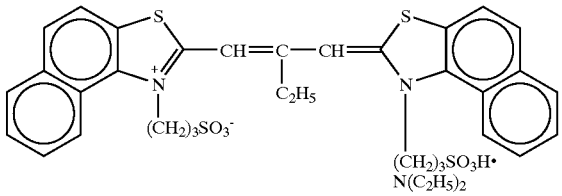
S1-2
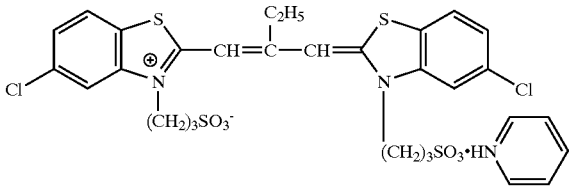
S-3
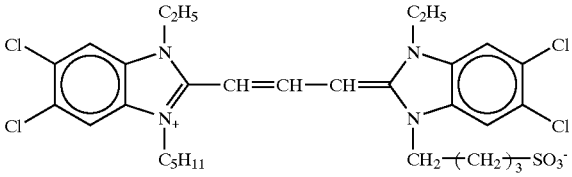
S1-4
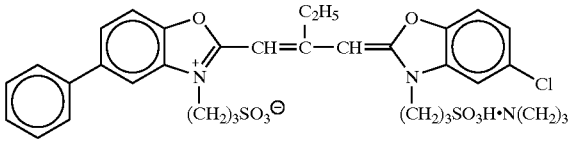
S1-5
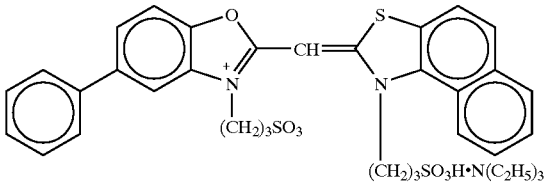
S1-6
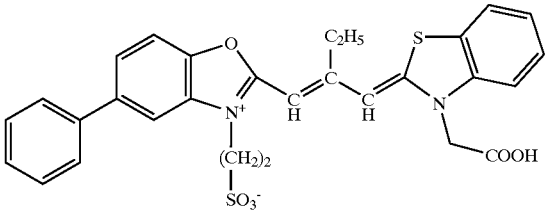

-continued
D1-1
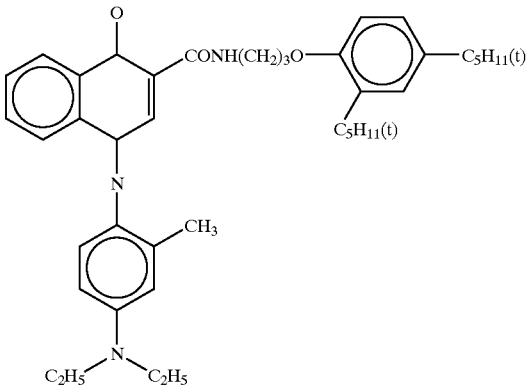
D1-2
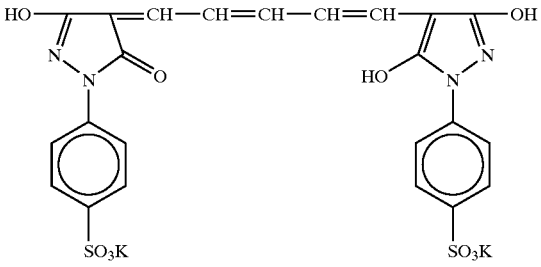
D1-3
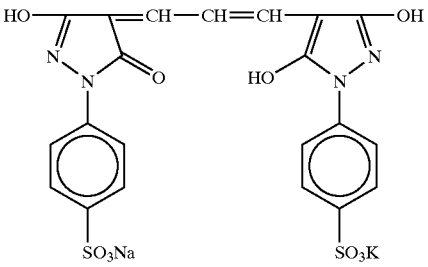
D1-4
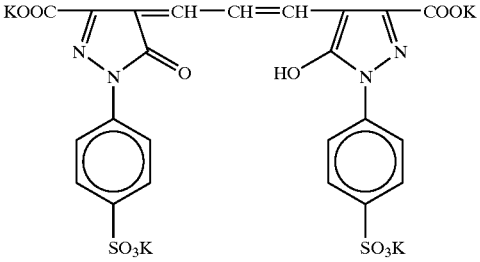
D1-5
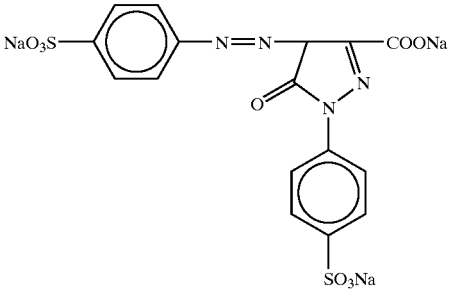
-continued
D1-6
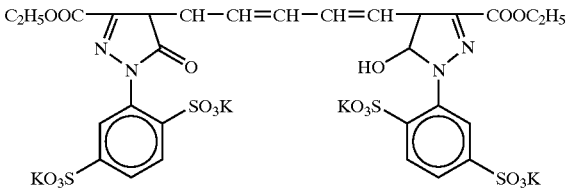
E1-1
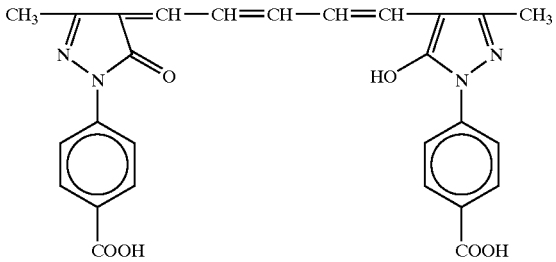
E1-2
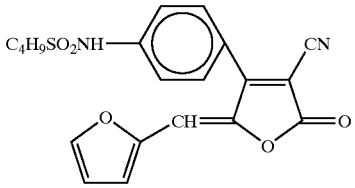
E1-3
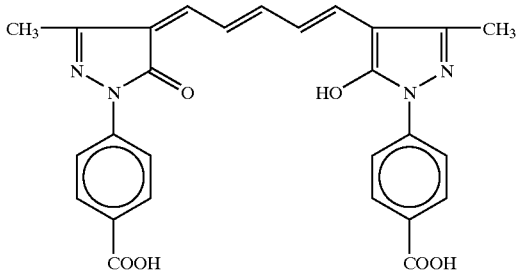
H1-1
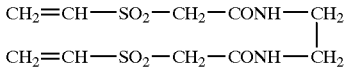
W1-1
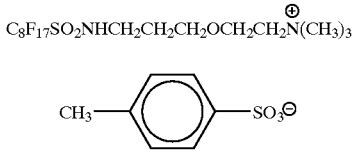
W1-2
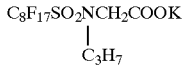
W1-3
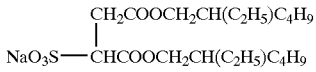
W1-4
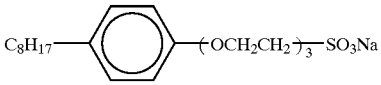

-continued
W1-5
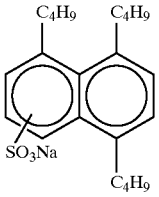
W1-6
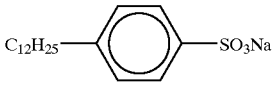
W1-7
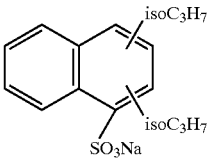
M1-1
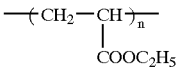
M1-2
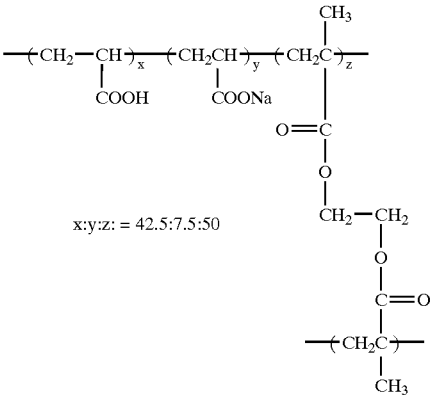
x:y:z: = 42.5:7.5:50
F1-1
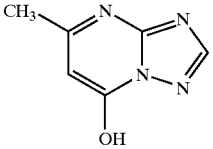
F1-2
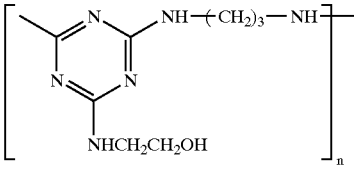
$\cdot HNO_3$
F1-3
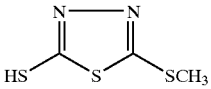
-continued
F1-4
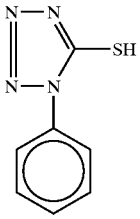
F1-5
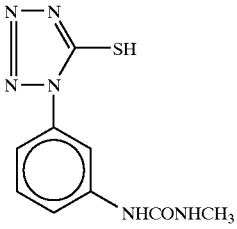
F1-6
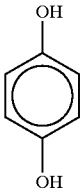
F1-7
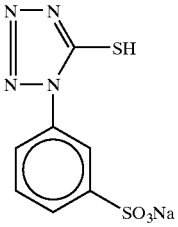
F1-8
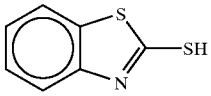
F1-9
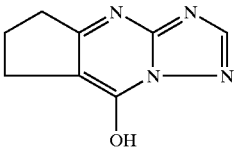
F1-10
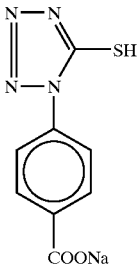

-continued

F1-11

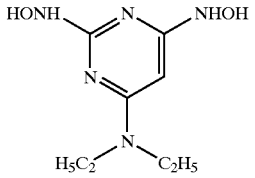

TABLE 4

| Emulsion | Characteristics of grains | Equivalent sphere average grain diameter (μm) | Coefficient of variation (%) | Silver iodide content (%) |
|---|---|---|---|---|
| A1 | Surface low-iodide triple structure monodisperse cubic grains | 0.12 | 8 | 4.5 |
| B1 | Surface low-iodide triple structure monodisperse cubic grains | 0.14 | 12 | 4.5 |
| C1 | Quadruple structure cubic grains | 0.28 | 15 | 4.5 |
| D1 | Quadruple structure cubic grains | 0.35 | 15 | 4.5 |
| El | Polydisperse twin crystal grains | 1.15 | 28 | 3.0 |
| F1 | Surface low-iodide triple structure monodisperse cubic grains | 0.32 | 12 | 2.0 |
| G1 | Surface low-iodide triple structure cubic grains into which Rh salt is doped | 0.35 | 16 | 4.7 |
| H1 | Quadruple structure cubic grains | 0.43 | 12 | 4.7 |
| I1 | Monodisperse tabular grains Aspect ratio 6.0 | 0.56 | 14 | 4.0 |
| J1 | Monodisperse tabular grains Aspect ratio 9.0 | 1.20 | 18 | 3.0 |
| K1 | Surface low-iodide triple structure cubic grains into which Rh salt is doped | 0.25 | 8 | 2.2 |
| L1 | Surface low-iodide triple structure cubic grains | 0.22 | 12 | 2.2 |
| Ml | Surface low-iodide triple structure cubic grains | 0.46 | 13 | 2.2 |
| N1 | Polydisperse twin crystal grains | 0.72 | 25 | 1.5 |
| O1 | Polydisperse tabular grains Aspect ratio 2.5 | 1.82 | 28 | 1.5 |

TABLE 5

Spectral sensitization of respective emulsions

| Emulsion | Sensitizing dye added | Addition amount ($10^{-4}$ mol/mol Ag) |
|---|---|---|
| A1 | S1-1/S1-2 | 4.0/4.0 |
| B1 | S1-1/S1-2 | 4.0/4.0 |
| C1 | S1-1/S1-2 | 1.9/1.9 |
| D1 | S1-1/S1-2 | 1.7/1.7 |
| El | S1-1/S1-2 | 1.7/0.6 |
| F1 | S1-3/S1-4 | 6.0/0.6 |
| G1 | S1-3/S1-4 | 5.0/0.5 |
| H1 | S1-3/S1-4 | 2.5/0.3 |
| I1 | S1-4 | 5.0 |
| J1 | S1-4 | 3.0 |
| K1 | S1-5 | 3.2 |
| L1 | S1-5 | 4.1 |
| Ml | S1-5 | 3.0 |
| N1 | S1-5 | 1.7 |
| O1 | S1-5 | 2.0 |

Samples B102 to B106 were prepared in the same manner as for the sample B101 except that the couplers and red-sensitive emulsions contained therein and further red-sensitive layer coating amounts were changed as indicated in Table 6. Changing of couplers with respect to each of the color-sensitive layers was conducted in the following manner.

(Red-sensitive Layer)

Couplers Cp-1, 2 were replaced by coupler CC-2 in a molar ratio of 0.5, and the coupler Cp-3 in a molar ratio of 0.6. In accordance with the coupler replacement, the high-boiling organic solvent was replaced as indicated with respect to the sample A102 in Example-1.

Further, without changing the emulsion ratio of each of the layers, the emulsion coating amount was decreased to, relative to that of the sample B101, 0.8-fold with respect to the low-speed layer, 0.7-fold with respect to the medium-speed layer and 0.6-fold with respect to the high-speed layer.

(Green-sensitive Layer)

Coupler Cp-4 was replaced by a mixture (molar ratio: 1:1) of couplers MC-31, 32 in a molar ratio of 0.7, and each of the couplers Cp-5, 6, 7 in a molar ratio of 0.6. In accordance with the coupler replacement, high-boiling organic solvent Oil-A was added in a mass ratio of 0.20 to the total amount of couplers.

Further, without changing the emulsion ratio of each of the layers, the emulsion coating amount was decreased to, relative to that of the sample B101, 1.0-fold with respect to the low-speed layer, 0.8-fold with respect to the medium-speed layer and 0.6-fold with respect to the high-speed layer.

(Blue-sensitive Layer)

Couplers Cp-8, 9 was replaced by coupler YC-46 in a molar ratio of 0.7, and the coupler Cp-10 in a molar ratio of 0.9.

Further, without changing the emulsion ratio of each of the layers, the emulsion coating amount was decreased to, relative to that of the sample B101, 0.8-fold with respect to both the low-speed layer and the high-speed layer.

The high-boiling organic solvent, additive, gelatin, etc. not listed in Table 6 are unchanged from those of the sample B101. Red-sensitive emulsions A2-E2 and A3-E3 were prepared in the same manner as for the emulsion A1-E1 except that the addition amounts of sensitizing dyes were changed as indicated in Table 7.

TABLE 7

| Emulsion | Sensitizing dye added | Addition amount ($10^{-4}$ mol/mol Ag) |
|---|---|---|
| A2 | S1-1/S1-2 | 2.0/6.0 |
| B2 | S1-1/S1-2 | 2.0/6.0 |
| C2 | S1-1/S1-2 | 1.0/3.0 |
| D2 | S1-1/S1-2 | 0.9/2.6 |
| E2 | S1-1/S1-2 | 0.9/1.5 |
| A3 | S1-2/S1-6 | 4.0/4.0 |
| B3 | S1-2/S1-6 | 4.0/4.0 |
| C3 | S1-2/S1-6 | 1.9/1.9 |
| D3 | S1-2/S1-6 | 1.7/1.7 |
| E3 | S1-2/S1-6 | 1.7/0.6 |

The thus obtained photosensitive materials were processed by the same procedure as in the image-forming method of item A above, thereby forming duplicate images.

TABLE 6

| Sample | Emulsion in Red-sensitive layer | λmax(nm) ※ | Coupler in red-sensitive layer: Low-speed layer | Medium-speed layer | High-speed layer | Coupler in green-sensitive layer: Low-speed layer | Medium-speed layer | High-speed layer | Coupler in blue-sensitive layer: Low-Speed layer | High-Speed layer |
|---|---|---|---|---|---|---|---|---|---|---|
| B101 | A1, B1, C1, D1, E1 | 675 | Cp-1, 2 | Cp-1, 2 | Cp-1, 2, 3 | Cp-4, 5, 6, 7 | Cp-4, 5, 7 | Cp-4, 5, 7 | Cp-8 | Cp-8, 9, 10 |
| B102 | A3, B3, C3, D3, E3 | 625 | Cp-1, 2 | Cp-1, 2 | Cp-1, 2, 3 | Cp-4, 5, 6, 7 | Cp-4, 5, 7 | Cp-4, 5, 7 | Cp-8 | Cp-8, 9, 10 |
| B103 | A2, B2, C2, D2, E2 | 665 | Cp-1, 2 | Cp-1, 2 | Cp-1, 2, 3 | Cp-4, 5, 6, 7 | Cp-4, 5, 7 | Cp-4, 5, 7 | Cp-8 | Cp-8, 9, 10 |
| B104 | A2, B2, C2, D2, E2 | 665 | CC-2 | CC-2 | CC-2 | Cp-4, 5, 6, 7 | Cp-4, 5, 7 | Cp-4, 5, 7 | Cp-8 | Cp-8, 9, 10 |
| B105 | A2, B2, C2, D2, E2 | 665 | CC-2 | CC-2 | CC-2 | MC-31, 32 | MC-31, 32 | MC-31, 32 | Cp-8 | Cp-8, 9, 10 |
| B106 | A2, B2, C2, D2, E2 | 665 | CC-2 | CC-2 | CC-2 | MC-31, 32 | MC-31, 32 | MC-31, 32 | YC-46 | YC-46 |

※λmax was measured at D = 0.5, 1.0, 1.5 and 2.0 to reveal that λmaxs at the respective densities were the same.

All the experiments were carried out under the above conditions.

Evaluation was made as to whether each step of density of obtained duplicate gray charts reproduces the original or as to whether the duplicate of color checker chart, flowers, landscape, etc. reproduces the original. The method of evaluation comprised a sensorial evaluation of obtained images. (Evaluation was conducted by ten persons engaged in image evaluation at the Ashigara Laboratory of Fuji Photo Film Co., Ltd. and five assistants for them. Each grader was given 10 marks and graded images, and the sore was averaged. The greater the score, the greater the image excellence.)

A summary of the obtained results is listed in Table 8.

TABLE 8

| Run No. | Photosensitive material for forming original images | Photosensitive material for forming duplicate images | Gray balance of duplicate images | Color reproducibility (hue, saturation) | Remarks 1 | Remarks 2 |
|---|---|---|---|---|---|---|
| 1 | A101 | B102 | 9.3 | 6.0 | | Comp. |
| 2 | A102 | B101 | 0 | 6.3 | Gray became excessively brown | Comp. |
| 3 | A102 | B102 | 0 | 4.1 | Gray became excessively brown | Comp. |
| 4 | A102 | B103 | 9.4 | 8.5 | | Inv. |
| 5 | A102 | B104 | 9.5 | 9.1 | | Inv. |
| 6 | A102 | B105 | 9.6 | 9.7 | | Inv. |
| 7 | A102 | B106 | 9.6 | 9.7 | | Inv. |

C; Evaluation of Color Reproduction

Each of the samples A101, A102 was cut into 35 mm widths, formed into cartridge configuration, charged in a camera, used to shoot a Macbeth-made color checker chart, gray chart (chart of different-density 16-step pattern), flowers, landscape, etc., and subjected to the aforementioned development processing. The shooting was effected while changing filters at the shooting so as to realize a satisfactory gray balance at a visual density of 1.0 with respect to all the samples.

The thus obtained original images were irradiated with tungsten rays, printed on the samples B101 to B106 in combinations as indicated in Table 8, and developed to thereby obtain duplicates. With respect to shooting conditions, filter conditions capable of reproduction of a step of 1.0 density into neutral gray with the use of sample A101 as original and sample B101 for duplication were determined.

It is apparent from Table 8 that duplicates of satisfactory gray balance and excellent color reproduction can be obtained according to the present invention.

Example-2

The following silver halide color photosensitive material for use as an original, Sample C101, was prepared Preparation of Sample C101

(i) Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

(ii) Components of Undercoat Layer

The two surfaces of the triacetylcellulose film were provided with the following undercoating. Numbers represent weight contained per liter of an undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

Coating of Back Layers (iii) One surface of the undercoated support was coated with the following back layers.

| | |
|---|---|
| 1st layer | |
| Binder: acid-processed gelatin (isoelectric point: 9.0) | 1.00 g |
| Polymeric latex: PX-2 (average grain size: 0.1 μm) | 0.13 g |
| Polymeric latex: PX-4 (average grain size 0.2 μm) | 0.23 g |
| Ultraviolet absorbent UX-1 | 0.030 g |
| Ultraviolet absorbent UX-2 | 0.010 g |
| Ultraviolet absorbent UX-3 | 0.010 g |
| Ultraviolet absorbent UX-4 | 0.020 g |
| High-boiling organic solvent OilX-2 | 0.030 g |
| Surfactant WX-2 | 0.010 g |
| Surfactant WX-4 | 3.0 mg |
| 2nd layer | |
| Binder: acid-processed gelatin (isoelectric point: 9.0) | 3.10 g |
| Polymeric latex: PX-4 (average grain size: 0.2 μm) | 0.11 g |
| Ultraviolet absorbent UX-1 | 0.030 g |
| Ultraviolet absorbent UX-3 | 0.010 g |
| Ultraviolet absorbent UX-4 | 0.020 g |
| High-boiling organic solvent OilX-2 | 0.030 g |
| Surfactant WX-2 | 0.010 g |
| Surfactant WX-4 | 3.0 mg |
| Dye DX-2 | 0.10 g |
| Dye DX-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point: 9.0) | 3.30 g |
| Surfactant WX-3 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant WX-2 | 0.060 g |
| Surfactant WX-1 | 7.0 mg |
| Hardener HX-1 | 0.23 g |

(iv) Coating of photosensitive emulsion layers

The following photosensitive emulsion layers were coated on the opposite side of the support to the side on which the back layers were coated to make Sample C101. Numbers represent addition amounts per $m^2$ of the coating surface. Note that the effects of added compounds are not restricted to the described purposes.

The gelatin set forth below were those having molecular weight (weight average molecular weight) of 100,000 to 200,000. Contents of main metal ions were 2,500 to 3,000 ppm of calcium, 1 to 7 ppm of iron, and 1,500 to 3,000 ppm of sodium.

Gelatin having calcium content of 1,000 or less were also used in combination.

The organic compounds to be contained were prepared as emulsified dispersions containing gelatin (WX-2, Wx-3 and Wx-4 were used as surfactants). Each of the photosensitive emulsions and yellow colloidal silver were also prepared as gelatin dispersions. The thus prepared dispersions were mixed to prepare coating solutions so that the described addition amounts are obtained, and served to coating for respective layers. CpdX-H, -O, -P and -Q, dye DX-1, -2, -3, -5, -6, -8, -9 and -10, HX-1, PX-3 and FX-1 to -9 were dissolved in water or a suitable water miscible organic solvent such as methanol, dimethylformamide, ethanol or dimethylacetamide, and added to the coating solutions for the respective layers.

The gelatin concentrations (weight of solid gelatin/coating liquid volume) of the thus prepared layers were in the range of 2.5% to 15%, pH's of the respective coating solutions were in the range of 5.0 to 8.5, and pAg's of the respective coating solutions containing silver halide emulsions were in the range of 7.0 to 9.5 when the pH's and temperatures thereof were adjusted to 6.0 and 40° C., respectively.

After the coating, the sample was obtained by drying steps of multiple stages in which the temperatures were maintained in the range of 10° C. to 45° C.

| | | |
|---|---|---|
| 1st layer: Antihalation layer | | |
| Black colloidal silver | | 0.20 g |
| Gelatin | | 2.20 g |
| Compound CpdX-B | | 0.010 g |
| Ultraviolet absorbent UX-1 | | 0.050 g |
| Ultraviolet absorbent UX-3 | | 0.020 g |
| Ultraviolet absorbent UX-4 | | 0.020 g |
| Ultraviolet absorbent UX-5 | | 0.010 g |
| Ultraviolet absorbent UX-2 | | 0.070 g |
| Compound CodX-F | | 0.20 g |
| High-boiling organic solvent OilX-2 | | 0.020 g |
| High-boiling organic solvent OilX-6 | | 0.020 g |
| Dye DX-4 | | 1.0 mg |
| Dye DX-8 | | 1.0 mg |
| Fine crystal solid dispersion of dye EX-1 | | 0.05 g |
| 2nd layer: Interlayer | | |
| Gelatin | | 0.4 g |
| Compound CpdX-F | | 0.050 g |
| Compound CpdX-R | | 0.020 g |
| Compound CpdX-S | | 0.020 g |
| High-boiling organic solvent OilX-6 | | 0.010 g |
| High-boiling organic solvent OilX-7 | | 5.0 mg |
| High-boiling organic solvent OilX-8 | | 0.020 g |
| Dye DX-11 | | 2.0 mg |
| Dye DX-7 | | 4.0 mg |
| 3rd layer: Interlayer | | |
| Gelatin | | 0.4 g |
| 4th layer: Photosensitive emulsion layer | | |
| Emulsion RX | silver | 0.20 g |
| Emulsion SX | silver | 0.10 g |
| Silver iodide emulsion grains (cubic grains, av. equivalent | silver | 0.050 g |

-continued

| | | |
|---|---|---|
| sphere diameter 0.05 μm) | | |
| Gelatin | | 0.5 g |
| Compound CpdX-F | | 0.030 g |
| High-boiling organic solvent OilX-6 | | 0.010 g |
| 5th layer: Photosensitive emulsion layer | | |
| Emulsion UX | silver | 0.20 g |
| Gelatin | | 0.4 g |
| 6th layer: Inter layer | | |
| Gelatin | | 1.50 g |
| Compound CodX-M | | 0.10 g |
| Compound CodX-D | | 0.010 g |
| Compound CodX-K | | 3.0 mg |
| Compound CodX-O | | 3.0 mg |
| Compound CodX-T | | 5.0 mg |
| Ultraviolet absorbent UX-6 | | 0.010 g |
| High-boiling organic solvent OilX-6 | | 0.010 g |
| High-boiling organic solvent OilX-3 | | 0.010 g |
| High-boiling organic solvent OilX-4 | | 0.010 g |
| 7th layer: Low-speed red-sensitive emulsion layer | | |
| Emulsion AX | silver | 0.15 g |
| Emulsion BX | silver | 0.10 g |
| Emulsion CX | silver | 0.15 g |
| Yellow colloidal silver | silver | 1.0 mg |
| Gelatin | | 0.60 g |
| Coupler CX-1 | | 0.15 g |
| Coupler CX-2 | | 7.0 mg |
| Ultraviolet absorbent UX-2 | | 3.0 mg |
| Compound CpdX-J | | 2.0 mg |
| High-boiling organic solvent OilX-5 | | 0.050 g |
| High-boiling organic solvent OilX-10 | | 0.020 g |
| 8th layer: Interlayer | | |
| Emulsion CX | silver | 0.20 g |
| Emulsion DX | silver | 0.15 g |
| Internally fogged silver bromide emulsion grains (cubic grains, average equivalent sphere diameter 0.11 μm) | silver | 0.010 g |
| Gelatin | | 0.60 g |
| Coupler CX-1 | | 0.15 g |
| Coupler CX-2 | | 7.0 mg |
| High-boiling organic solvent OilX-5 | | 0.050 g |
| High-boiling organic solvent OilX-10 | | 2.0 mg |
| 9th layer: High-speed red-sensitive emulsion layer | | |
| Emulsion EX | silver | 0.15 g |
| Emulsion FX | silver | 0.20 g |
| Gelatin | | 1.50 g |
| Coupler CX-1 | | 0.70 g |
| Coupler CX-2 | | 0.025 g |
| Coupler CX-3 | | 0.020 g |
| Coupler CX-8 | | 3.0 mg |
| Ultraviolet absorbent UX-1 | | 0.010 g |
| High-boiling organic solvent OilX-5 | | 0.25 g |
| High-boiling organic solvent OilX-9 | | 0.05 g |
| High-boiling organic solvent OilX-10 | | 0.10 g |
| Compound CpdX-D | | 3.0 mg |
| Compound CpdX-L | | 1.0 mg |
| Compound CpdX-T | | 0.050 g |
| Additive PX-1 | | 0.010 g |
| Additive PX-3 | | 0.010 g |
| Dye DX-8 | | 1.0 mg |
| 10th layer Interlayer | | |
| Gelatin | | 0.50 g |
| Additive PX-2 | | 0.030 g |
| Dye DX-5 | | 0.010 g |
| Dye DX-9 | | 6.0 mg |
| Compound CpdX-I | | 0.020 g |
| Compound CpdX-O | | 3.0 mg |
| Compound CpdX-P | | 5.0 mg |
| 11th layer: Interlayer | | |
| Yellow colloidal silver | silver | 3.0 mg |

-continued

| | | |
|---|---|---|
| Gelatin | | 1.00 g |
| Additive PX-2 | | 0.010 g |
| Compound CpdX-A | | 0.030 g |
| Compound CpdX-M | | 0.10 g |
| Compound CpdX-O | | 2.0 mg |
| Ultraviolet absorbent UX-1 | | 0.010 g |
| Ultraviolet absorbent UX-2 | | 0.010 g |
| Ultraviolet absorbent UX-5 | | 5.0 mg |
| High-boiling organic solvent OilX-3 | | 0.010 g |
| High-boiling organic solvent OilX-6 | | 0.10 g |
| High-boiling organic solvent OilX-10 | | |
| 12th layer: Low-speed green-sensitive emulsion layer | | |
| Emulsion GX | silver | 0.15 g |
| Emulsion HX | silver | 0.15 g |
| Emulsion IX | silver | 0.15 g |
| Gelatin | | 1.00 g |
| Coupler CX-4 | | 0.060 g |
| Coupler CX-5 | | 0.10 g |
| Compound CpdX-B | | 0.020 g |
| Compound CpdX-G | | 2.5 mg |
| Compound CpdX-K | | 1.0 mg |
| High-boiling organic solvent OilX-2 | | 0.010 g |
| High-boiling organic solvent OilX-5 | | 0.020 g |
| 13th layer: Medium-speed green-sensitive emulsion layer | | |
| Emulsion IX | silver | 0.10 g |
| Emulsion JX | silver | 0.20 g |
| Gelatin | | 0.50 g |
| Coupler CX-4 | | 0.10 g |
| Coupler CX-5 | | 0.050 g |
| Coupler CX-6 | | 0.010 g |
| Compound CpdX-B | | 0.020 g |
| Compound CpdX-U | | 8.0 mg |
| High-boiling organic solvent OilX-2 | | 0.010 g |
| High-boiling organic solvent OilX-5 | | 0.020 g |
| Additive PX-1 | | 0.010 g |
| 14th layer: High-speed green-sensitive emulsion layer | | |
| Emulsion JX | silver | 0.15 g |
| Emulsion KX | silver | 0.25 g |
| Internally fogged silver bromide emulsion grains (cubic grains, average equivalent sphere diameter 0.11 μm) | silver | 5.0 mg |
| Gelatin | | 1.20 g |
| Coupler CX-4 | | 0.50 g |
| Coupler CX-5 | | 0.20 g |
| Coupler CX-7 | | 0.10 g |
| Compound CpdX-B | | 0.030 g |
| Compound CpdX-U | | 0.020 g |
| High-boiling organic solvent OilX-5 | | 0.15 g |
| Additive PX-1 | | 0.030 g |
| 15th layer: Yellow filter layer | | |
| Yellow colloidal silver | silver | 2.0 mg |
| Gelatin | | 1.0 g |
| Compound CpdX-C | | 0.010 g |
| Compound CpdX-M | | 0.020 g |
| High-boiling organic solvent OilX-1 | | 0.020 g |
| High-boiling organic solvent OilX-6 | | 0.020 g |
| Fine crystal solid dispersion of dye EX-2 | | 0.25 g |
| 16th layer: Photosensitive emulsion layer | | |
| Emulsion TX | silver | 0.15 g |
| Gelatin | | 0.40 g |
| Coupler CX-1 | | 5.0 mg |
| Coupler CX-2 | | 0.5 mg |
| High-boiling organic solvent OilX-5 | | 2.0 mg |
| Compound CpdX-Q | | 0.20 g |
| Dye DX-6 | | 2.0 mg |
| 17th layer: Low-speed blue-sensitive emulsion layer | | |
| Emulsion LX | silver | 0.10 g |

-continued

| | | |
|---|---|---|
| Emulsion MX | silver | 0.10 g |
| Emulsion NX | silver | 0.10 g |
| Internally and surface fogged silver bromide emulsion grains (cubic grains, average equivalent sphere diameter 0.11 μm) | silver | 0.010 g |
| Gelatin | | 0.80 g |
| Coupler CX-8 | | 0.020 g |
| Coupler CX-9 | | 0.020 g |
| Coupler CX-10 | | 0.20 g |
| Compound Cpd-B | | 0.010 g |
| Compound Cpd-I | | 8.0 mg |
| Compound Cpd-K | | 2.0 mg |
| Ultraviolet absorbent UX-5 | | 0.010 g |
| Additive PX-1 | | 0.020 g |
| 18th layer: Medium-speed blue-sensitive emulsion layer | | |
| Emulsion NX | silver | 0.20 g |
| Emulsion OX | silver | 0.20 g |
| Gelatin | | 0.80 g |
| Coupler CX-8 | | 0.030 g |
| Coupler CX-9 | | 0.030 g |
| Coupler CX-10 | | 0.30 g |
| Compound CpdX-B | | 0.015 g |
| Compound CpdX-E | | 0.020 g |
| Compound CpdX-N | | 2.0 mg |
| Compound CpdX-T | | 0.010 g |
| Ultraviolet absorbent UX-5 | | 0.015 g |
| Additive PX-1 | | 0.030 g |
| 19th layer: High-speed blue-sensitive emulsion layer | | |
| Emulsion PX | silver | 0.20 g |
| Emulsion QX | silver | 0.15 g |
| Gelatin | | 2.00 g |
| Coupler CX-8 | | 0.10 g |
| Coupler CX-9 | | 0.15 g |
| Coupler CX-10 | | 1.10 g |
| Coupler CX-3 | | 0.010 g |
| High-boiling organic solvent OilX-5 | | 0.020 g |
| Compound CpdX-B | | 0.060 g |
| Compound CpdX-D | | 3.0 mg |
| Compound CpdX-E | | 0.020 g |
| Compound CpdX-F | | 0.020 g |
| Compound CpdX-N | | 5.0 mg |
| Compound CpdX-T | | 0.070 g |
| Ultraviolet absorbent UX-5 | | 0.060 g |
| Additive PX-1 | | 0.10 g |

-continued

| | | |
|---|---|---|
| 20th layer: 1st protective layer | | |
| Gelatin | | 0.70 g |
| Ultraviolet absorbent UX-1 | | 0.020 g |
| Ultraviolet absorbent UX-5 | | 0.030 g |
| Ultraviolet absorbent UX-2 | | 0.10 g |
| Compound CpdX-B | | 0.030 g |
| Compound CpdX-O | | 5.0 mg |
| Compound CpdX-A | | 0.030 g |
| Compound CpdX-H | | 0.20 g |
| Dye DX-1 | | 2.0 mg |
| Dye DX-2 | | 3.0 mg |
| Dye DX-3 | | 2.0 mg |
| High-boiling organic solvent OilX-2 | | 0.020 g |
| High-boiling organic solvent OilX-3 | | 0.030 g |
| 21st layer: 2nd protective layer | | |
| Silver iodobromide emulsion grains (average equivalent sphere diameter 0.06 μm, silver iodide content: 1 mol %) | silver | 0.10 g |
| Gelatin | | 0.80 g |
| Ultraviolet absorbent UX-2 | | 0.030 g |
| Ultraviolet absorbent UX-5 | | 0.030 g |
| High-boiling organic solvent OilX-2 | | 0.010 g |
| 22nd layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SOX-1 | | 0.20 g |
| Surfactant WX-1 | | 0.010 g |
| Surfactant WX-2 | | 0.040 g |

In addition to the above compositions, additives FX-1 to FX-9 were added to all emulsion layers. Also, a gelatin hardener HX-1 and surfactants WX-2, WX-3, and W-4 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

Sample C101 prepared as above had a coating film thickness at dry state of 25.8 μm, and a swelling ratio when swelled with purified water at 25° C. was 1.78 times.

TABLE 9

Constitution of silver halide emulsions AX-UX

| | Silver iodobromide emulsion used in Sample C101 | | | | | | | | | | | |
|---|---|---|---|---|---|---|---|---|---|---|---|---|
| | | | | | | | | Other characteristics | | | | |
| Emulsion | Characteristics | Av. ESD (μm) | COV (%) | Av. AgI content (mol %) | Structure in halide composition of silver halide grains | AgI content at grain surface (mol %) | (1) | (2) | (3) | (4) | (5) |
| AX | Monodisperse tetradecahedral grains | 0.18 | 10 | 3.5 | Triple structure | 2.5 | ○ | ○ | | ○ | |
| BX | Monodisperse (111) tabular grains Av. aspect ratio 3.0 | 0.20 | 10 | 2.5 | Quadruple structure | 2.5 | | | ○ | | ○ |
| CX | Monodisperse (111) tabular grains Av. aspect ratio 4.5 | 0.32 | 11 | 1.8 | Triple structure | 0.1 | | ○ | | ○ | ○ |
| DX | Monodisperse (111) tabular grains Av. aspect ratio 6.0 | 0.32 | 21 | 4.8 | Triple structure | 2.0 | | ○ | | ○ | ○ |

TABLE 9-continued

Constitution of silver halide emulsions AX-UX

| | Silver iodobromide emulsion used in Sample C101 | | | | | | | | | | |
|---|---|---|---|---|---|---|---|---|---|---|---|
| | | Av. ESD | COV | Av. AgI content | Structure in halide composition of silver | AgI content at grain surface | Other characteristics | | | | |
| Emulsion | Characteristics | (μm) | (%) | (mol %) | halide grains | (mol %) | (1) | (2) | (3) | (4) | (5) |
| EX | Monodisperse (111) tabular grains Av. aspect ratio 6.0 | 0.48 | 12 | 0 | Quadruple structure | 1.3 | | ○ | | | |
| FX | Monodisperse (111) tabular grains Av. aspect ratio 8.0 | 0.65 | 12 | 1.6 | Triple structure | 0.6 | | ○ | ○ | | ○ |
| GX | Monodisperse cubic grains | 0.14 | 9 | 3.5 | Quadruple structure | 0.3 | ○ | | ○ | ○ | |
| HX | Monodisperse cubic grains | 0.22 | 12 | 1.9 | Quadruple structure | 0.7 | | ○ | | | ○ |
| IX | Monodisperse (111) tabular grains Av. aspect ratio 4.0 | 0.35 | 12 | 3.5 | Quintuple structure | 1.5 | ○ | ○ | | ○ | ○ |
| JX | Monodisperse (111) tabular grains Av. aspect ratio 7.0 | 0.40 | 21 | 2.0 | Quadruple structure | 2.2 | | ○ | | ○ | ○ |
| KX | Monodisperse (111) tabular grains Av. aspect ratio 8.5 | 0.65 | 13 | 1.7 | Triple structure | 1.3 | ○ | ○ | ○ | | ○ |
| LX | Monodisperse tetradecahedral grains | 0.30 | 9 | 7.5 | Triple structure | 0.8 | | | ○ | | ○ |
| MX | Monodisperse tetradecahedral grains | 0.30 | 9 | 7.5 | Triple structure | 2.5 | | ○ | | ○ | |
| NX | Monodisperse (111) tabular grains Av. aspect ratio 3.0 | 0.35 | 13 | 2.1 | Quintuple structure | 4.0 | ○ | ○ | ○ | | |
| OX | Monodisperse (111) tabular grains Av. aspect ratio 5.0 | 0.45 | 9 | 2.5 | Quadruple structure | 1.0 | | ○ | ○ | ○ | ○ |
| PX | Monodisperse (111) tabular grains Av. aspect ratio 9.0 | 0.70 | 21 | 2.8 | Triple structure | 0.5 | ○ | ○ | | | ○ |
| QX | Monodisperse (111) tabular grains Av. aspect ratio 9.0 | 0.85 | 8 | 1.0 | Quadruple structure | 0.5 | ○ | ○ | | | ○ |
| RX | Monodisperse (111) tabular grains Av. aspect ratio 5.0 | 0.40 | 15 | 8.0 | Quadruple structure | 4.0 | ○ | ○ | | | ○ |
| SX | Monodisperse (111) tabular grains Av. aspect ratio 4.0 | 0.70 | 13 | 12.5 | Quadruple structure | 3.0 | | ○ | ○ | | ○ |
| TX | Monodisperse (111) tabular grains Av. aspect ratio 4.0 | 0.45 | 13 | 10.5 | Quadruple structure | 2.8 | ○ | ○ | | | ○ |
| UX | Monodisperse (111) tabular grains Av. aspect ratio 4.0 | 0.55 | 15 | 12.5 | Triple structure | 1.5 | | ○ | ○ | | ○ |

Av. ESD = Equivalent-sphere average grain size;
COV = Coefficient of variation
(Other characteristics)
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsions were after-ripped by the use of sodium thiosulfate, sodium thiocyanate, and sodium aurichloride. Note, also, a iridium salt was added during grain formation.
Note, also, that chemically-modified gelatin whose amino groups were partially converted to phthalic acid amide, was added to emulsions BX, CX, EX, HX, JX, NX, QX, RX, SX, and TX.

TABLE 10

Spectral sensitization of Emulsions AX–PX

| Emulsion | Sensitizing dye added | Addition amount per mol of silver halide (g) | Timing of adding sensitizing dye |
|---|---|---|---|
| AX | SX-1 | 0.75 | Subsequent to after-ripening |
| | SX-2 | 0.15 | Prior to after-ripening |
| | SX-3 | 0.10 | Prior to after-ripening |
| BX | SX-1 | 0.60 | Prior to after-ripening |
| | SX-2 | 0.30 | Prior to after-ripening |
| | SX-3 | 0.05 | Prior to after-ripening |
| CX | SX-1 | 0.60 | Prior to after-ripening |
| | SX-2 | 0.20 | Prior to after-ripening |
| | SX-3 | 0.07 | Prior to after-ripening |
| DX | SX-1 | 0.70 | Subsequent to after-ripening |
| | SX-2 | 0.15 | Subsequent to after-ripening |
| | SX-3 | 0.10 | Prior to after-ripening |
| EX | SX-1 | 0.75 | Prior to after-ripening |
| | SX-2 | 0.30 | Prior to after-ripening |
| | SX-3 | 0.15 | Prior to after-ripening |
| FX | SX-1 | 0.90 | Prior to after-ripening |
| | SX-2 | 0.30 | Prior to after-ripening |
| | SX-3 | 0.15 | Prior to after-ripening |
| GX | SX-4 | 0.65 | Subsequent to after-ripening |
| | SX-5 | 0.10 | Subsequent to after-ripening |
| HX | SX-4 | 0.60 | Prior to after-ripening |
| | SX-5 | 0.10 | Subsequent to after-ripening |
| IX | SX-4 | 0.70 | Prior to after-ripening |
| | SX-5 | 0.10 | Prior to after-ripening |
| JX | SX-4 | 0.70 | Prior to after-ripening |
| | SX-5 | 0.10 | Subsequent to after-ripening |
| | SX-6 | 0.08 | Subsequent to after-ripening |

TABLE 10-continued

Spectral sensitization of Emulsions AX–PX

| Emulsion | Sensitizing dye added | Addition amount per mol of silver halide (g) | Timing of adding sensitizing dye |
|---|---|---|---|
| KX | SX-4 | 0.70 | Prior to after-ripening |
| | SX-5 | 0.15 | Prior to after-ripening |
| | SX-6 | 0.10 | Prior to after-ripening |
| LX, MX | SX-6 | 0.10 | Subsequent to after-ripening |
| | SX-7 | 0.10 | Subsequent to after-ripening |
| | SX-8 | 0.50 | Subsequent to after-ripening |
| NX | SX-6 | 0.10 | Subsequent to after-ripening |
| | SX-7 | 0.15 | Subsequent to after-ripening |
| | SX-8 | 0.55 | Subsequent to after-ripening |
| OX | SX-7 | 0.20 | Subsequent to after-ripening |
| | SX-8 | 0.65 | Subsequent to after-ripening |
| PX | SX-6 | 0.06 | Subsequent to after-ripening |
| | SX-7 | 0.15 | Subsequent to after-ripening |
| | SX-8 | 0.70 | Subsequent to after-ripening |
| QX | SX-6 | 0.05 | Prior to after-ripening |
| | SX-7 | 0.15 | Prior to after-ripening |
| | SX-8 | 0.80 | Prior to after-ripening |
| RX | SX-4 | 0.40 | Subsequent to after-ripening |
| | SX-6 | 0.30 | Subsequent to after-ripening |
| SX | SX-4 | 0.40 | Subsequent to after-ripening |
| | SX-6 | 0.30 | Prior to after-ripening |
| TX | SX-7 | 0.05 | Prior to after-ripening |
| | SX-8 | 0.60 | Prior to after-ripening |
| UX | SX-1 | 0.60 | Prior to after-ripening |
| | SX-3 | 0.30 | Prior to after-ripening |

CX-1

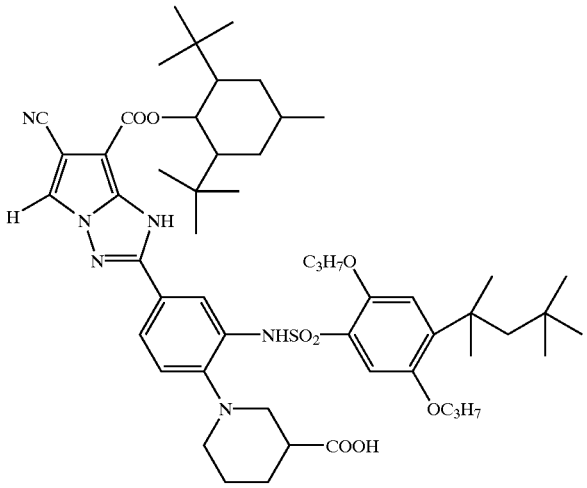

CX-2

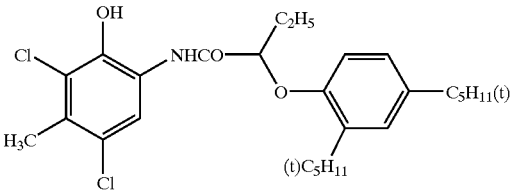

-continued
CX-3
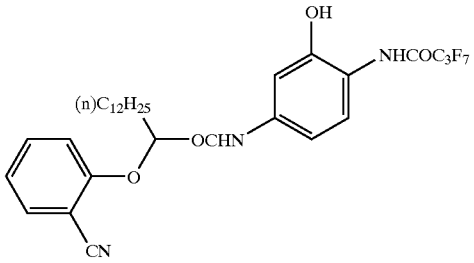
CX-4
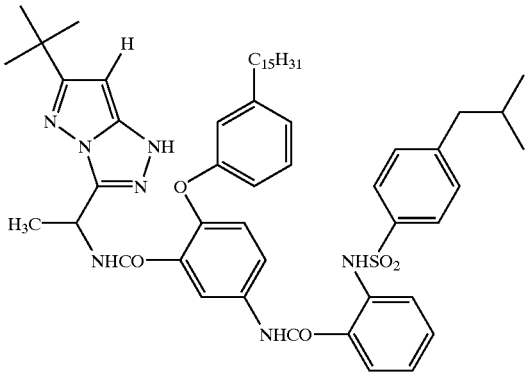
CX-5
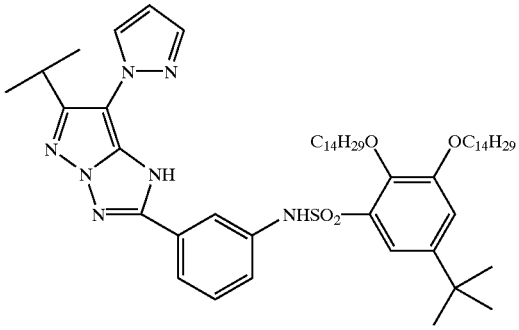
CX-6
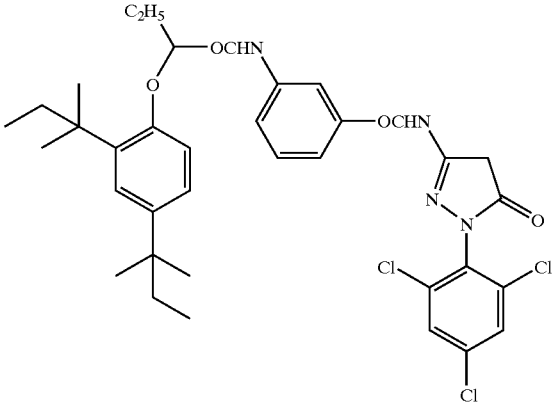
CX-7
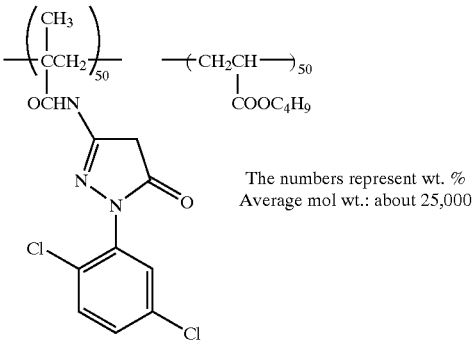
The numbers represent wt. %
Average mol wt.: about 25,000
CX-8
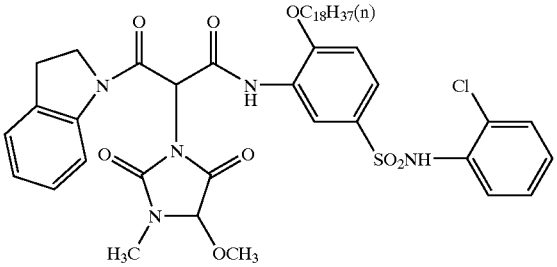
CX-9
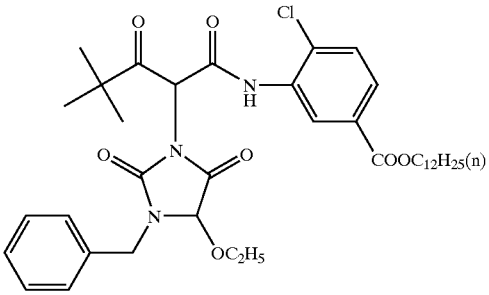
CX-10
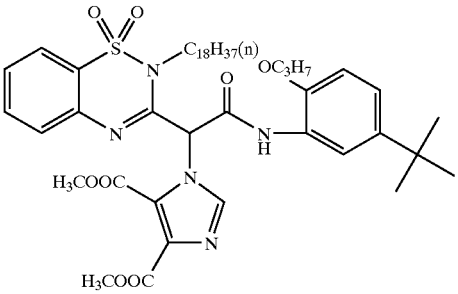
OilX-1
Tri(n-hexyl)phosphate
OilX-2
Tricresyl phosphate -continued
OilX-3
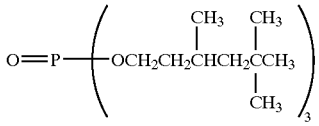
OilX-4
Tricyclohexyl phosphate
OilX-5
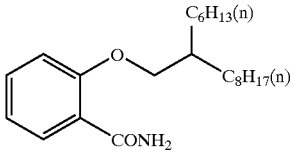
OilX-6
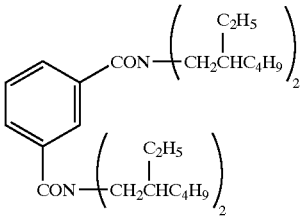
OilX-7
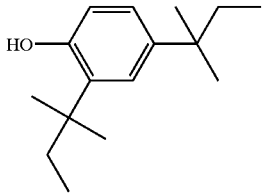
OilX-8
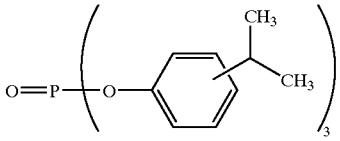
(A mixture of isomers)
OilX-9
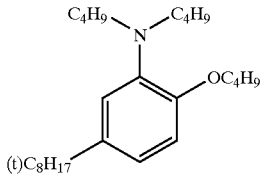
OilX-10
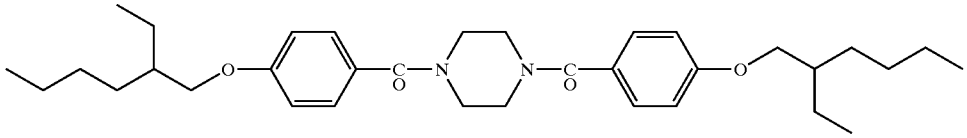
CpdX-A
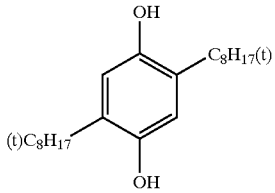
CpdX-B
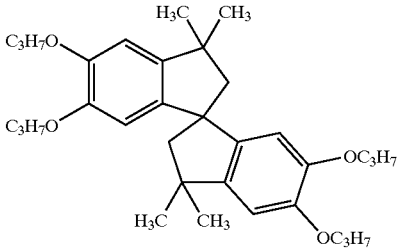
CpdX-C
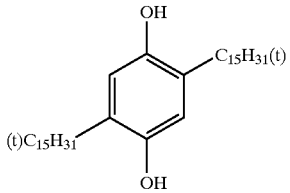
CpdX-D
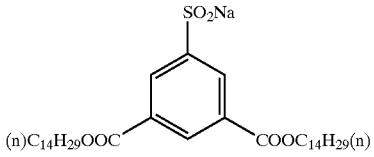
CpdX-E
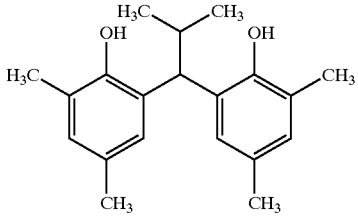
CpdX-F
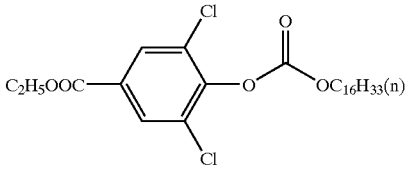

-continued
CpdX-G
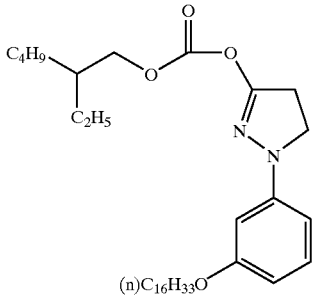
CpdX-H
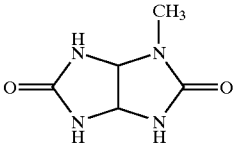
CpdX-I
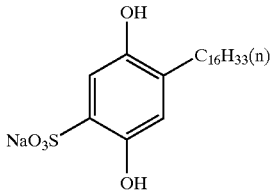
CpdX-J
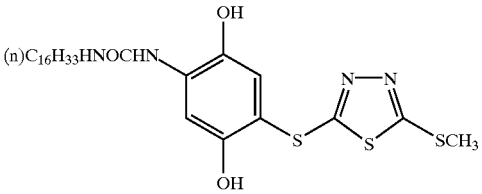
CpdX-K
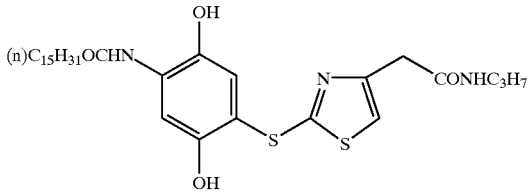
CpdX-L
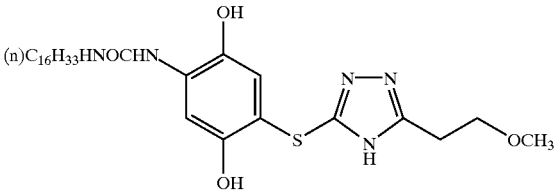
CpdX-M
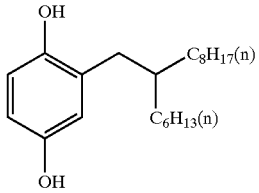
CpdX-N
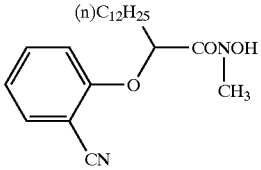
CpdX-O
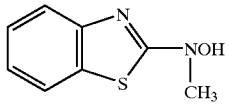
CpdX-P
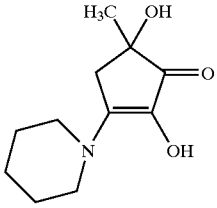
CpdX-Q
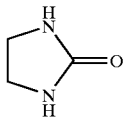
CpdX-R
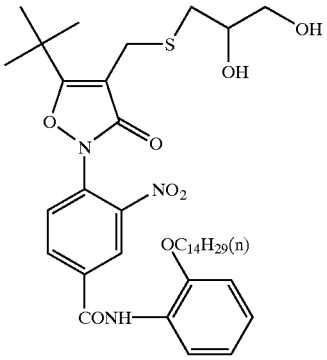

-continued
CpdX-S
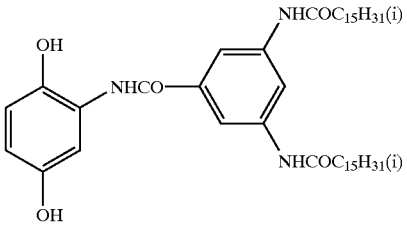
CpdX-T
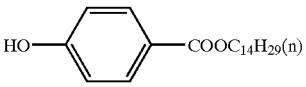
CpdX-U
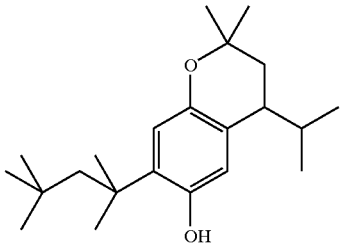
UX-1
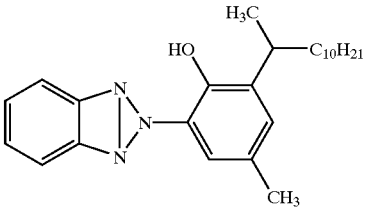
UX-2
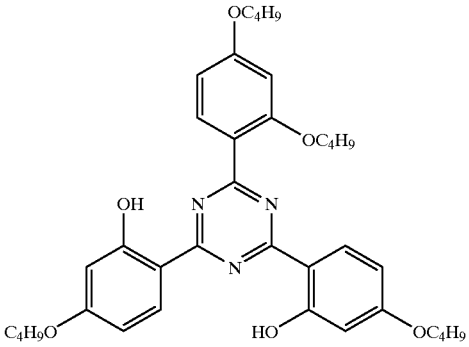
UX-3
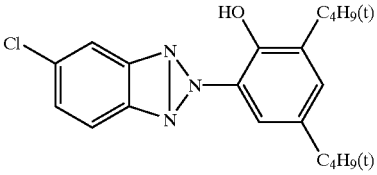
UX-4
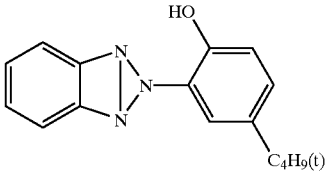
UX-5
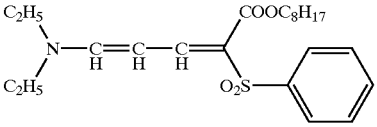
UX-6
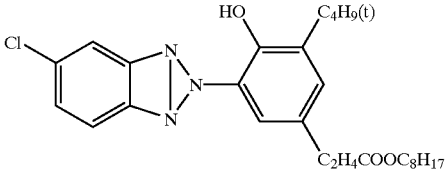
SX-1
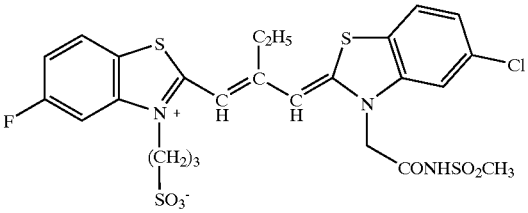
SX-2
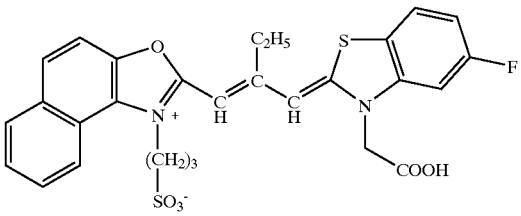
SX-3
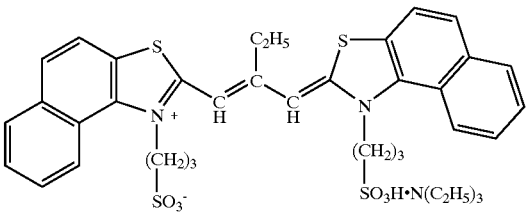

-continued
SX-4
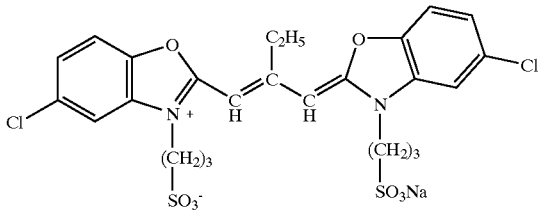
SX-5
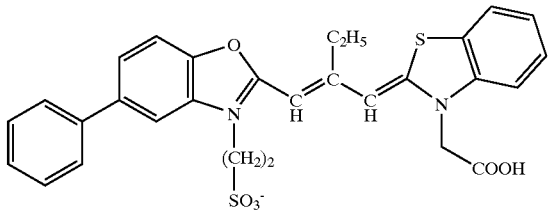
SX-6
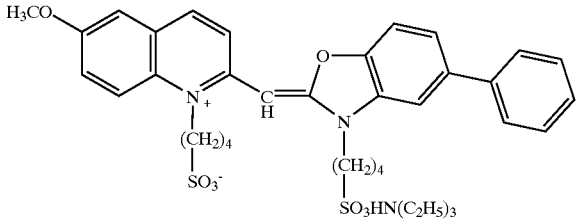
SX-7
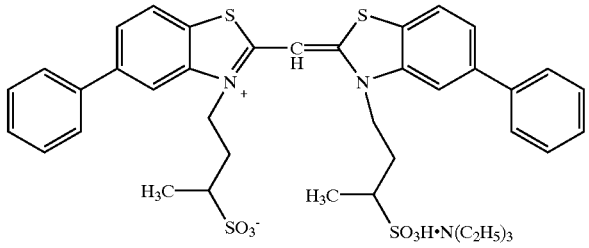
SX-8
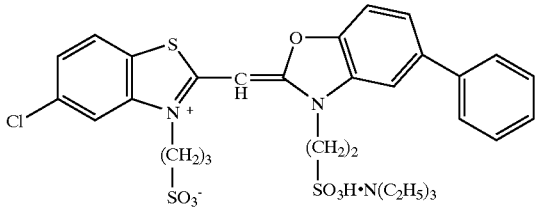
DX-1
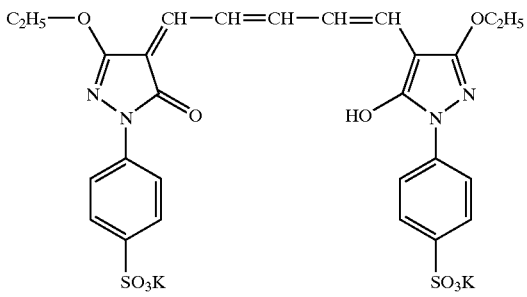
DX-2
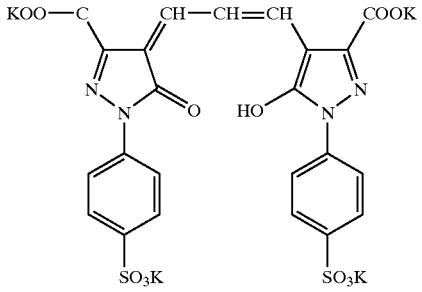
DX-3
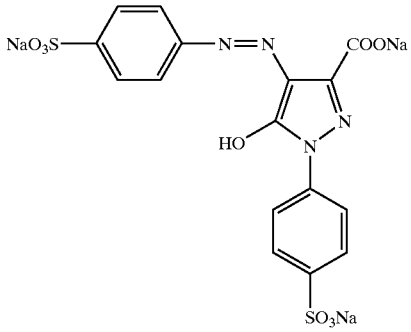
DX-4
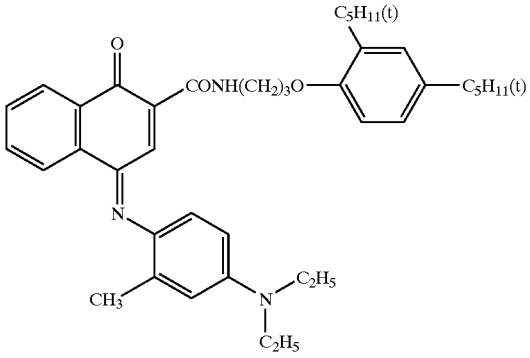
DX-5
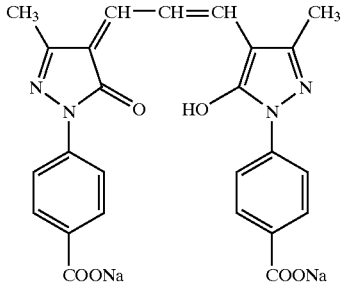

-continued
DX-6
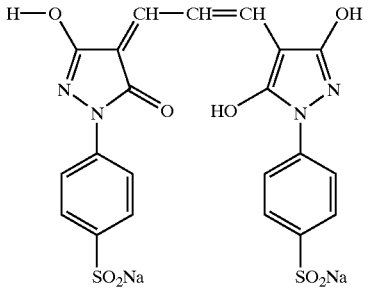
DX-7
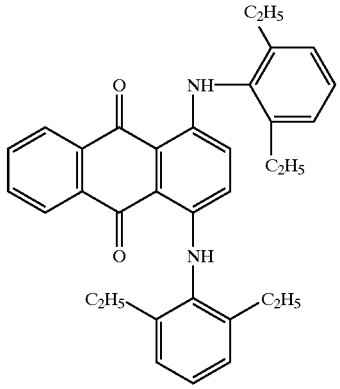
DX-8
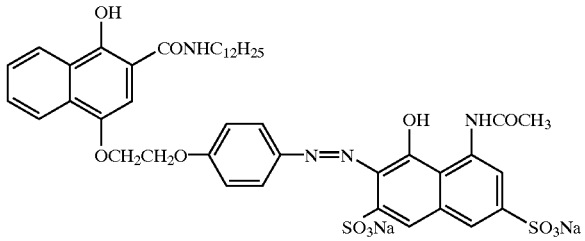
DX-9
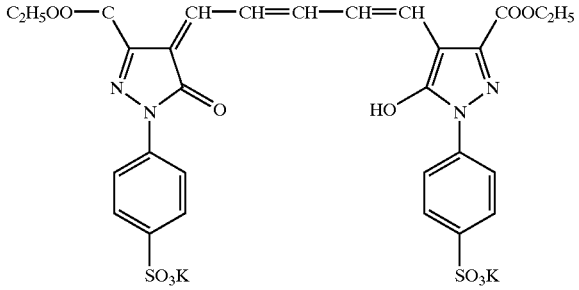
DX-10
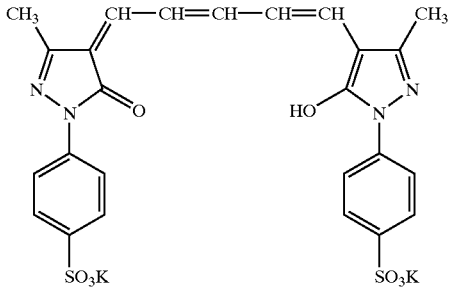
DX-11
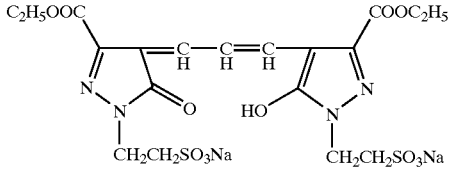
EX-1
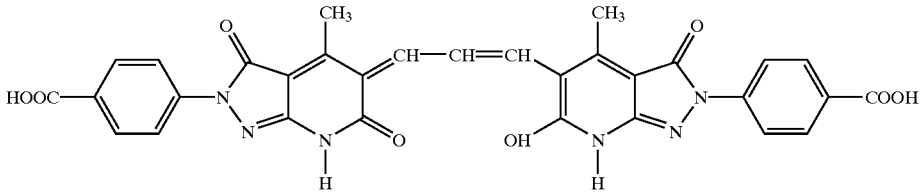
EX-2
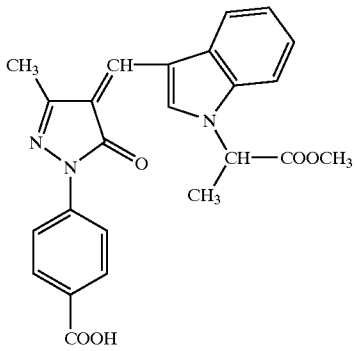
HX-1
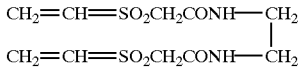

-continued
WX-1
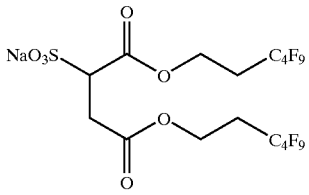
WX-2
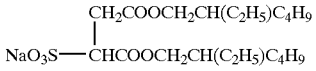
WX-3
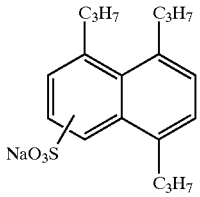
WX-4
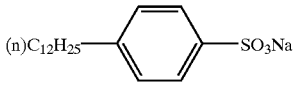
WX-5
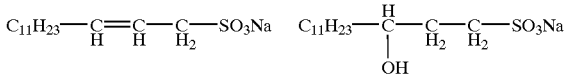
A mixture of (60%:40%)
PX-1
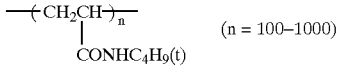
(n = 100–1000)
PX-2
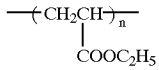
(n = 100–1000)
PX-3
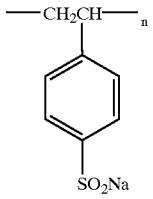
(n = 100–1000)
PX-4
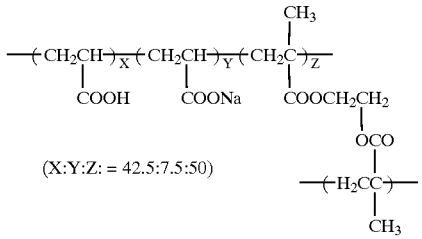
(X:Y:Z: = 42.5:7.5:50)
FX-1
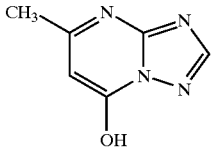
FX-2
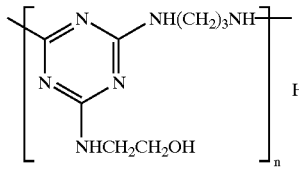
n = 3–4
FX-3
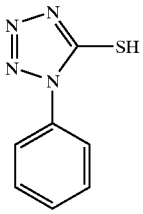
FX-4
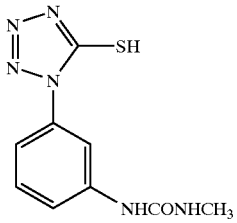
FX-5
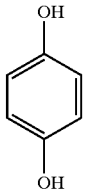

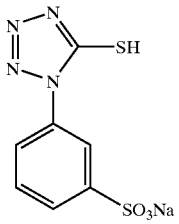

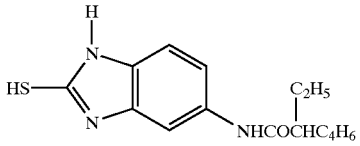

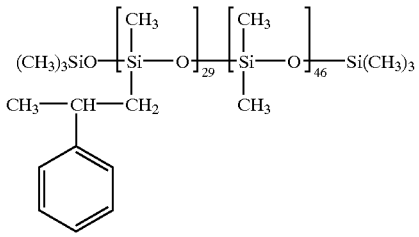

-continued

FX-6

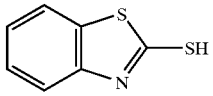

FX-7

FX-8

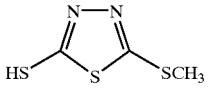

FX-9

SOX-1

Preparation of Organic Solid Dispersed Dye (Preparation of Fine Crystalline Solid Dispersion of Dye EX-1)

100 g of Pluronic F88 (an ethylene oxide-propylene oxide block copolymer) manufactured by BASF CORP. and water were added to a wet cake of the dye EX-1 (the net weight of EX-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Fine Crystalline Solid Dispersion of Dye EX-2)

Water and 270 g of W-4 were added to 1,400 g of a wet cake of EX-2 containing 30 weight % of water, and the resultant material was stirred to form a slurry having an EX-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr. This dispersion was diluted to 20 weight % by ion exchange water to obtain a fine crystalline solid dispersion of Dye EX-2. The average grain size was 0.15 $\mu$m.

Photographing was performed using this Sample C101 as a photosensitive material for use as an original, and Samples B103 and B106 were used as photosensitive material for use as a duplicate to conduct the same evaluation as in Example-1.

Good results as in Example-1 were obtained also in the duplicate by this method.

According to the method of the present invention, duplicated color images with improved saturation and gradation reproduction were able to be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of forming a color image, comprising forming an original image on an image-forming material and duplicating the formed original image on a color photosensitive material for use in the duplication, the color photosensitive material for use in the duplication comprising at least one blue-sensitive silver halide emulsion layer containing a yellow coupler, at least one green-sensitive silver halide emulsion layer containing a magenta coupler and at least one red-sensitive silver halide emulsion layer containing a cyan coupler on a support of a transmission-type or reflection-type, wherein the formed original image contains a dye formed from a cyan coupler represented by the following general formula (CC-1):

(CC-1)

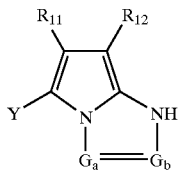

wherein Ga represents —C($R_{13}$)=or —N=; Gb represents —C($R_{13}$)= when Ga represents —N=, or Gb represents —N= when Ga represents —C($R_{13}$)=;

each of $R_{11}$ and $R_{12}$ represents an electron-withdrawing group having a Hammett substituent constant σp value of 0.20 to 1.0; $R_{13}$ represents a substituent; and Y represents a hydrogen atom or a group capable of splitting-off by a coupling reaction with an oxidized product of an aromatic primary amine color developing agent; and wherein with respect to the red-sensitive silver halide emulsion layer of the color photosensitive material for use in the duplication, the maximum sensitivity wavelength, λmax (D), of spectral sensitivity distribution at each density satisfies the relationship:

$$630\ \text{nm} \leqq \lambda\max(D) \leqq 670\ \text{nm}.$$

2. The method of forming color images according to claim 1, wherein the color photosensitive material for use in the duplication contains a cyan coupler represented by the general formula (CC-1).

3. The method of forming color images according to claim 1, wherein the color photosensitive material for use in the duplication contains a magenta coupler represented by the following general formula (MC-1):

(MC-1)

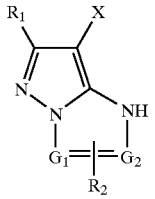

wherein $R_1$ represents a hydrogen atom or substituent; one of $G_1$ and $G_2$ represents a carbon atom, and the other represents a nitrogen atom; $R_2$ represents a substituent that substitutes one of $G_1$ and $G_2$ which is a carbon atom, wherein $R_1$ and $R_2$ may further have a substituent, or a polymer chain may be bonded to the magenta coupler via $R_1$ or $R_2$; and X represents a hydrogen atom or a group capable of splitting-off by a coupling reaction with an oxidized product of an aromatic primary amine color developing agent.

4. The method of forming color images according to claim 1, wherein the color photosensitive material for use in the duplication contains a yellow coupler represented by the following general formula (YC-1):

(YC-1)

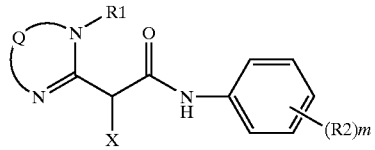

wherein Q represents a nonmetallic atomic group capable of forming 5- to 7-membered ring in cooperation with —N═C—N(R1)—; R1 represents a substituent; R2 represents a substituent; m is an integer of 0 to 5, wherein when m is 2 or greater, two or more R2s may be the same or different from each other, and may be bonded with each other to thereby form a ring; and X represents a hydrogen atom or a group capable of splitting-off by a coupling reaction with an oxidation product of a developing agent.

5. The method of forming color images according to claim 1, wherein the image-forming material is a color reversal photosensitive material.

6. The method of forming color images according to claim 1, wherein the compound represented by the general formula (CC-1) is a compound represented by the general formula (CC-2):

(CC-2)

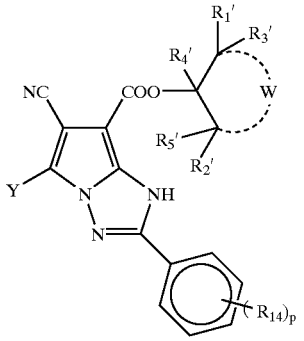

wherein $R_{14}$ represents a substituent other than a hydrogen atom; p is natural number of 1 to 5, and when p is 2 or greater, two or more $R_{14}$s may be wholly identical with or different from each other; each of $R_1'$ and $R_2'$ represents an aliphatic group; each of $R_3'$, $R_4'$ and $R5'$ represents a hydrogen atom or an aliphatic group; W represents a non-metallic atomic group required to form a 5- to 8-membered ring; and Y has the same meaning as that of general formula (CC-1).

7. The method of forming color images according to claim 6, wherein at least one of the $R_{14}$s is an amino group which substitutes at the para position.

* * * * *